US007290722B1

(12) United States Patent
Ewald

(10) Patent No.: US 7,290,722 B1
(45) Date of Patent: Nov. 6, 2007

(54) METHOD AND APPARATUS FOR MAKING SNOW

(75) Inventor: Jeffrey Allen Ewald, Bay City, MI (US)

(73) Assignee: Snow Machines, Inc., Midland, MI (US)

( * ) Notice: Subject to any disclaimer, the term of this patent is extended or adjusted under 35 U.S.C. 154(b) by 234 days.

(21) Appl. No.: 11/013,307

(22) Filed: Dec. 15, 2004

Related U.S. Application Data

(60) Provisional application No. 60/529,935, filed on Dec. 16, 2003.

(51) Int. Cl.
*A01G 15/00* (2006.01)

(52) U.S. Cl. ..... 239/14.2; 239/14.1; 239/2.2; 239/2.1; 239/296; 239/423; 239/418; 239/421

(58) Field of Classification Search ..... 239/2.1, 239/2.2, 14.1, 14.2, 421, 418, 423, 296, 280; 241/122.1, 125.1, 157
See application file for complete search history.

(56) References Cited

U.S. PATENT DOCUMENTS

| | | | |
|---|---|---|---|
| 902,863 | A | 11/1908 | Darrow |
| 1,051,672 | A | 1/1913 | Boudreaux |
| 1,213,409 | A | 1/1917 | Pfeifer |
| 1,299,380 | A | 4/1919 | Plumer |
| 1,577,225 | A | 3/1926 | Granger |
| 1,649,649 | A | 11/1927 | Bank |
| 1,748,043 | A | 2/1930 | Grupe |
| 1,950,521 | A | 3/1934 | Rudolph |
| 1,972,240 | A | 9/1934 | Rufener et al. |
| 2,049,940 | A | 8/1936 | Barthel |
| 2,136,758 | A | 11/1938 | Rosberg |
| 2,315,096 | A | 3/1943 | Sanderson et al. |
| 2,371,678 | A | 3/1945 | Crosser |
| 2,546,460 | A | 3/1951 | Leeds |
| 2,551,789 | A | 5/1951 | Copley |
| 2,571,069 | A | 10/1951 | Shearman |
| 2,582,201 | A | 1/1952 | Huntington |
| 2,592,898 | A | 4/1952 | Helberg |
| 2,594,725 | A | 4/1952 | Britt |

(Continued)

FOREIGN PATENT DOCUMENTS

| | | |
|---|---|---|
| EP | 0 089 590 A1 | 9/1983 |

(Continued)

*Primary Examiner*—Kevin Shaver
*Assistant Examiner*—Trevor McGraw
(74) *Attorney, Agent, or Firm*—Reising, Ethington, Barnes, Kisselle, P.C.; William J. Waugaman

(57) ABSTRACT

An elongated pipe conduit snow making tower, and assembly method, having an upper end spray nozzle head and pivotally supported on a support pipe for vertical inclination by a hydraulic ram jack enabling infinite non-preselected incremental inclinations. A ram safety latch automatically latch/catches the tower pipe if the jack leaks. Secondary and tertiary external flexible water hoses are selectable to feed associated spray head snowmaking nozzles, and an internal compressed air conduit feeds spray head seeding nozzles. Secondary and tertiary ball valve assemblies mounted on a water feed block are outlet coupled to their respective hoses. In drain condition turbulent primary water continually washes against a valve ball flow closure side for an anti-freezing effect. The spray head is a four-piece modular planar stack up of disks each carrying spray nozzles that all discharge forwardly away from the pipe tower in generally parallel spray patterns.

31 Claims, 23 Drawing Sheets

U.S. PATENT DOCUMENTS

| | | | |
|---|---|---|---|
| 2,608,792 | A | 9/1952 | Chater |
| 2,635,920 | A | 4/1953 | Boyce |
| 2,667,717 | A | 2/1954 | Daugherty |
| 2,676,471 | A | 4/1954 | Pierce, Jr. |
| 2,685,476 | A | 8/1954 | Spreng |
| 2,704,038 | A | 3/1955 | Horton |
| 2,769,400 | A | 11/1956 | Wallmannsberger |
| 2,840,300 | A | 6/1958 | Carr |
| 2,857,201 | A | 10/1958 | Palmer |
| 2,886,249 | A | 5/1959 | Sidlow |
| 2,938,672 | A | 5/1960 | Glatfelter |
| 2,968,164 | A | 1/1961 | Hanson |
| 2,984,444 | A | 5/1961 | Lewis |
| 2,988,287 | A | 6/1961 | Sherman |
| 3,010,660 | A | 11/1961 | Barrett |
| 3,013,401 | A | 12/1961 | Rigterink |
| 3,050,262 | A | 8/1962 | Curtis |
| 3,069,091 | A | 12/1962 | Giesse et al. |
| 3,071,083 | A | 1/1963 | Hochmuth |
| 3,127,107 | A | 3/1964 | Merryweather |
| 3,128,036 | A | 4/1964 | McBride |
| 3,146,951 | A | 9/1964 | Brown |
| 3,164,324 | A | 1/1965 | Bruinsma |
| 3,252,656 | A | 5/1966 | Greenwood |
| 3,257,815 | A | 6/1966 | Brocoff et al. |
| 3,298,612 | A | 1/1967 | Torrens |
| 3,301,485 | A | 1/1967 | Tropeano et al. |
| 3,369,754 | A | 2/1968 | Wolford |
| 3,372,827 | A | 3/1968 | Altschuler |
| 3,372,872 | A | 3/1968 | Le Bus, III et al. |
| 3,393,529 | A | 7/1968 | Torrens |
| 3,401,643 | A | 9/1968 | Kircher |
| 3,401,888 | A | 9/1968 | Sutter |
| 3,408,005 | A | 10/1968 | Struble et al. |
| 3,415,512 | A | 12/1968 | Bumbaum |
| 3,415,513 | A | 12/1968 | Bumbaum |
| 3,434,661 | A | 3/1969 | Boyle et al. |
| 3,460,764 | A | 8/1969 | Wallis |
| 3,464,625 | A | 9/1969 | Carlsson |
| 3,494,559 | A | 2/1970 | Skinner |
| 3,513,906 | A | 5/1970 | Richards |
| 3,567,116 | A | 3/1971 | Lindhof |
| 3,567,117 | A | 3/1971 | Eustis |
| 3,596,476 | A | 8/1971 | Jakob et al. |
| 3,610,527 | A | 10/1971 | Ericson et al. |
| 3,703,991 | A | 11/1972 | Eustis et al. |
| 3,706,414 | A | 12/1972 | Dupre |
| 3,716,190 | A | 2/1973 | Lindlof |
| 3,733,029 | A | 5/1973 | Eustis et al. |
| 3,760,598 | A | 9/1973 | Jakob et al.. |
| 3,761,020 | A | 9/1973 | Tropeano et al. |
| 3,762,176 | A | 10/1973 | Coggins, Jr. |
| 3,774,842 | A | 11/1973 | Howell |
| 3,774,843 | A | 11/1973 | Rice |
| 3,804,355 | A | 4/1974 | Uroshevich |
| 3,814,319 | A | 6/1974 | Loomis |
| 3,822,825 | A | 7/1974 | Dupre |
| 3,829,013 | A | 8/1974 | Ratnik |
| 3,831,844 | A | 8/1974 | Tropeano et al. |
| 3,838,815 | A | 10/1974 | Rice |
| 3,887,580 | A | 6/1975 | Patrikeev et al. |
| 3,897,904 | A | 8/1975 | Kiegerl |
| 3,908,903 | A | 9/1975 | Burns, Jr. |
| 3,923,246 | A | 12/1975 | Cloutier et al. |
| 3,923,247 | A | 12/1975 | White |
| 3,945,567 | A | 3/1976 | Rambach |
| 3,948,442 | A | 4/1976 | Dewey |
| 3,952,949 | A | 4/1976 | Dupre |
| 3,964,682 | A | 6/1976 | Tropeano et al. |
| 3,969,908 | A | 7/1976 | Lawless et al. |
| 3,979,061 | A | 9/1976 | Kircher |
| 4,004,732 | A | 1/1977 | Hanson |
| 4,050,169 | A | 9/1977 | Pasquier |
| 4,060,282 | A | 11/1977 | Kehr |
| 4,083,492 | A | 4/1978 | Dewey |
| 4,101,073 | A | 7/1978 | Curran |
| 4,105,161 | A | 8/1978 | Kircher et al. |
| 4,129,252 | A | 12/1978 | Pouring |
| 4,145,000 | A | 3/1979 | Smith et al. |
| 4,194,689 | A | 3/1980 | Ash |
| 4,199,103 | A | 4/1980 | Dupre |
| 4,200,228 | A | 4/1980 | Woerpel |
| 4,202,496 | A | 5/1980 | VanderKelen et al. |
| 4,214,700 | A | 7/1980 | VanderKelen et al. |
| 4,222,519 | A | 9/1980 | Kircher et al. |
| 4,223,836 | A | 9/1980 | Eager |
| 4,275,833 | A | 6/1981 | Fairbank |
| 4,295,608 | A | 10/1981 | White |
| 4,314,670 | A | 2/1982 | Walsh, Jr. |
| 4,353,504 | A | 10/1982 | Girardin et al. |
| 4,376,511 | A | 3/1983 | Franklin, Jr. |
| 4,383,646 | A | 5/1983 | Smith |
| 4,462,423 | A | 7/1984 | Franklin, Jr. |
| 4,465,230 | A | 8/1984 | Ash |
| 4,480,788 | A | 11/1984 | Manhart |
| 4,491,273 | A | 1/1985 | Manhart |
| 4,493,457 | A | 1/1985 | Dilworth et al. |
| 4,511,083 | A | 4/1985 | Muller-Girard |
| 4,516,722 | A | 5/1985 | Avery |
| 4,538,369 | A | 9/1985 | Pasquier |
| 4,545,529 | A | 10/1985 | Tropeano et al. |
| 4,573,636 | A | 3/1986 | Dilworth et al. |
| 4,593,854 | A | 6/1986 | Albertsson |
| 4,597,524 | A | 7/1986 | Albertsson |
| 4,634,050 | A | 1/1987 | Shippee |
| 4,640,460 | A | 2/1987 | Franklin, Jr. |
| 4,682,729 | A | 7/1987 | Doman et al. |
| 4,711,395 | A | 12/1987 | Handfield |
| 4,722,324 | A | 2/1988 | Amen |
| 4,730,774 | A | 3/1988 | Shippee |
| 4,742,958 | A | 5/1988 | Bucceri |
| 4,742,959 | A | 5/1988 | Stanchak et al. |
| 4,746,064 | A | 5/1988 | Isono et al. |
| 4,749,127 | A | 6/1988 | Ash |
| 4,759,503 | A | 7/1988 | Kraus et al. |
| 4,767,054 | A | 8/1988 | Suga et al. |
| 4,768,711 | A | 9/1988 | Suga |
| 4,773,621 | A | 9/1988 | Gebhardt |
| 4,790,531 | A | 12/1988 | Matsui et al. |
| 4,792,093 | A | 12/1988 | Suga et al. |
| 4,793,142 | A | 12/1988 | Bucceri |
| 4,793,554 | A | 12/1988 | Kraus et al. |
| 4,796,805 | A | 1/1989 | Carlberg et al. |
| 4,798,331 | A | 1/1989 | Suga |
| 4,809,514 | A | 3/1989 | Suga et al. |
| 4,813,597 | A | 3/1989 | Rumney et al. |
| 4,813,598 | A | 3/1989 | Kosik, Sr. et al. |
| 4,823,518 | A | 4/1989 | Dilworth et al. |
| 4,836,446 | A | 6/1989 | Chanel |
| 4,889,180 | A | 12/1989 | Sloan |
| 4,901,920 | A | 2/1990 | Wollin |
| 4,903,895 | A | 2/1990 | Mathewson et al. |
| 4,911,362 | A | 3/1990 | Delich |
| 4,915,302 | A | 4/1990 | Kraus et al. |
| 4,916,911 | A | 4/1990 | Duryea et al. |
| 4,917,297 | A | 4/1990 | Terhume |
| 4,919,331 | A | 4/1990 | Kosik, Sr. et al. |
| 4,976,319 | A | 12/1990 | Eberhardt et al. |
| 4,993,635 | A | 2/1991 | Dupre |
| 5,004,151 | A | 4/1991 | Dupre |
| 5,031,832 | A | 7/1991 | Ratnik et al. |
| 5,037,093 | A | 8/1991 | Roark, Jr. |
| 5,062,279 | A | 11/1991 | Kawashima et al. |
| 5,083,707 | A | 1/1992 | Holden |

5,090,619 A 2/1992 Barthold et al.
5,102,043 A 4/1992 Inoue et al.
5,102,044 A 4/1992 Inoue et al.
5,135,167 A 8/1992 Ringer
5,154,348 A 10/1992 Ratnik et al.
5,167,367 A 12/1992 VanderKelen et al.
5,169,783 A 12/1992 Kieft
5,176,320 A 1/1993 Kraus et al.
5,180,105 A 1/1993 Teague
5,180,106 A 1/1993 Handfield
5,219,746 A 6/1993 Brinegar et al.
5,272,883 A 12/1993 Matsui et al.
5,284,202 A 2/1994 Dickey et al.
5,289,973 A 3/1994 French
5,297,731 A 3/1994 Bucceri
5,301,512 A 4/1994 Yamamoto
5,322,218 A 6/1994 Melbourne
5,360,163 A 11/1994 Dupre
5,379,937 A 1/1995 Rothe
5,398,522 A 3/1995 Franklin, Jr.
5,400,965 A 3/1995 Ratnik et al.
5,400,966 A 3/1995 Weaver et al.
5,445,320 A 8/1995 Berthelier
5,518,177 A 5/1996 Weaver et al.
5,518,178 A 5/1996 Sahoo et al.
5,529,242 A 6/1996 Hedin
5,538,184 A 7/1996 Karbanowicz et al.
5,593,090 A 1/1997 Werner
5,614,107 A 3/1997 Mallia, Jr.
5,628,456 A 5/1997 Dupre
5,667,137 A 9/1997 Dupre
5,699,961 A 12/1997 Ratnik et al.
5,718,378 A 2/1998 Dupre
5,749,517 A 5/1998 Dupre
5,775,111 A 7/1998 Franklin
5,807,697 A 9/1998 Strong-Gunderson et al.
5,810,249 A 9/1998 Nilsson
5,810,251 A 9/1998 McKinney
5,823,427 A * 10/1998 Dupre et al. ..... 239/14.2
5,836,513 A 11/1998 Smith et al.
5,836,514 A 11/1998 Handfield
5,873,525 A 2/1999 Shearer
5,884,841 A 3/1999 Ratnik et al.
5,887,791 A 3/1999 Rothe
5,890,652 A 4/1999 Taylor
5,890,654 A * 4/1999 Dupre ..... 239/14.2
5,908,156 A * 6/1999 Dupre ..... 239/14.2
5,909,844 A 6/1999 Nilsson
5,934,556 A * 8/1999 Charriau et al. ..... 239/14.2
5,961,041 A 10/1999 Sekihara et al.
5,979,785 A 11/1999 McKinney
6,006,526 A 12/1999 Nilsson
6,016,970 A * 1/2000 Dupre ..... 239/14.2
6,029,468 A 2/2000 Ferris et al.
6,029,898 A 2/2000 Dupre
6,032,872 A * 3/2000 Dupre ..... 239/14.2
6,039,265 A 3/2000 Dupre et al.
6,056,203 A 5/2000 Fukuta
6,056,205 A 5/2000 Dupre
6,079,161 A 6/2000 Tomioka et al.
6,116,515 A 9/2000 Chelminski
6,119,956 A * 9/2000 McKinney ..... 239/14.2
6,129,290 A 10/2000 Nikkanen
6,152,380 A * 11/2000 Dupre ..... 239/14.2
6,161,769 A * 12/2000 Kircher et al. ..... 239/2.2
6,164,556 A 12/2000 Dupre
6,168,089 B1 1/2001 Dupre
6,182,905 B1 * 2/2001 Dupre ..... 239/2.2
6,182,906 B1 2/2001 Dupre
6,321,559 B1 11/2001 Guerra
6,378,778 B1 4/2002 Luras
6,402,047 B1 6/2002 Thomas
6,454,182 B1 9/2002 Bucceri
6,464,148 B1 10/2002 Costa et al.
6,474,090 B2 11/2002 Guerra
6,474,091 B2 11/2002 Guerra
6,508,412 B1 1/2003 Pergay et al.
6,511,000 B2 1/2003 Fujiwara
6,543,699 B1 * 4/2003 Dupre ..... 239/14.2
6,547,157 B2 4/2003 Jervas
6,554,200 B1 4/2003 Satonaka
6,575,381 B1 6/2003 Fujiwara
6,691,926 B1 * 2/2004 Moen ..... 239/2.2
6,719,209 B1 * 4/2004 Pergay et al. ..... 239/14.2
6,793,148 B2 9/2004 Ratnik
6,797,191 B2 9/2004 Philips et al.

FOREIGN PATENT DOCUMENTS

GB 1175696 12/1966
WO WO97/16686 5/1997

* cited by examiner

METHOD AND APPARATUS FOR MAKING SNOW

This is a United States regular utility patent application filed pursuant to 35 U.S.C. § 111(a) and claiming the benefit under 35 U.S.C. § 119(e)(1) of the priority U.S. provisional application Ser. No. 60/529,935 filed Dec. 16, 2003.

TECHNICAL FIELD

The present invention relates generally to the art of snow making and an improved method and apparatus for making large volumes of high quality artificial snow suitable for skiing, and more particularly to universally adjustable tower-type snowmakers for ski slopes.

BACKGROUND OF THE INVENTION

Numerous water spray systems have been developed for producing snow wherein water and air under pressure are in some manner mixed and commingled. The principle involved is to reduce the size of water particles to the smallest size possible, typically by high pressure discharge of water through an atomizing nozzle orifice to form a spray, and augmented by injection of compressed air directly or indirectly with the water spray or mixing with air within a mixing chamber, to thereby form seed crystals.

Spray-made snow is formed from seed crystals. Preferably, these seed crystals are formed from the expansion of compressed air expelled into the atmosphere within and around which minute water particles freeze and form spray-made snow. The compressed air is at a higher temperature than normal ambient winter air conditions and when expelled to ambient will expand to atmospheric pressure while simultaneously dropping greatly in temperature. Because of the refrigerating effect of such pressure reduction, if there is a high quantitative level of moisture vapor present in the compressed air, such moisture vapor upon expansion will condense and freeze, immediately forming seed crystals necessary for seeding atomized water spray particles for snow making. Of course, impingement of the expanding compressed air stream upon associated atomizing-spray-generated water particles also forms such seed crystals. These seed crystals are immediately formed because of the extremely low temperature condition obtained through the expansion of the air together with the freezing effect of atmospheric conditions of winter, that is, wet bulb temperatures below 32° F. The seed crystals thus formed can be combined with the remaining water particles of the atomized water spray in a manner to form more spray-made snow.

In connection with the atomizing of water for snow making it has long been known that the water particle size should be as small as possible, in many cases as small as 200 microns or less, because if such particles are too large, depending on ambient weather conditions and the ratio of water to air mixture, they will produce ice or sleet particles which are unsatisfactory for desirable skiing conditions. Also, the greater the water pressure at the discharge nozzle, the smaller the water particles or moisture droplets upon nozzle discharge. However, the water particles should not be so small that they drift away, evaporate and/or sublimate.

Further, information and history of various methods and apparatus for spray-making snow are set forth in columns 1 through 8 of the Kircher et al. U.S. Pat. No. 6,161,769, and in the references cited therein, all of which are incorporated herein by reference for brevity.

More recent examples of United States patents directed to spray snow making pipe towers are as follows (also all incorporated "herein" by reference for brevity): McKinney U.S. Pat. No. 5,810,251; Dupre U.S. Pat. No. 5,908,156; McKinney U.S. Pat. No. 5,979,785; Pergay et al. U.S. Pat. No. 6,508,412; Dupre U.S. Pat. No. 6,543,699 and Jervas U.S. Pat. No. 6,547,157.

OBJECTS OF THE INVENTION

Among one or more of the objects of the invention is to provide an improved snow making tower wherein (1) primary water is fed in a novel manner into a water feed block and up into the tower pipe sleeve and then to feed spray head, and cooperative improved secondary and tertiary water supply valves that ensure that turbulent water continuously flows in such a manner that heaters are not needed and yet such valves do not freeze up;

(2) an improved hydraulic jack and safety latch system to provide a compact hoisting apparatus with much mechanical advantage, and enabling the boom to be easily and safely positioned at any angular position in its range of pivotal travel established by jack operation, and yet ensures that the entire boom may safely retropivot back downwardly a very short distance established by a latch system that can be quickly converted over to a nonlatching mode to allow the boom to be dropped as rapidly as desired under the operator control of the hydraulic release valve on the ram;

(3) a modular design spray head enabling manufacturing economies to be achieved and facilitating cleaning, repair and replacement in the field;

(4) internal nucleation system providing efficient mixture of compressed air and seed spray in an internal chamber and expansion of this mixture through a spray nozzle to thereby provide copious quantities of seed crystals for seeding water spray from a spray head assembly, and wherein the filter screens of internal spray nozzles are accessible for removal and cleaning or replacement by simply removing access plugs with an Allen wrench;

(5) a tower pipe boom assembly and method that enables the air and water chambers of the tower to be isolated and economically leak tested sequentially during assembly to ensure reliable leakproof operation of the final assembly;

(6) a welded-on pipe cap installed at the upper end of tower support pole to provide a rugged hemispherical bearing surface for the pipe cap of a support pipe on the pole to thereby substantially lower the torque or effort required to turn the tower boom assembly, and also provides a substantially fail-safe, heavy-duty and long lasting bearing arrangement for this purpose;

(7) improved tower support service locks that greatly enhance the safety anti-rotation lockup of the tower boom assembly to thereby prevent the tower boom assembly from turning even under high wind loads and/or water pressure loads;

(8) an extruded pipe tower that provides substantial reinforcement against gravity-induced bending loads exerted on the boom assembly while also protecting secondary and tertiary water feed hoses, and adds manufacturing flexibility in the event that different models are to be offered that in some instance do not use tertiary water; and in other instances do not use secondary and/or tertiary water, and (9) safely enabling use of waterfeed hoses instead of internal extruded water conduits in the pipe tower boom facilitate cleaning these conduit passages and to ensure that the secondary and tertiary water feed is not in heat transfer relationship with primary water nor with the compressed air being fed, thereby enabling lower temperature water to be fed to secondary and tertiary spray nozzles in those installations where tower spray water is drawn from surface ponds at a temperature close to freezing and delivered to the snow making tower at such lower temperatures, which in turn further increases snow making efficiencies.

The foregoing as well as additional objects, features and advantages of the present invention will become apparent from the following detailed description of the best mode, presently known to the inventor named herein, and from the accompanying drawings wherein:

DETAILED DESCRIPTION OF THE PREFERRED EMBODIMENTS OF THE INVENTION

Figure 1:
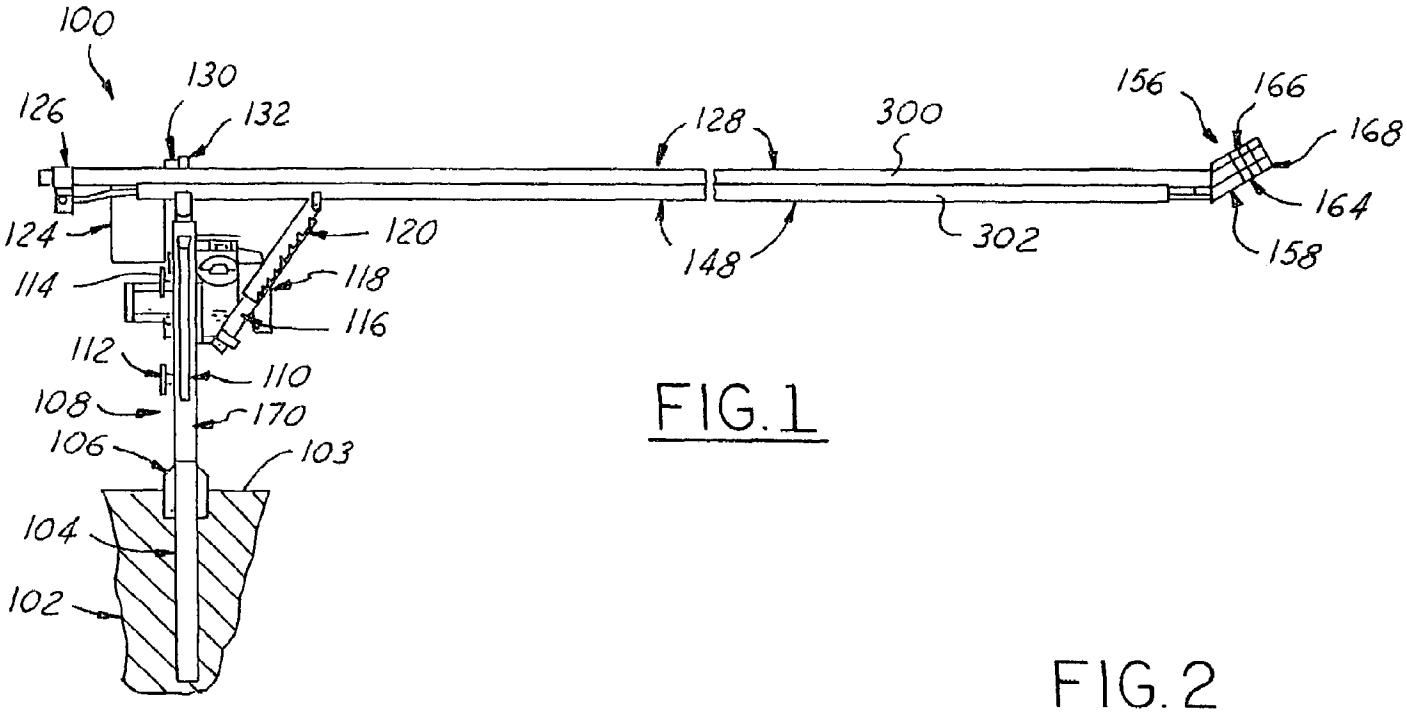
FIG. 1 is a side-elevational view, partially fragmentary, of an adjustable snow making tower construction in accordance with the present invention shown in the lowermost one of its universally adjustable positions, i.e., a horizontal position during shutdown for maintenance.

Referring in more detail to the accompanying drawings, FIG. 1 illustrates in a somewhat simplified format the overall construction and assembly of an exemplary but presently preferred first embodiment of an adjustable snow making tower 100 of the present invention. Referring to FIG. 1, as well as to FIGS. 2-8, the principal components of tower 100 are identified by reference numerals as follows:

100—overall adjustable snow making tower
102—support pole foundation
103—surface of foundation material (e.g., concrete, rock or earthen-material)
104—support pole
106—support pole anti-rotation and stiffening fins
108—tower pipe assembly
110—tower turning handle
112—lower service lock
114—upper service lock
116—hydraulic jack
118—on-board electric motor—air compressor assembly
120—hydraulic jack safety latch
122—hydraulic jack stop assembly
124—electrical control panel
126—compressed air feed hose
126—water feed block assembly
128—boom assembly
130—electrical panel support bracket
132—tower compressor support bracket
134—water feed block
136—pipe sleeve
138—air feed coupling
140—secondary water valve assembly
142—tertiary water valve assembly
144—secondary water supply hose
146—tertiary water supply hose
148—extrusion forming primary water conduit and housing for secondary and tertiary water hoses
150—rotation stop block
152—boom pivot bracket
154—boom jack bracket
156—spray head assembly
158—spray head manifold base
160—secondary water transition block

162—tertiary water transition block
164—spray head intermediate manifold
166—spray head nucleator manifold
168—spray head manifold cap Additional reference numerals, identifying further structural elements and detailed components of the foregoing primary components identified above with reference numerals 100-168 and associated part names, also will be utilized hereinafter in the following detailed description.

Tower Ground Support Structure

Tower 100 is comprised of a ground support structure which, in this exemplary but preferred embodiment, includes a substantially vertical tubular support pole 104 (FIGS. 1 and 3) which may be a conventional cylindrical steel pipe of, for example, four to six inches in outer diameter and some six to ten feet in overall length. The lower half of pole 104 is embedded in the base table foundation 102 so that approximately four to five feet of pole 104 protrude above the ground or foundation surface 103. Foundation 102 typically is a poured concrete foundation cast into a suitable earth excavation. Support pole 104 must be securely anchored to the ground because tower 100 must support a good deal of structural weight (boom assembly 128 weighing approximately 150 to 200 pounds) and additional water-fill weight. In addition, during operation water is being ejected in spray form from the snow making tower nozzles supported at the upper end of the structure in spray head 156 at very high pressures (for example, 100-500 psi), and at angles relative to the vertical extent of the tower, thereby creating varying backward thrusts at high elevations on the tower.

Figure 3:
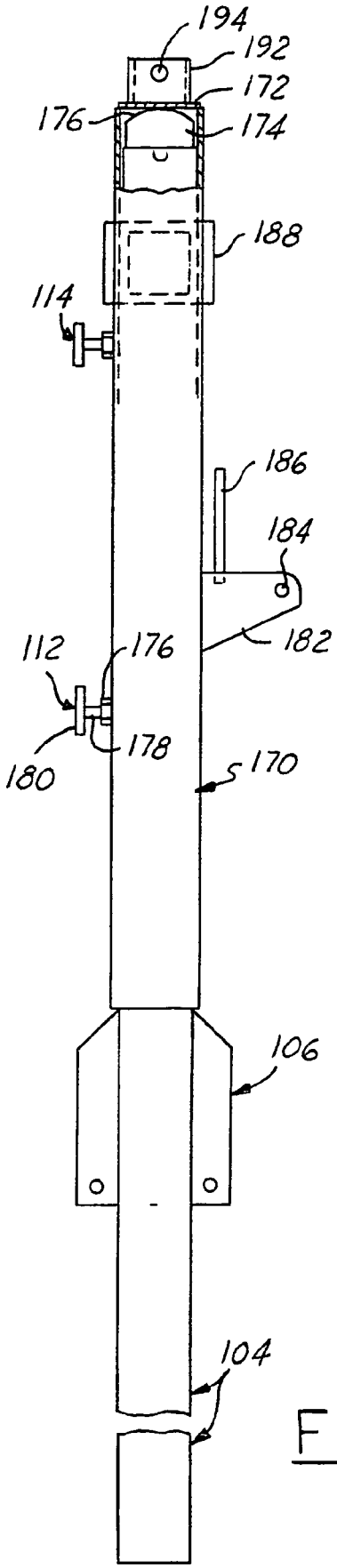
FIG. 3 is a fragmentary side-elevational view illustrating the ground support pole and associated support pipe telescopically mounted thereon.

Tower pipe assembly 108 also includes a support pipe 170, open at its lower end and closed at its upper end by a flat cap plate 172 (FIG. 3). Pipe 170 is coaxially telescopically received downwardly over support pole 104 for support and free rotation thereon about the vertical pole axis through a full 360°.

In accordance with one feature of the present invention, the upper end of support pole 104 has installed therein a cap 174 which has a cylindrical sidewall and a hemispherical-shaped upper crown 176 to thereby provide a convex bearing surface on which the flat cap plate 172 loosely rests. Thus, cap 174 and plate 172 provide a very simple and strong rotational bearing structure for the aforementioned 360° range of tower rotation about the pole axis. The fins 106 of pole 104, being at least partially embedded in the concrete foundation 102, reinforce pole 104 against rotation and operational forces generated by and in tower 100 when pipe 170 is being supported and rotated on pole 104.

Additional structure on support pipe 170 includes the lower and upper service locks 112 and 114 each of which includes a hex nut 176 welded to the outer surface of the pipe 170 and registering with a hole through the pipe wall. A locking handle comprising of a threaded shaft 178, with a T-handle 180 affixed to its outer end, is threaded into nut 176 and when tightened bears at its inner end against the surface of pole 104 to lock pipe 170 against rotation relative to pole 104. The upper service lock 114 is identical in construction to service lock 112. Providing two of such service locks at spaced vertical elevations enhances the lock up safety of tower 100 to better resist the loosening effect of operating vibrational and wind forces that may be exerted on tower 100 under varying operational conditions.

Support pipe 170 also has a hydraulic jack bracket 182 welded to its outer surface to which the lower end of a ram of a hydraulic jack 116 is pivotally connected by a pin through a hole 184 in bracket 182. A jack handle holder 186 is conveniently provided by mounting a rod upright on bracket 182 adjacent the outer surface of pipe 170. A suitable bracket structure 188 (FIG. 3) is welded on the side of pole 170 near its upper end to provide a support point for the motor-compressor assembly 118 which in turn carries the control panel 124. The tower turning handle 110 (FIG. 6) is pivotally connected to pole 170 at its upper end by a channel bracket 190 welded to the outer surface of pipe 170. When not in use handle 110 rests against pipe 170 under the influence of gravitational forces. When it is desired to rotate boom assembly 128 about the vertical axis of the ground support structure, the service locks 112 and 114 are backed off to disengage from support pole 104, and then handle 110 raised to a generally horizontal operating position and torque applied to pipe 170 via manually pushing on the outer end of handle 110.

Figure 6:
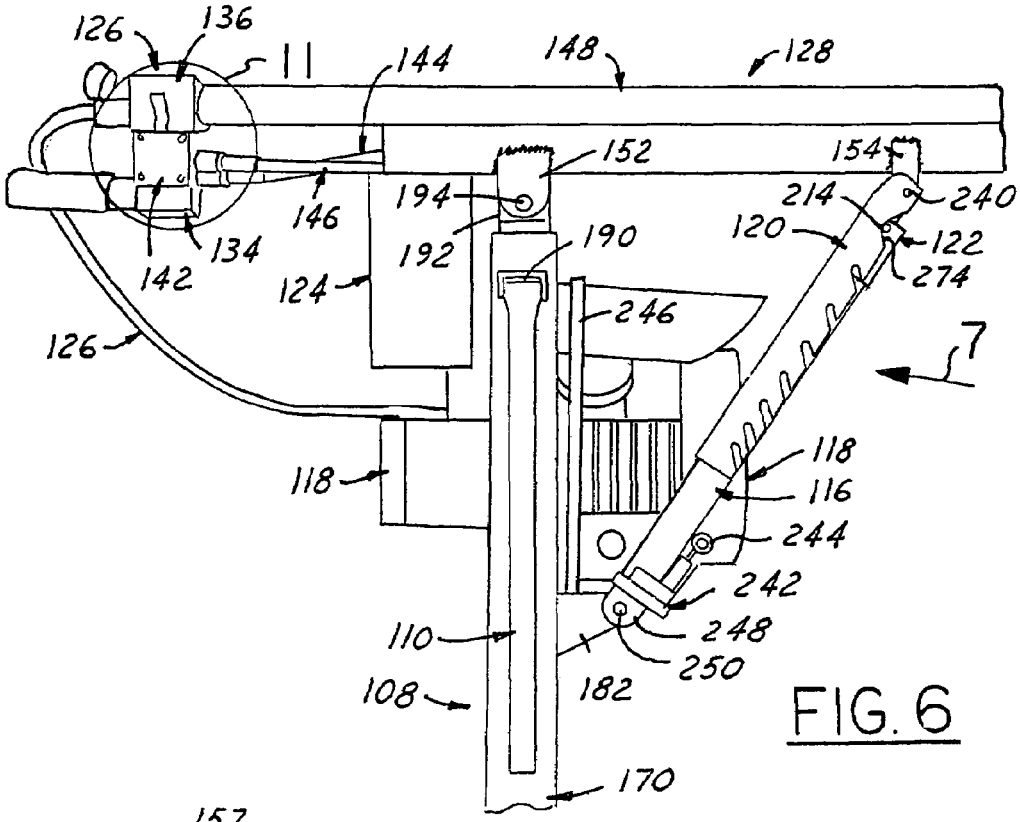
FIG. 6 is a fragmentary side-elevational view of a portion of the tower ground support structure and boom, as shown on a scale enlarged over FIG. 1 and also illustrating the optional control panel and air compressor structure.
Figure 7:
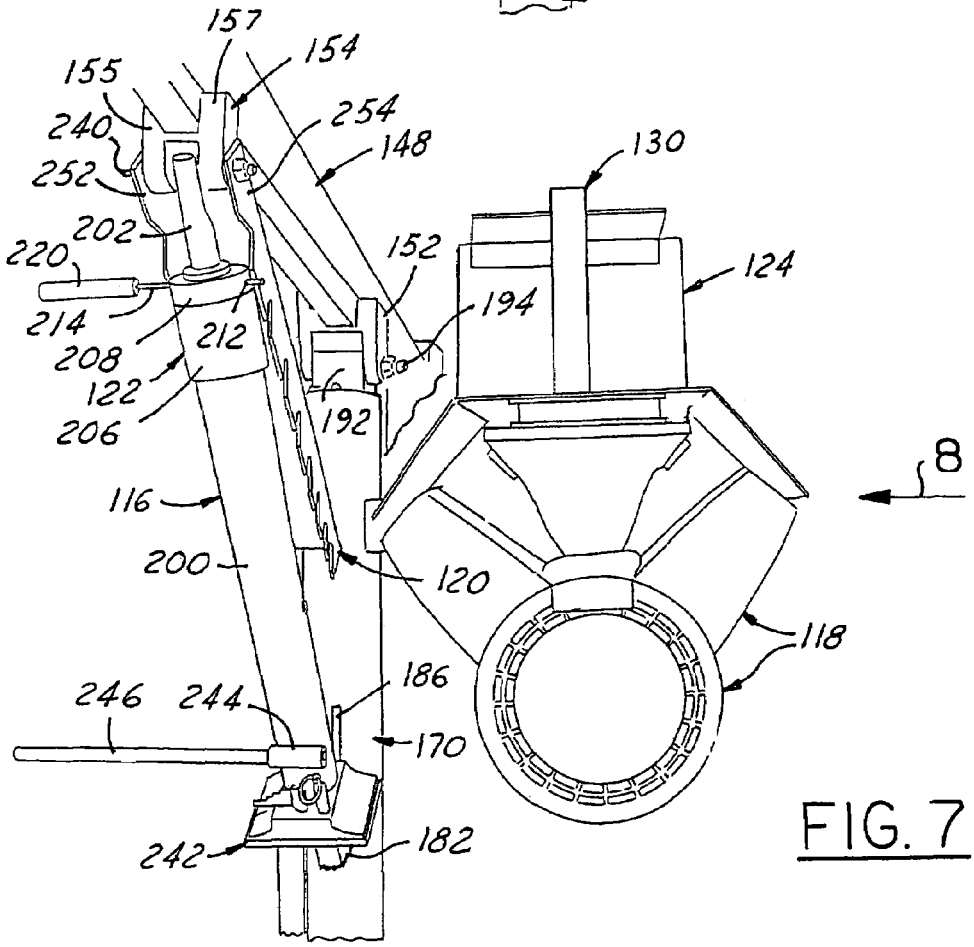
FIG. 7 is a fragmentary perspective view of the structure shown in FIG. 6 looking in the direction of the arrow 7 in FIG. 6, but with the boom assembly slightly elevated from its FIG. 6 position.

As best seen in FIGS. 3, 6 and 7, the upper end of pipe 170 also has mounted thereon a mounting bracket 192 which comprises a box-like or rectangular casing welded onto the upper surface of support pipe cap plate 172 and provided with aligned through-holes for receiving a main boom pivot pin axle bolt 194 therethrough to thereby pivotally connect boom pivot bracket 152 to the upper end of the pipe 170. Brackets 152 and 192 thus support extrusion 148 for swinging in a vertical plane about the pivot axis provided by the axle bolt 194, thereby permitting the boom to be pivoted in a vertical plane from a substantially horizontal orientation shown in FIG. 1 upwardly to an angle of about 70° from horizontal, i.e., to the maximum elevated operational position of the tower (not shown).

Tower Pivoting Mechanism

Figure 42:
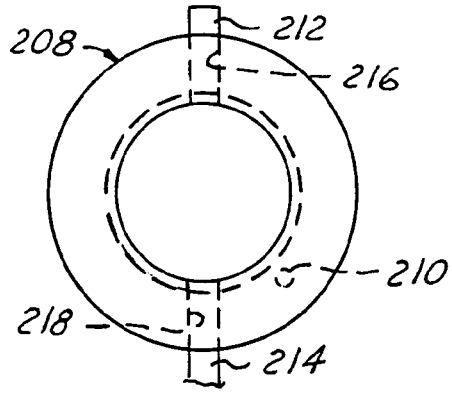
FIG. 42 is a top plan view of the jack safety stop swivel part of the subassembly seen in FIGS. 40 and 41.
Figure 43:
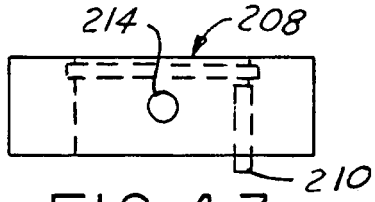
FIG. 43 is a side elevational view of the jack safety stop swivel.

Preferably the mechanism for pivoting boom 128 of tower 100 in a vertical plane through its aforementioned operating range comprises the hydraulic jack 116 best seen in FIGS. 6, 7 and 30-45. Hydraulic jack 116 comprises a conventional commercially available hydraulic ram comprising a hydraulic cylinder 200 with a piston therein (not shown) driving a piston rod 202 that protrudes from the upper end of cylinder 200. Hydraulic ram 116 is modified from conventional construction by providing, in accordance with the invention, a specially constructed jack stop assembly 122 made up of a subassembly 204 comprising a jack safety stop base 206 (shown in detail in FIGS. 41, 44 and 45), a jack safety stop pin carrier swivel 208 (shown in detail in FIGS. 40, 41, 42 and 43), a rotary travel limit stop pin 210 carried by swivel 208 (FIGS. 40 and 42) and a pair of cooperative safety stop pins 212 and 214 (FIGS. 40 and 42). Pins 212 and 214 are affixed in diametrically opposed and coaxially aligned bores 216 and 218 in swivel 208. Pin 212 is the shorter of the two pins and protrudes only a short distance therefrom so as to be nestable in an associated interior corner of the jack latch channel 120 (FIG. 39), whereas pin 214 protrudes from swivel 208 approximately three inches and receives thereon a hand grip knob 220 that in turn is about four inches in length.

Figure 41:
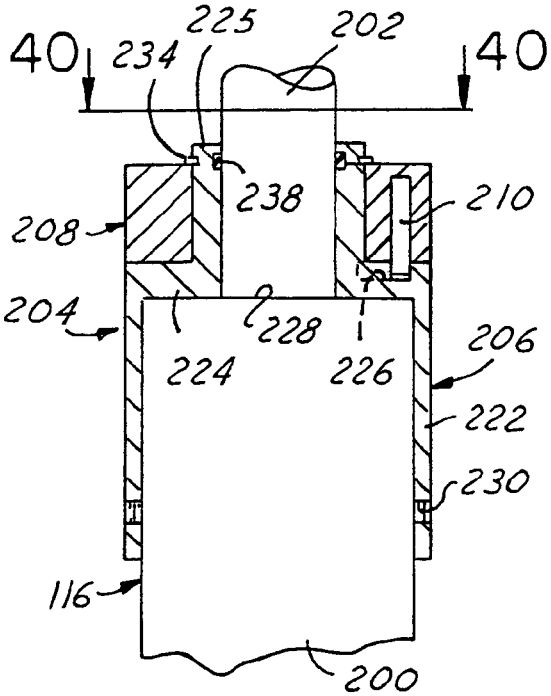
FIG. 41 is a fragmentary cross-sectional view taken on the line 41-41 of FIG. 40.
Figure 44:
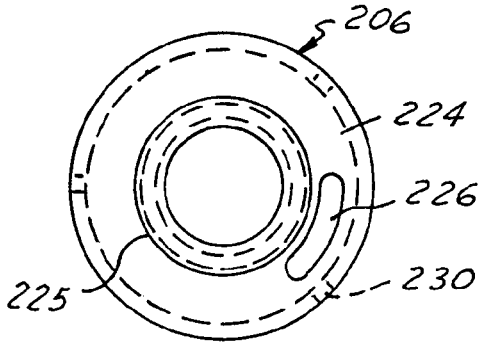
FIG. 44 is a top plan view of the jack safety stop base of the subassembly of FIGS. 40 and 41.
Figure 45:
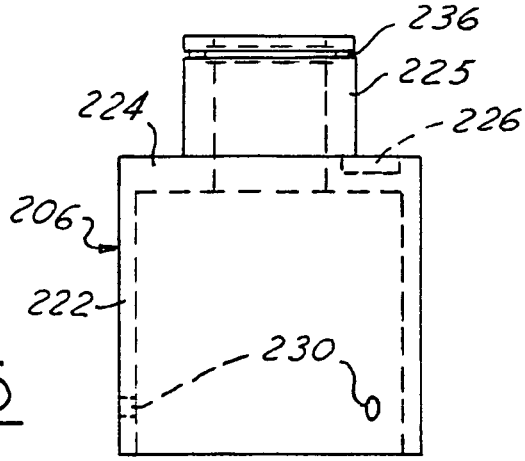
FIG. 45 is a side elevational view of the jack safety stop base.

As best seen in FIGS. 41, 44 and 45, stop base 206 comprises a cylindrical skirt 222 open at its lower end and terminating at its upper end in a radially extending shoulder wall 224 that extends between skirt 222 and an axially protruding collar 225. As best seen in FIG. 41, sleeve 222 fits slidably upon the upper outer end of ram cylinder 200 with shoulder wall 224 resting on the upper end surface 228 of ram cylinder 200 and with piston rod 202 protruding slidably upwardly through and out of collar 225. Stop base is held fixed on cylinder 200 by set screws 230 provided in skirt 222. The upper surface of shoulder wall 224 is provided with an upwardly opening arcuate groove 226 extending angularly approximately 45°. Stop swivel 208 is assembled on collar 225 so as to rest on shoulder wall 224 as shown in FIG. 41 with the lower end of travel limit pin 210 protruding into limit groove 226. Thus swivel 208 can rotate approximately 45° on collar 225 and relative to swivel base 206 within the limits established by pin 210 striking one or the other of the opposite ends of groove 226. Swivel 208 is held axially fixed on collar 225 by a snap ring 234 that is received in a snap ring groove 236 in collar 225 (FIG. 45). Collar 225 also carries a suitable fluid sealing packing 238 which sealingly and slidably engages piston rod 202 (FIG. 41).

The upper end of hydraulic jack 116 is pivotally coupled to boom 128, as best seen in FIG. 7, by the upper end of piston rod 202 being received within the device arms 155 and 157 of bracket 154 and being pivotally coupled thereto by a pivot bolt 240 passing through coaxially registering holes in the upper end of rod 202, arms 155 and 157 and the sides of safety latch channel 120. Bolt 240 also pivotally suspends safety latch 120 from its upper end so that it is gravitationally biased to nestably overlie ram 116, as will be explained in more detail hereinafter.

As best shown in FIGS. 6 and 7, the lower end of ram 116 is provided with the usual commercially available base plate 242 that is provided with a pump-actuating collar 244 adapted to slidably receive one end of a jack-pumping pipe handle 246 shown installed in operative pumping position in FIG. 7. When not in use, pumping handle 246 is conveniently stored on storage rod 186 so as to stand upright adjacent pipe 170 as shown in FIG. 6. Pump 116 is pivotally mounted on bracket 182 by providing a pair of spaced mounting ears 248 welded to the underside of base 242 so as to embrace the sides of bracket 182, and a pivot mounting pin 250 is inserted therethrough and through hole 184 in bracket 182 (FIGS. 3 and 6).

To raise boom 128 from the lowermost position of its operating range (FIG. 1), pump handle 246 is installed in collar 244 and swung back and forth in an arc in a plane parallel to the axis of ram 116 to thereby reciprocate a conventional pumping piston of a built-in hydraulic pump that pumps hydraulic fluid into the ram cylinder chamber below the internal piston to thereby force piston rod 202 to extend from cylinder 200, thereby pivoting boom 128 about the axis of mounting pin 194. When it is desired to lower the boom from a position raised above that shown in FIG. 1, a conventional ram fluid release valve (not shown) on base 242 is operated by a socket on the end of handle 246 to allow hydraulic fluid to bypass the internal piston as the weight of the boom drives the piston in a retractal direction within the cylinder, thereby retracting piston rod 202. Thus, it is possible to pivotally raise boom 128 to any desired angle or position by pumping jack 116, or to lower the boom by releasing hydraulic fluid internally (after rotating swivel 208 to the unlocked position shown in FIG. 39) to allow the boom to drop, the lowered stop position being selected and controlled by shutoff of the fluid release valve. Thus, within the total range of pivotal movement possible for boom 128, jack 116 enables boom positioning in infinite incremental positions, the boom being locked in any such operationally selected position (as contrasted with a preselected position in this range of vertical motion) by ceasing pumping action on handle 246, and then, if desired, "inching" the boom downwardly by briefly opening and closing the hydraulic release valve on such base 242.

Figure 38:
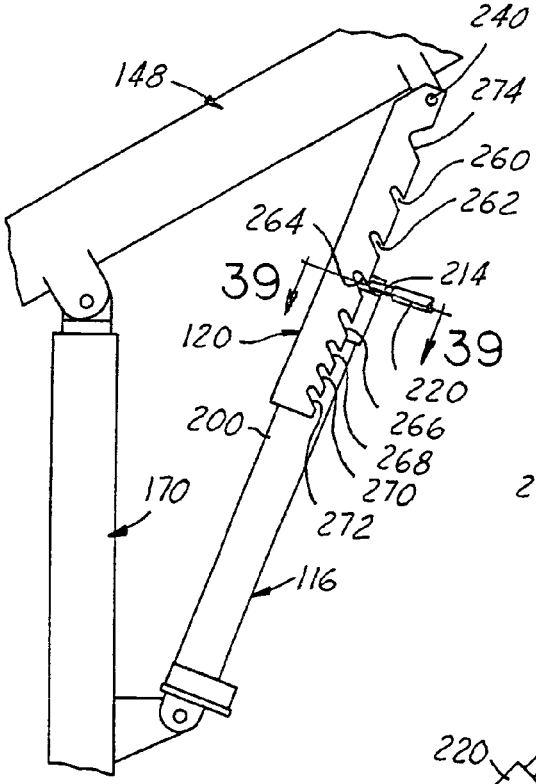
FIG. 38 shows the latch handle rotated fully to the fully unlocked position wherein the safety pin is nested in the corner of the safety latch channel and hence restrained from counter-rotation to a latching position, thereby readying the jacking latch subassembly to be retracted back to the start position illustrated in FIG. 6.
Figure 37:
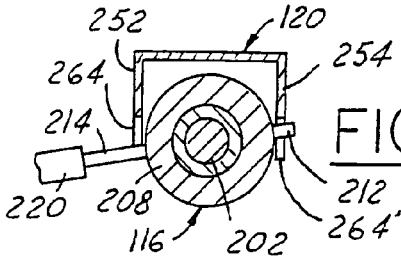
FIG. 37 is a cross-sectional view taken on the line 37-37 of FIG. 36.

As a further feature of the invention, the hydraulic jack mechanism 116 is also provided with the safety latch 120 that is operable to automatically latch/catch the boom in the event that the hydraulic jack experiences internal leakage past the piston seals that allows the piston rod 202 to be forced back into the cylinder at a very gradual rate. The construction of the safety latch 120 will be evident from FIGS. 6, 7 and 30-39. Latch 120 comprises an inverted C-channel having a planar web 250 with a pair of spaced-apart parallel side flanges 252 and 254 dependent therefrom (FIG. 31). Each of the side flanges 252 and 254 is provided with a series of spaced-apart safety latch notches 260, 262, 264, 266, 268, 270 and 272 (FIG. 38). As will be seen in the side views of FIGS. 6, 30, 32, 34, 36 and 38, the longitudinal spacing of these notches one from another becomes progressively shorter as such successive notch position approaches the lower end of latch 120. Preferably, notches 260-272 have parallel sidewalls and are oriented at an angulation of 45° to the longitudinal axis of latch channel 120 and in an upward direction. An additional V-shaped notch 274 is provided near the upper end of channel latch 120. As best seen in FIG. 7, when swivel 208 is oriented so that the axis of latching pins 212 and 214 is perpendicular to side flanges 252 and 254 of latch 120, the free edge of flange 254 rides on pin 212 and the free edge of flange 252 rides on pin 214. (See also FIGS. 31 and 33). Note that swivel 208 is rotated to orient pins 212 and 214 to straddle the channel flange edges as thus described. Gravitational forces exerted by the weight of channel latch 120, as it hangs suspended to swing freely at its lower end because pivotally hung by pin 240 only at its upper end, provides a yieldable biasing force that maintains pins 212 and 214 in the straddling position. This straddling position is herein termed the safety latching mode of orientation of latch knob 220 and pins 212 and 214.

In operation of safety latch 120, assume that the boom 128 has been lowered to its fully down position shown in FIG. 1, and latch pins 212 and 214 have been oriented by manipulating handle 220 to position them in the V-notch 274 as best seen in FIG. 6. The position of latch pins 212 and 214 in this condition corresponds to the fully retracted condition of piston rod 202 in cylinder 200 of the ram 116. With safety latch knob 220 so oriented assume that it is desired to pivot boom 128 upwardly. One end of pump handle 246 is inserted in pumping collar 244 as shown in FIG. 7 and handle 246 reciprocated to produce pumping action and thereby begin extension of piston rod 202. An initial increment of this motion as shown in FIG. 7. Note that an initial extension of piston rod 202 has carried safety latch 120 upwardly due to its attachment to the clevis of bracket 154 by pivot pin 240. However, the ram cylinder 200, including the safety stop assembly 204, does not extend axially relative to, but rather is fixed axially to, lower support pipe 170 even though it can pivot thereon from its base. Hence, the free edges of the flanges of latch 120 are dragged upwardly relative to and slidably along latch pins 212 and 214 so that the latch channel is cammed by pins 212, 214 to pivot away from ram cylinder 200 from its fully nested position in FIG. 6 to its divergent position in FIG. 7.

Figure 30:
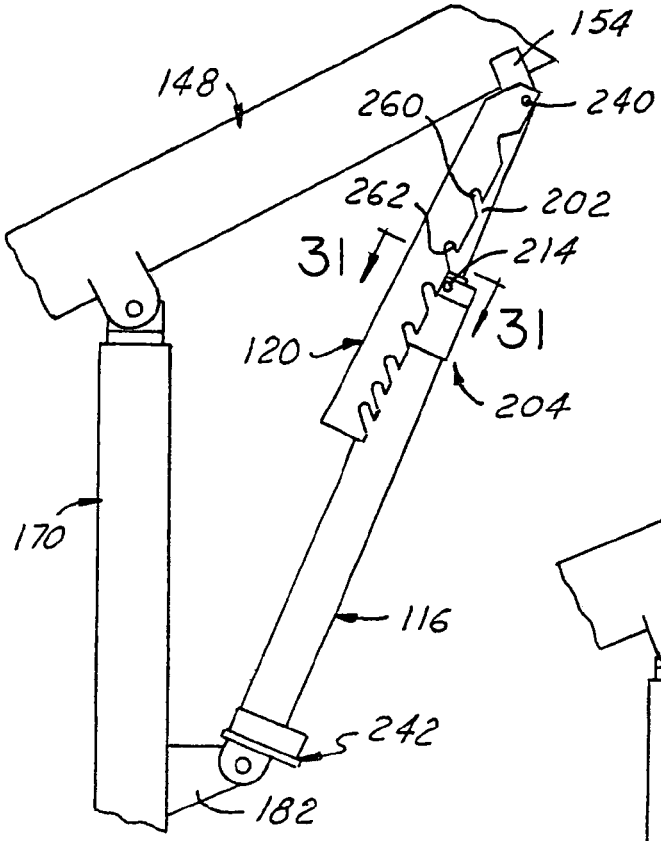
FIG. 30 is a simplified side-elevational view of the hydraulic jack and hydraulic jack latch structure, and associated boom and support pipe (shown in more detail in FIGS. 6 and 7), and illustrating the jack partially extended to pivot the boom to a desired but exemplary operating elevation with the latch handle and associated latch pin bearing against the underside edges of the latch stop flanges and thus being positioned between two adjacent safety latch notches.
Figure 31:
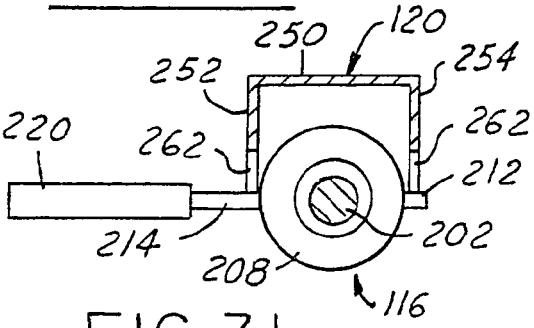
FIG. 31 is a cross-sectional view taken on the line 31-31 of FIG. 30.

Assume now that it is desired to position boom assembly 128 at the upward angle shown in FIG. 30. By further pumping up the hydraulic ram the piston rod 202 will be further extended, thereby raising the boom from the slightly elevated position of FIG. 7 to the mid-range elevated position of FIG. 30. During the motion from the pivot angle of FIG. 7 to that of FIG. 30, the latch channel will be slidably dragged further over the pins 212 and 214. As the pins register with the first notch 260 in such upward travel of latch 120, the pins will drop partially into the notch and rest on the downhill-side edge of the notch. Due to the 45° notch inclination further motion of the latch channel upwardly will cause the pins to cam the latch in a swinging motion back away from the ram as the portion of the channel edge between notches 260 and 262 now rides on the latch pins. The same action will occur when pins 212 and 214 register with the next notch 262, When the desired angle of boom inclination of FIG. 30 is reached, the operator can cease pumping the jack. Then, assuming there is no internal hydraulic leakage in the ram, boom 128 will remain at this operating inclination indefinitely until readjusted by the tower operator.

Figure 32:
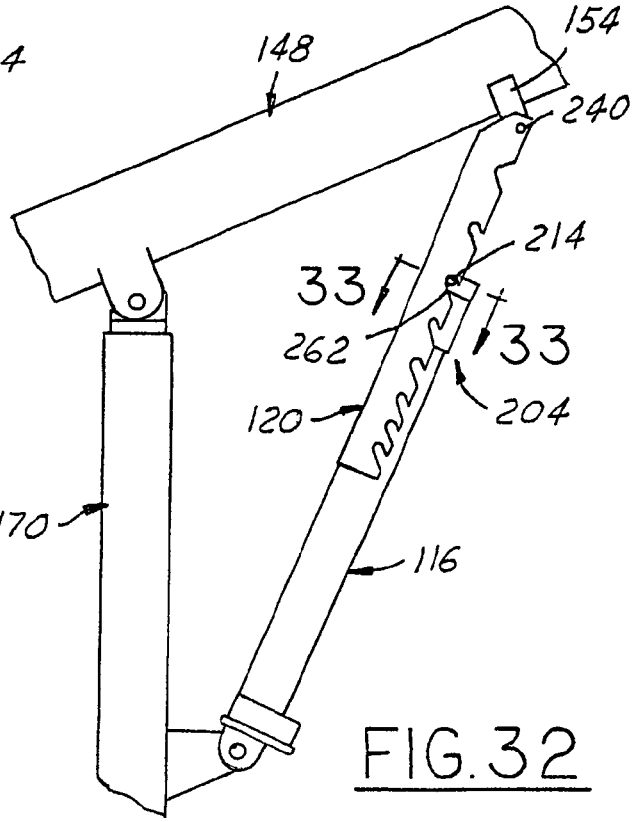
FIG. 32 illustrates the safety latch having a pair of stop notches engaging the latch handle and associated pin when the hydraulic jack has retracted slightly due, for example, to internal hydraulic fluid leakage past the jack piston packings, thereby retracting the piston rod sufficiently to cause the latch to slide down along the latch handle and associated latch pin until the latter enters the next supra-adjacent locking notch, thereby allowing the latch to pivot under gravitational bias to the fully locked position shown in FIG. 32.
Figure 33:
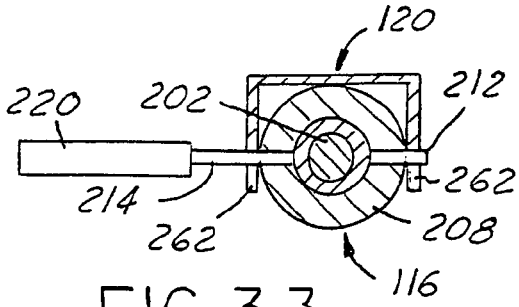
FIG. 33 is a cross-sectional view taken on the line 33-33 of FIG. 32.

However, should leakage occur after the position of FIG. 30 is reached and set, the resultant leakage-induced retraction of piston rod 202, which typically is a very gradual motion, will cause the channel latch 120 to ride downwardly relative to and slidably on latch pins 212, 214, thereby allowing these pins to ride up and into a locking condition in notch 262, as shown in the sequence of FIG. 30 to FIG. 32. This retrograde movement from the unengaged condition of FIG. 30 to the engaged, leakage-induced slightly lower position of FIG. 32 is also shown in the progression from FIG. 31 to FIG. 33. Hence, it will be seen that latch 120 does reliably provide a safety latch-up operation lattice that will catch the boom from falling any further than the corresponding distance between adjacent latch notches in latch channel 120.

If it is desired to elevate boom assembly 128 higher than the position of FIG. 30 or 32 the tower operator need only resume the upward pumping action on ram 116 thereby further extending piston rod 202 and thus dragging latch 120 over the pins again. This relative motion cause the pins 212, 214 to cam the latch pivotally away from the ram until the pins ride on the channel edge between notches. Assume that this renewed elevation action has only raised the boom one notch, i.e., from notch 262 to notch 264. This also assumes that ram leakage has caused the retrograde retraction of the piston rod to automatically bring the pins 214 and 212 into notch-locking relationship into notch 264, as shown in FIG. 34.

Of course, the operator could intentionally cause seating of pins 212, 214 in a selected notch by pumping up the ram to carry the latch channel over the pins until just below the notch, and then releasing ram fluid to allow the notch to register with the pins and causing them to seat in the notch. Normally, however, there would be no need to so manipulate the jack in the boom raising and safety latch operation.

It will also be seen from the foregoing that the foreshortening of the incremental spacing between the notches as they progress downwardly from notch 260 down to notch 272 (FIG. 38) is trigonometrically designed so that as the pins are locked up in each successive notch they will position the boom successively at equal angular increments in its pivotal range of travel, for example, at 100 increments.

Figure 34:
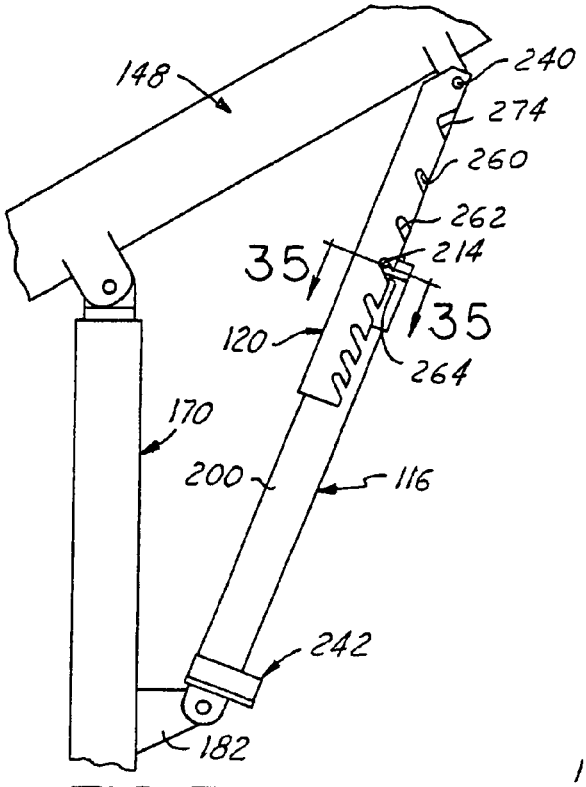
FIG. 34 is a view similar to FIGS. 30 and 32 but showing the hydraulic jack piston further extended to further raise the boom, and with the latch handle and associated safety pin latch locked.
Figure 35:
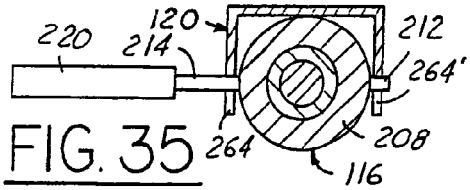
FIG. 35 is a cross-sectional view taken on the line 35-35 of FIG. 34.
Figure 36:
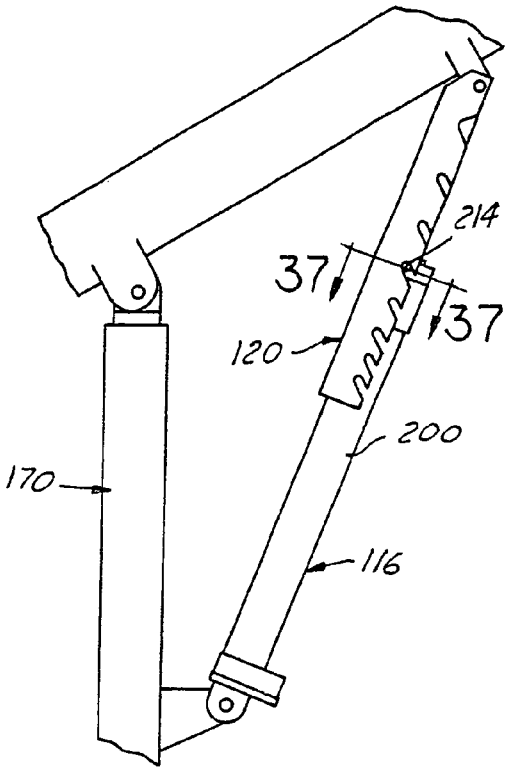
FIG. 36 is a view similar to FIG. 34, but showing the beginning of the unlatching procedure wherein the latch handle has been rotated slightly counter- clockwise as seen in FIG. 37 to manually cam the latch upwardly along with the associated piston rod, likewise pivoting the boom slightly upwardly, as assisted if necessary by pumping the hydraulic jack pump handle to assist in raising the boom during this procedure.
Figure 39:
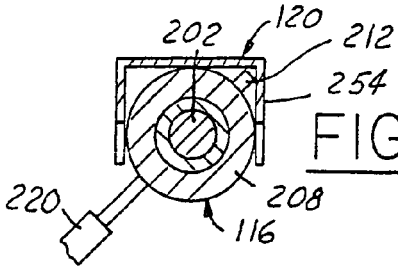
FIG. 39 is a cross-sectional view taken an the line 39-39 of FIG. 38.
Figure 40:
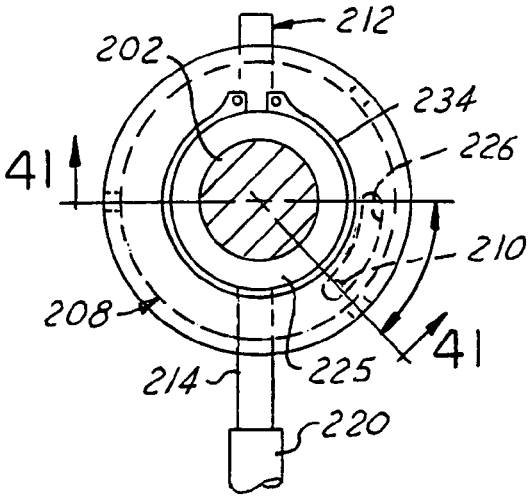
FIG. 40 is a cross-sectional view taken on the line 40-40 of FIG. 41 and showing the upper end of the ram cylinder with the jack safety stop base and stop swivel assembled thereon.

In order to render the safety latch channel inoperable to lock up with the latch pins, either in a raising or a lowering mode, the unlatching sequence shown in FIGS. 34-39 is performed. Assume that the safety latch 120 is locked up with pins 212 and 214 positioned as shown in FIGS. 34 and 35. Then, in order to render the safety latch inoperable for latch locking, the piston rod 202 must be extended by pumping the ram to move the position of pins 212 and 214 so that they are near the associated notch bottom edge adjacent the open end of this notch. Then handle 220 is rotated to pivot the swivel collar 208 in a counterclockwise direction as viewed in the sequence of FIGS. 35, 36, 37 and 39. Enough torque is applied to latch pins 212 and 214 by this manual manipulation to cause latch pin 214 to bear upwardly on the upper edge of its notch 264 and thereby cam latch channel 120 upwardly relative to ram cylinder 200, as this counter-clockwise rotation of stop swivel 208 proceeds. Note that limit pin 210 correspondingly travels through the arcuate range of the stop notch 226 during this motion. On the other side of the channel latch 120, latch pin 212 is also forcing channel flange 254 upwardly as viewed in FIG. 37, and also tending to cause the outer end of latch pin 212 to retract from its notch 264'. When the counter-clockwise rotation has proceeded to the point where latch pin 214 is clear of its notch, the outer edge of latch pin 212 will have traveled through and against the back edge of notch 264' and then, once clear of the same, will enter the corner of the channel as shown in FIG. 39. This enables channel latch 120 to be gravitationally biased back into fully nested relationship against the side of ram cylinder 200 as shown in FIG. 38.

With the safety latch pin 212 so captured in the corner of channel 120 (FIG. 39) the operator can release his grip on handle rod 220, and it will stay in the relative orientation of FIG. 39 (FIG. 38 also). In this condition, neither latch pin 212 nor 214 can engage any of the locking notches 260 through 272. Hence, if the operator desires to lower the boom after so disabling the safety lock up mechanism, the operator need only operate the fluid release valve at the base of the ram and to control the release of fluid to lower the boom under the influence of gravity at a speed controlled by the degree of opening of the release valve. Typically, when the boom is fully lowered to the position of FIG. 6, the operator will reposition the latch pins 212 and 214 in a straddling safety lock up mode in notch 274. In order to do this, the operator manually raises latch channel 120 to pivot it upwardly about the axis of pin 240 until the channel flange is clear of pin 212 so that the stop swivel 208 can be rotated back to the lock-up position of FIG. 6.

It will thus be seen that a safety latch system of the invention is very versatile, reliable, rugged, economical and easily operated, and renders the boom elevation procedure and operation secure and safe even in the event of internal fluid leakage in the hydraulic ram.

Primary, Secondary and Tertiary Waterfeed Conduit Structure and Compressedair Feed Conduit Structure of Tower 100

Figure 4:
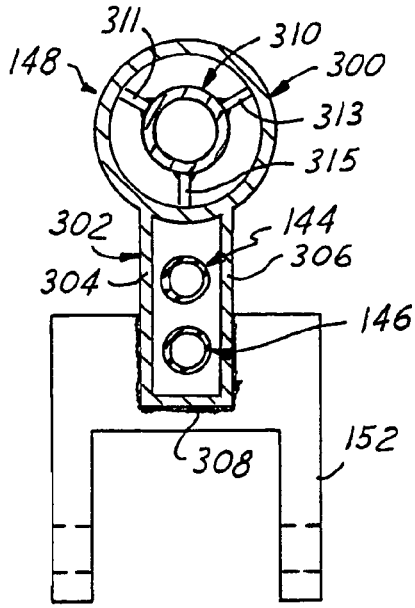
FIG. 4 is a cross-sectional view taken on the line of 4-4 of FIG. 2.
Figure 5:
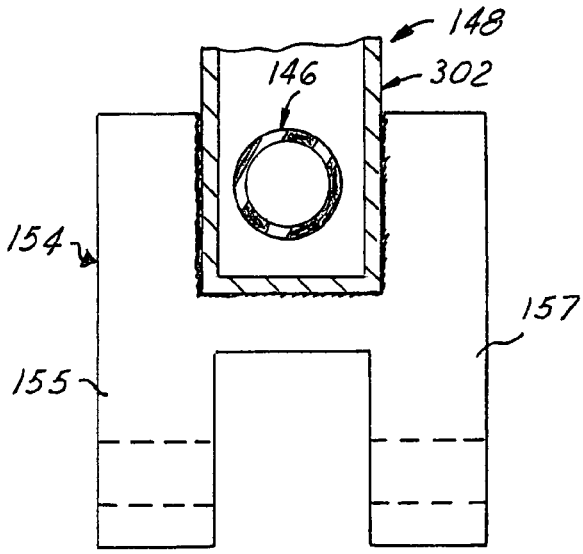
FIG. 5 is a cross-sectional view taken on the line of 5-5 of FIG. 2.
Figure 66:
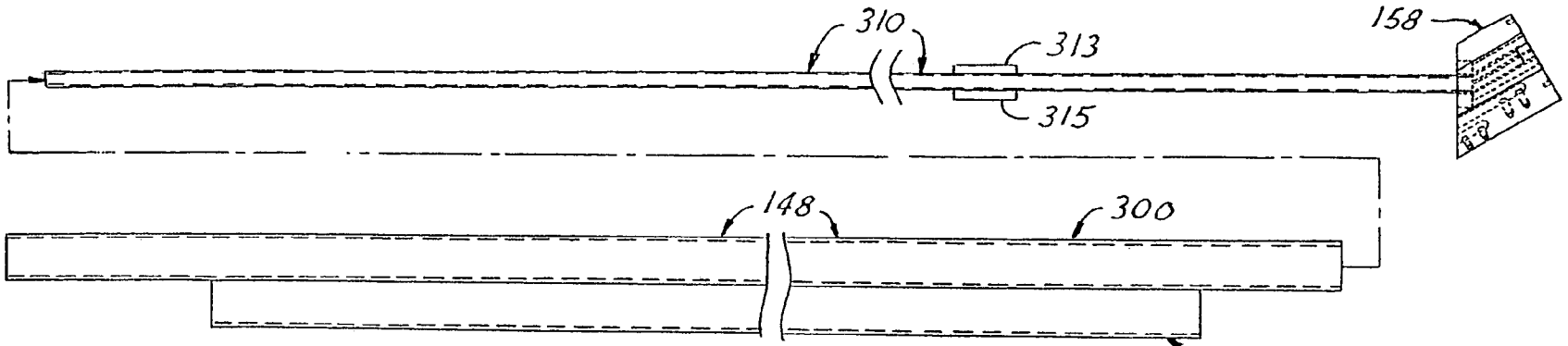
FIGS. 66, 67, 68, 69 and 70 are fragmentary side-elevational views illustrating in sequence the fabrication steps performed in assembling the snow making tower boom and associated water feed-lock assembly at its lower end and manifold base component at its upper end in accordance with the preferred method of fabrication of the present invention.
Figure 67:
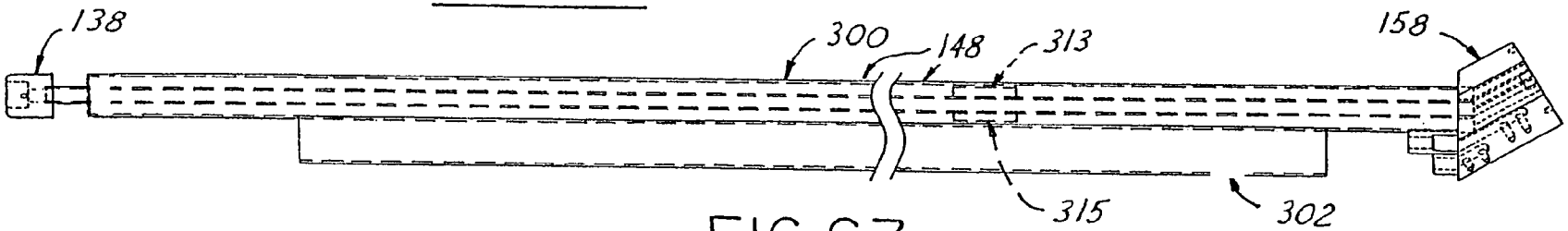
Figure 68:
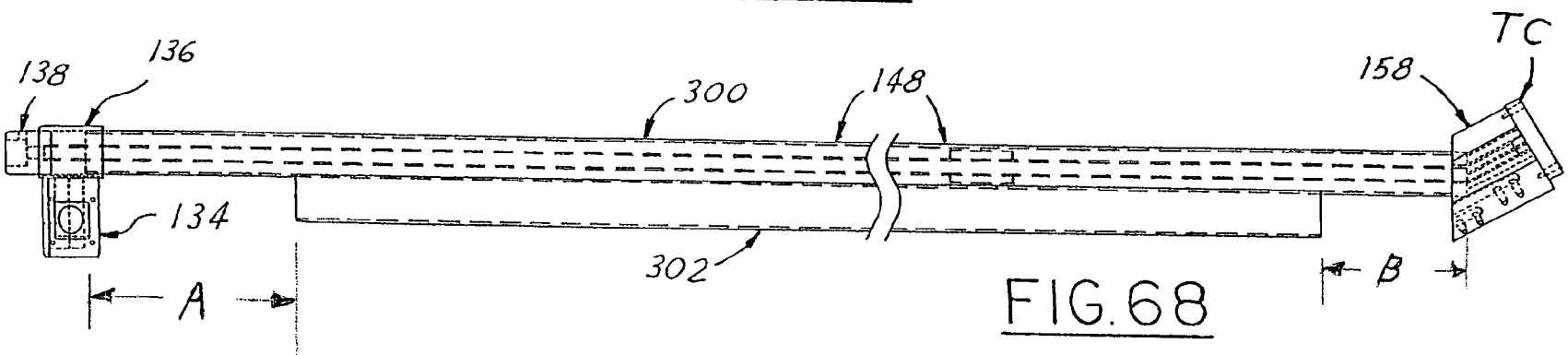

Referring again to FIGS. 1, 2 as well as FIG. 66, the principal component of tower boom assembly 128 is the extrusion 148 that forms the conduit for the primary (i.e., "always on") water feed to spray head 156, as well as the housing for receiving the secondary and tertiary water supply hoses 144 and 146. Referring to FIG. 4, extrusion 148 comprises a hollow cylindrical portion 300 of constant diameter throughout its length and the hollow rectangular hose housing channel 302 that is extruded integrally with cylinder 300. Housing 302 is made up of two spaced parallel sidewalls 304 and 306 integrally joined along their upper edges to the underside of cylindrical portion 300 and dependent therefrom, and a web wall 308 joined to the lower edges of, and extending perpendicularly to, the sidewalls 304 and 306 and running lengthwise parallel to the axis of extrusion 148. Although hose housing 302 as initially extruded is of the same length as cylindrical water conduit portion 300, as shown in FIG. 67, it is subsequently cut back a distance "A" at the input end of extrusion 148, for example, 13 inches, as shown in FIG. 68. Housing extrusion 302 and is also cut back a distance "B" at the output end of extrusion 148, for example, 9 inches. It will be seen in FIG. 4 that the depth of housing 302, i.e., the dimension from wall 308 to pipe 300 measured perpendicularly to the axis of the pipe, is approximately equal to the diameter of pipe 300. Hence, housing 302 functions as a very strong stiffening member for pipe 300 as well as providing ample room for entraining the secondary and tertiary water feed hoses 144 and 146 therethrough. Housing 302 also provides a strong supporting beam for welded attachment to the boom pivot bracket 152 that carries most of the weight of the boom, particularly when the same is fully elevated in operation. Likewise, channel housing 302 provides a strong beam for welded attachment to the boom jack 154 bracket (FIG. 5 and FIGS. 6 and 7).

Figure 2:
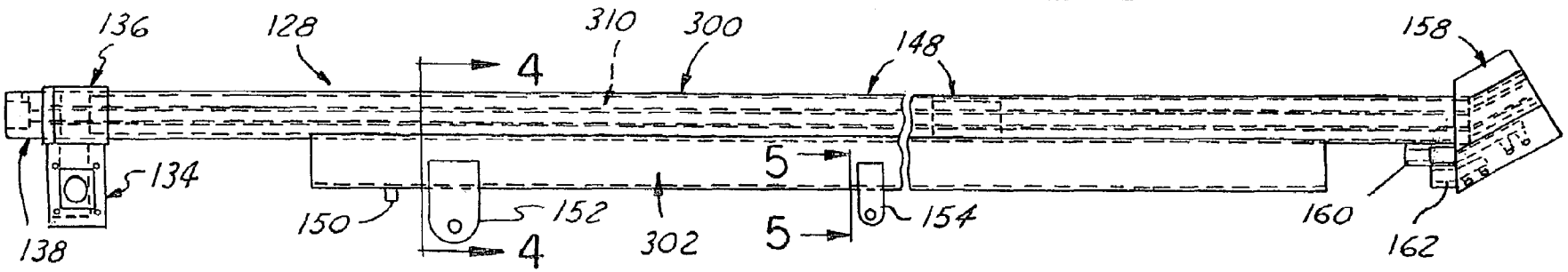
FIG. 2 is a fragmentary side-elevational view of the boom assembly of the snow making tower of FIG. 1 shown by itself separate from the supporting and elevating structure of the tower.
Figure 21:
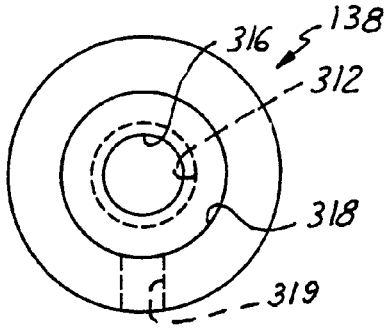
FIGS. 21 and 22 are respectively end and top plan views of the air feed coupling block that is installed in the pipe sleeve of the water feed block sub-assembly as shown in FIGS. 2, 8, 9, 10 and 12.
Figure 22:
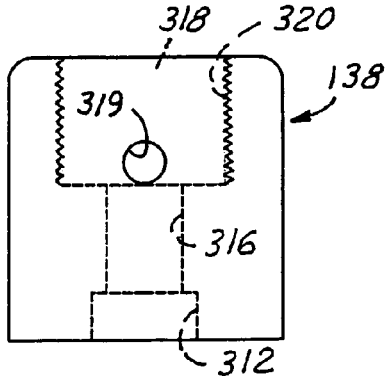
Figure 23:
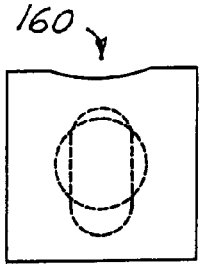
FIGS. 23, 24 and 25 are respectively an end view of the input end of the long water transition block, a side elevational view of this block and an end elevational view of the output end of this block, and shown separately prior to final assembly with boom assembly 128 in FIG. 2.
Figure 24:
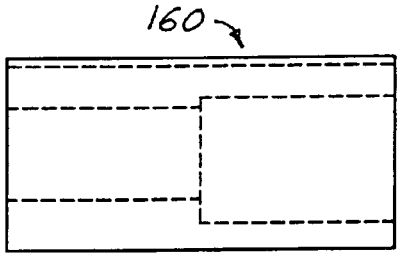
Figure 25:
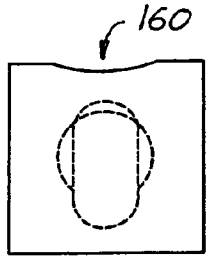
Figure 26:
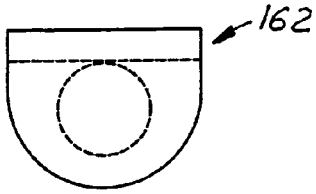
FIGS. 26 and 27 are respectively an end elevation of the input end of the short water transition block, and a side-elevational view of the same, shown separately and prior to installation in final assembly as shown in FIG. 2.
Figure 27:
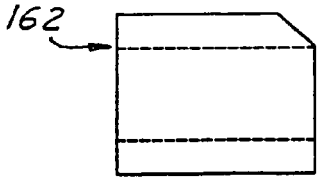

The compressed air feed conduit 310 of boom assembly 128 is best seen in FIGS. 2, 4 and 66. Preferably conduit 310 comprises a three-quarter inch Schedule 40 aluminum pipe extending substantially the full length of boom 128. The input end of air pipe 310 is inserted into the outlet socket 312 of air feed coupling 138 as shown in FIG. 67, coupling 138 being shown by itself in FIGS. 21 and 22. Counterbore socket 312 communicates with a central throughbore 316 of coupling 138 that in turn communicates with an internally threaded entrance bore 318 provided with one and one-half inch standard national pipe thread internal threads 320.

Figure 8:
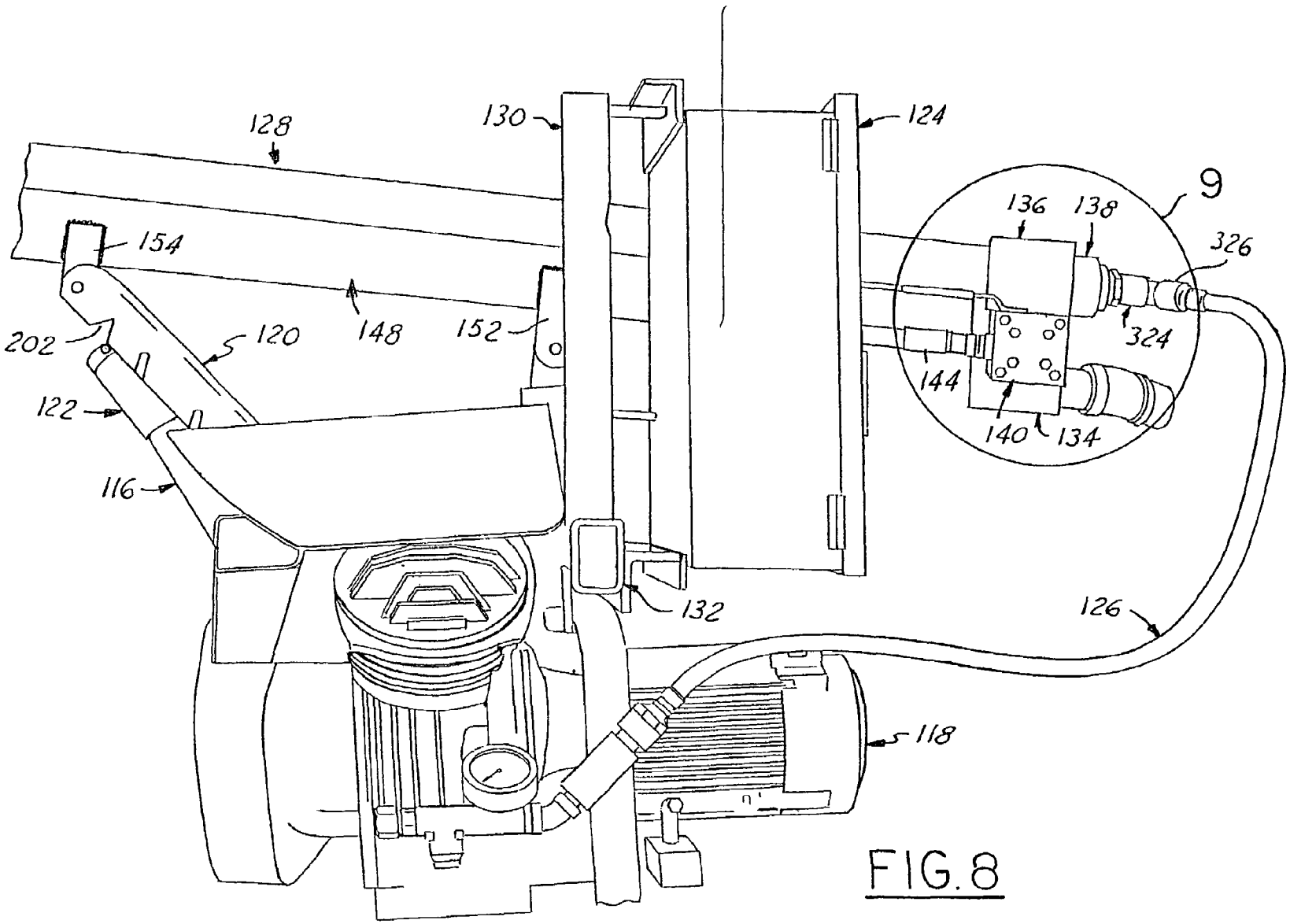
FIG. 8 is a fragmentary side-elevational view of the structure shown in FIGS. 6 and 7 looking in the direction of the arrow 8 in FIG. 7.
Figure 9:
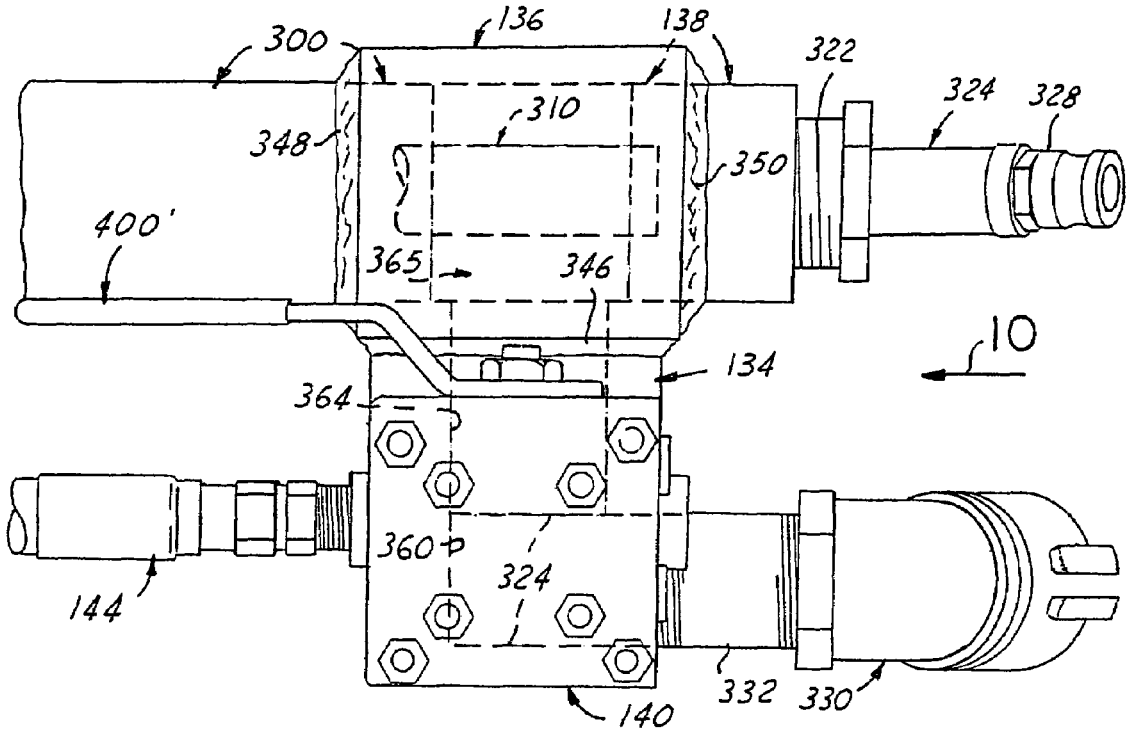
FIG. 9 is a fragmentary side-elevational view of the primary and secondary water inlet and distribution system and associated compressed air inlet coupling structure, and comprising the portion of the structure in FIG. 8 encompassed by the circle 9 therein and enlarged thereover.
Figure 10:
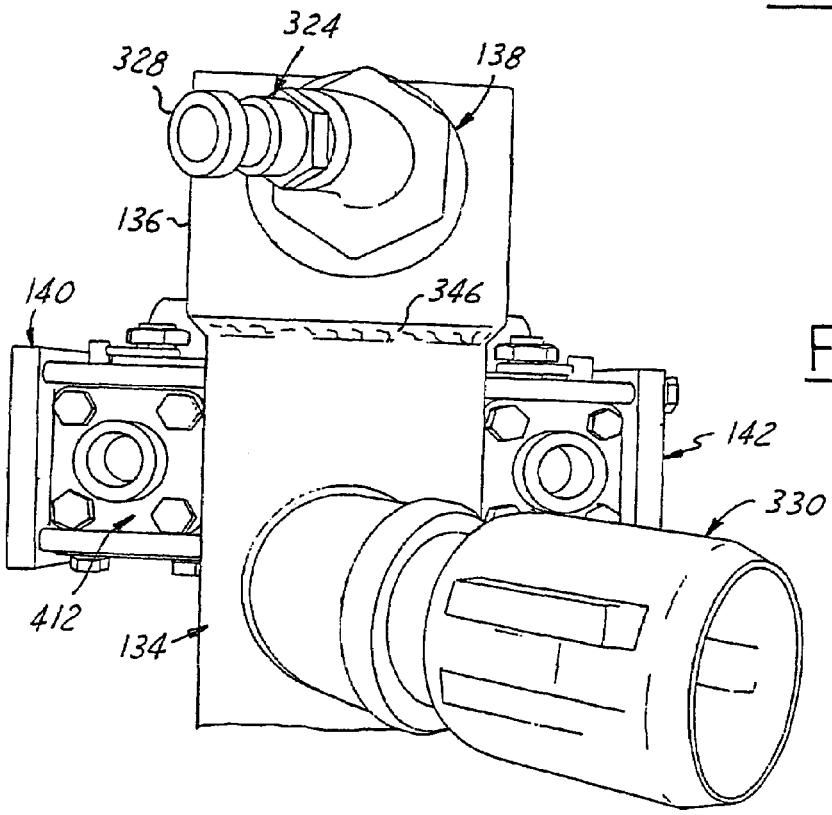
FIG. 10 is a fragmentary end elevational view of the structure shown in FIG. 9 as viewed in the direction of the arrow 10 in FIG. 9, and with the tertiary water valve assembly 142 also attached.

As shown in FIGS. 9 and 10, the subassembly of a threaded output bushing 322, a threaded fitting 324 and an air hose coupling 328 is threadably received in the large input counterbore 318 of coupling 138. As shown in FIG. 8, compressed air line 126 has an output coupling 326 that is detachably sealably coupled to the input coupling 328 to thereby feed compressed air into conduit pipe 310 via air feed coupling 138 as supplied by operation of the motor-compressor unit 118. Of course, when compressed supply lines are available on a ski slope, and tower 100 need not be equipped with motor-compressor unit 118, the compressed air coupling line from the compressed air main line being connected by an air hose to coupling 324.

Figure 11:
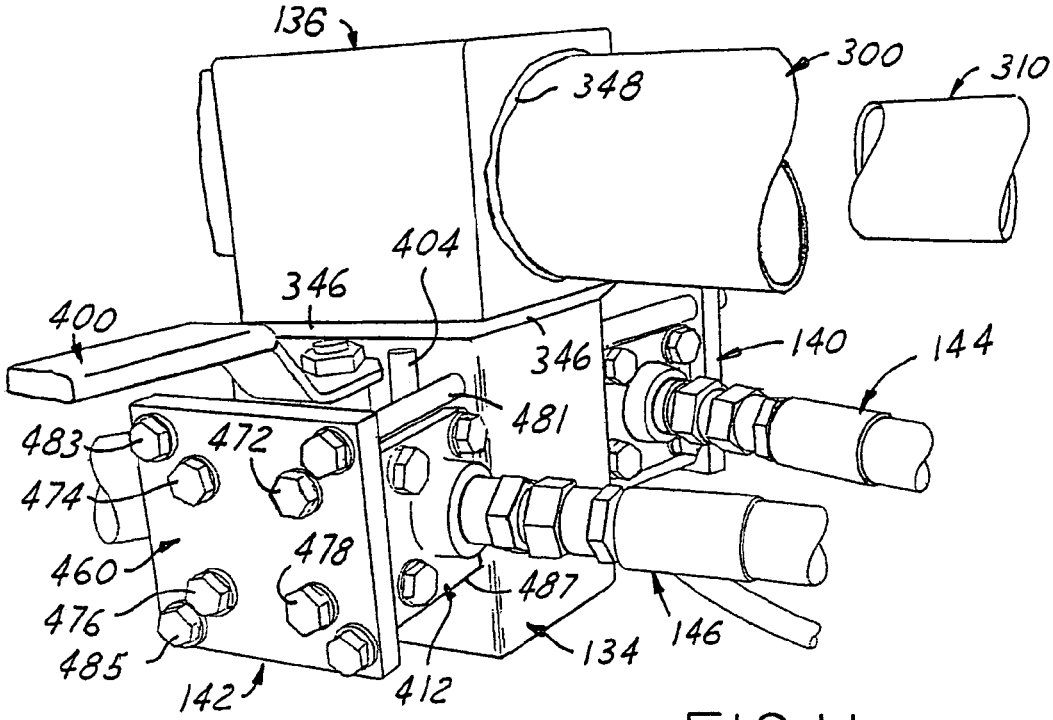
FIG. 11 is a fragmentary perspective view of the primary, secondary and tertiary water inlet distribution structure and valves of FIGS. 9 and 10 as viewed in perspective looking at the outlet side, and being similar to the showing of the structures encompassed by the circle 11 in FIG. 6 but enlarged thereover.
Figure 19:
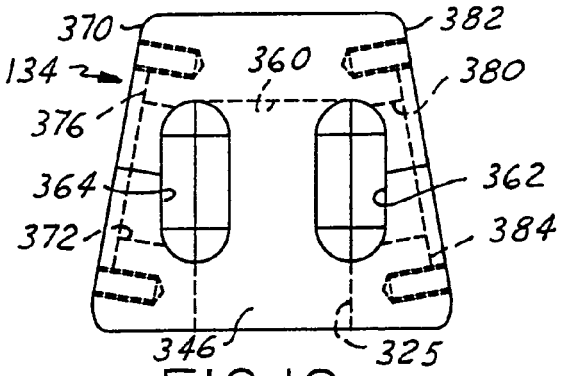
FIGS. 19 and 20 are plan and elevation views of the water feed block as respectively viewed from the top and the main water inlet side of the block.
Figure 20:
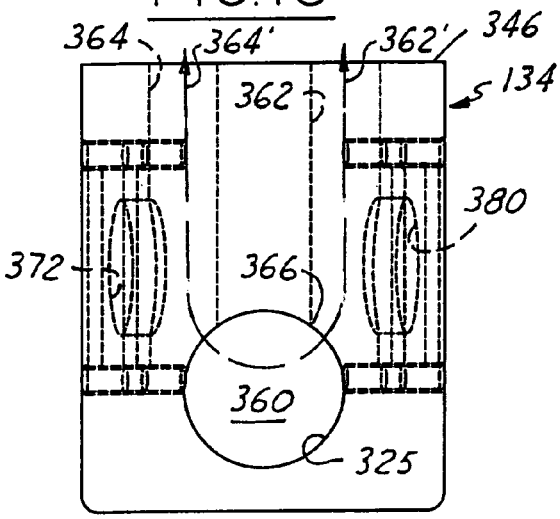
Figure 28:
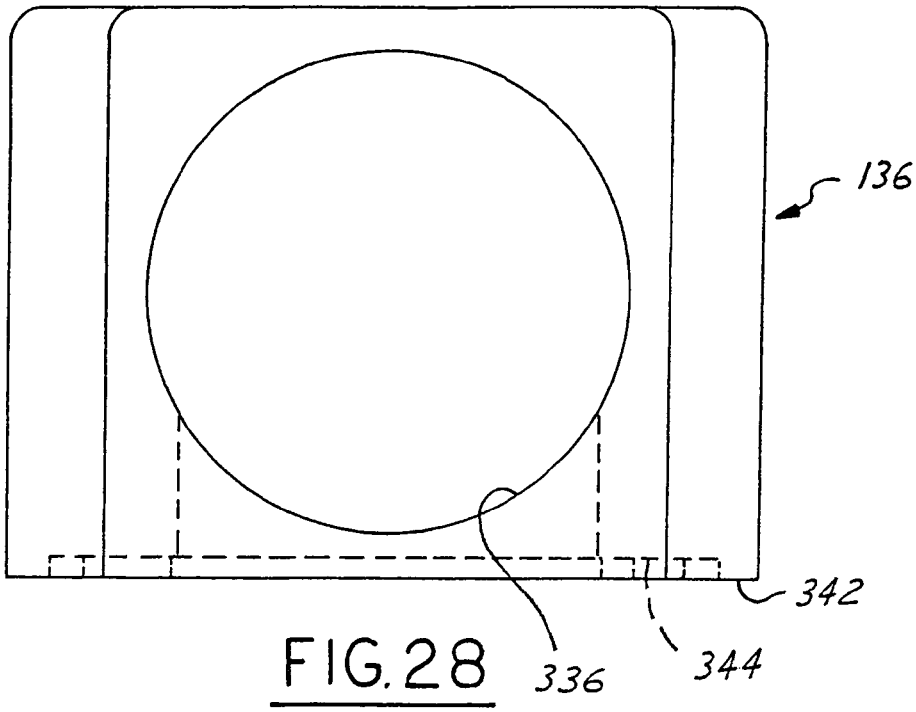
FIG. 28 is an end elevational view of the output end of the pipe sleeve of the water feed block assembly.
Figure 29:
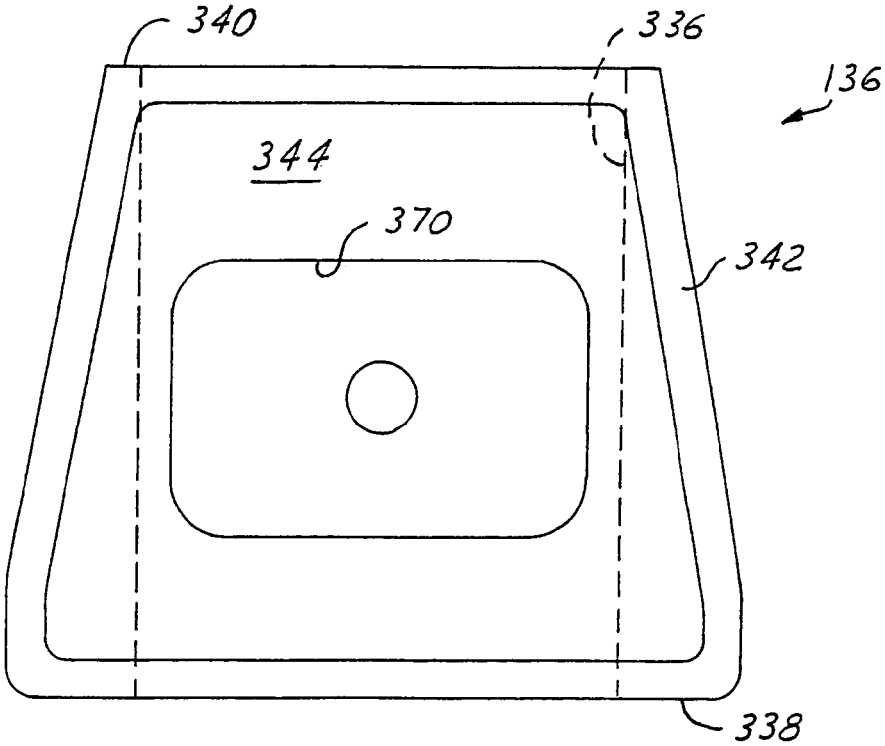
FIG. 29 is a bottom plan view of the pipe sleeve of FIG. 28.

The primary water supply or feed system of tower 100 comprises a standard 45° elbow quick connect coupling 330 (best seen in FIGS. 9 and 10), and the outlet of which is threadably received on an externally threaded straight pipe nipple 332 which in turn is threadably secured in the internally threaded inlet blind bore 325 of water feed block 134 (FIGS. 19 and 20). As best seen in FIGS. 9, 10 and 11, block 134 is supported on boom pipe 300 by the pipe sleeve 136 (shown separately in FIGS. 28 and 29). Pipe sleeve 136 has a cylindrical throughbore 336 open at its inlet end in the rear vertical face 338 of sleeve 136 and its outlet end in the front face 340 of sleeve 136. The bottom face 342 of sleeve 136 has a recess to provide a flat inset surface 344 matching in outline contour to the top face 346 of water feed block 134 (compare FIG. 29 and FIG. 19). The bottom face 342 of pipe sleeve 136 thus is bounded by a trapezoidal margin that in assembly with feed block 134 surrounds the upper edge of the four sides of block 134, face 344 being seated on face 346 in assembly. The circumferentially continuous weld seam 346 affixes and seals feed block 134 to the underside of sleeve 136, see FIGS. 9, 10, and 11. The outlet end of bore 336 telescopically receives the inlet end of boom pipe 300 with an overlapping fit as best seen in FIG. 2 as well as in FIGS. 67-69. This telescopic joint is sealed by a circumferential weld 348 best seen in FIG. 9 and FIGS. 11-12. The rear end of bore 336 of sleeve 136 closely telescopically receives the forward end of air feed coupling 138 and these parts are also sealably secured together by a circumferential weld 350 (FIG. 9).

As still another feature of the invention, water feed block 134, as best seen in FIGS. 19 and 20, provides both an internally split as well as dog leg flow path for primary water feed from inlet nipple 332 up into a flow recombinant chamber 365 in sleeve 136 (see also FIG. 9). More particularly, it will be seen in FIG. 19 that blind bore 325 ends at a back blind wall 360 to thereby form an initial receiving chamber for incoming primary water. Primary water exits from this chamber via a split path route formed by a pair of parallel flow channels 362 and 364 which are elliptical in cross-sectional shape as shown in FIG. 19. These channels open at the top face 346 of block 134 and extend downwardly in the block so as to generally tangentially intersect blind bore 325 to provide flow communication therebetween. The lower end edge of flow channel 362, where the same intersects the blind bore 360 along an edge 366 (FIG. 20), can be partially seen in the perspective view of FIG. 13.

The bottom recessed wall 344 of sleeve 136 (FIGS. 28 and 29) is provided with a rectangular through opening 370 that overlies the openings of split channels 362 and 364 where they exit at top face 346 of block 134. Hence, primary water flowing up channels 364 and 362, indicated by the dot dash flow lines 362' and 364' respectively in FIG. 20, enters the recombining chamber 365 formed in sleeve 136 by the wall of bore 336 and the front face of coupling 138, with air conduit 310 extending centrally coaxially through this space into water pipe 300, as indicated by the phantom or hidden line showing in FIG. 9. The flow streams 362' and 364' thus recombine in sleeve 136 and then make a right angle turn as they leave chamber 365 and enter the inlet end of pipe 300 in surrounding relation to the centrally disposed air tube 310.

As shown in FIGS. 19 and 20, the left side face 370 of block 134 is provided with a secondary water outlet feed channel 372 that opens into primary water feed branch channel 364. The outlet of channel 372 is centered in a face 376 set inwardly from the left face 370 of sleeve 374. Likewise, a tertiary water outlet feed channel 380 is formed in the right-hand face 382 of sleeve 134 and intersects the right-hand wall of primary feed branch channel 362, as shown in FIGS. 19 and 20. Channel 380 likewise opens in a recessed face 384 formed in main face 382 of block 134 (see also FIG. 13). Side outlet channel 372 communicates with the inlet of secondary water valve assembly 140, whereas side channel 380 communicates with the inlet of tertiary water valve assembly 142, as explained in more detail hereinafter.

Construction of Secondary Water Valve Assembly 140 and Tertiary Water Valve Assembly 142

Valve assemblies 140 and 142 utilize commercially available 3-way flow port T-style ball valves. However, these commercially available ball valves are modified in accordance with another feature of the invention to reduce, if not eliminate, the chances of freeze up of these valves, even when unheated, as explained in more detail hereinafter, as well as to provide the improved mounting arrangement for these valves onto water feed block 134.

Figure 12:
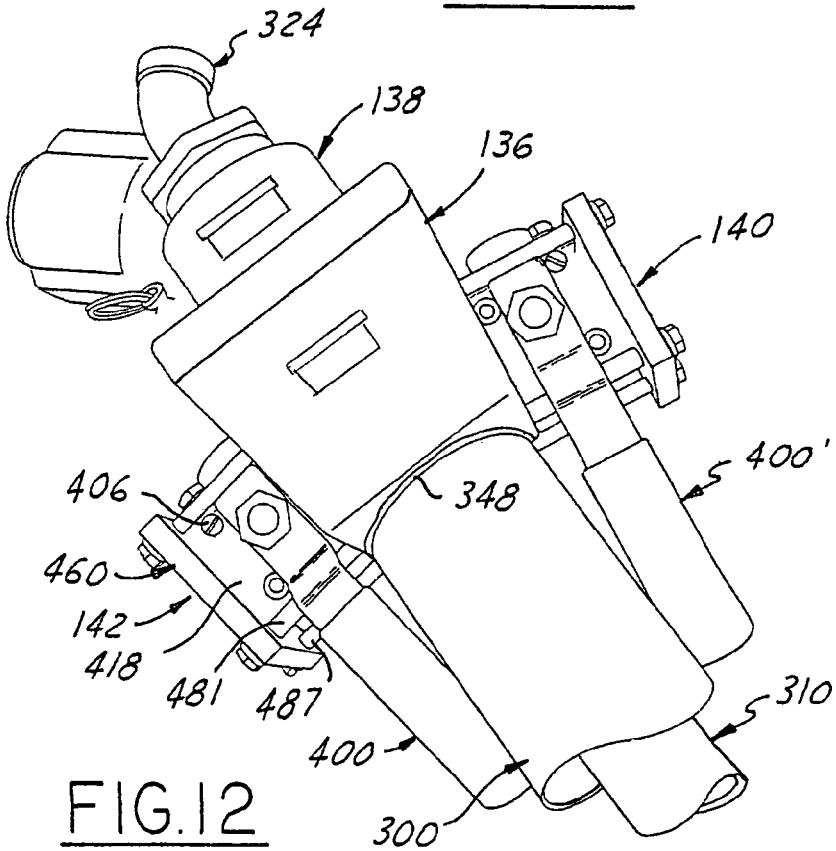
FIG. 12 is a perspective top view of the structure shown in FIG. 11.
Figure 13:
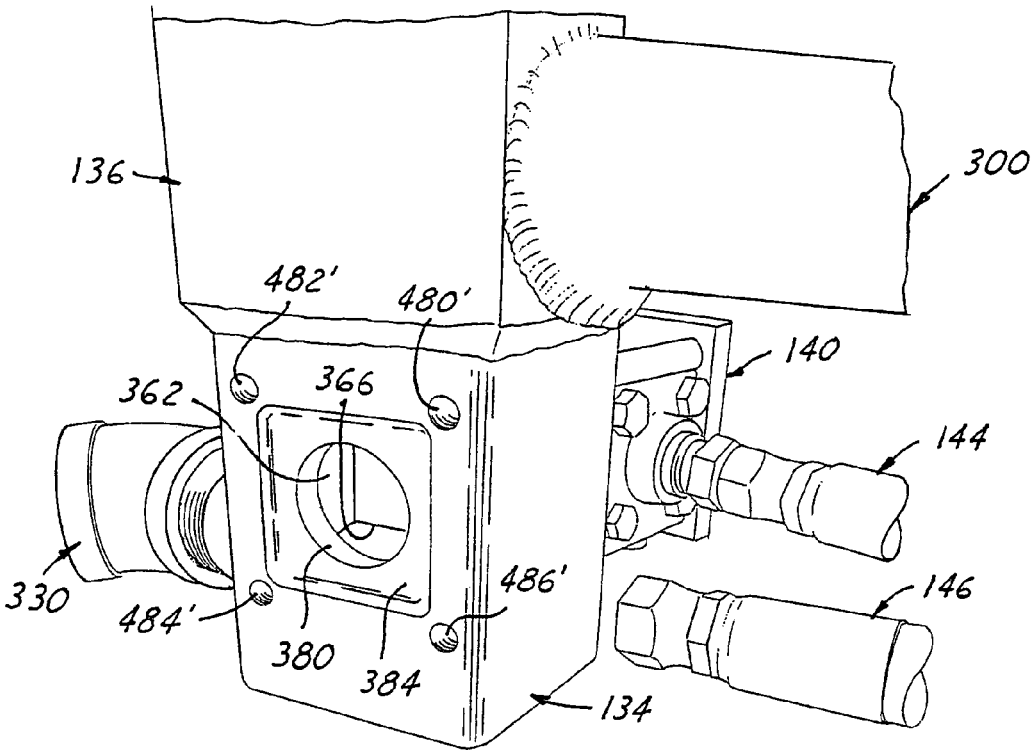
FIG. 13 is a fragmentary perspective view similar to that of FIG. 11 but with the tertiary water supply valve removed and the associated output coupling hose shown disconnected therefrom.
Figure 14:
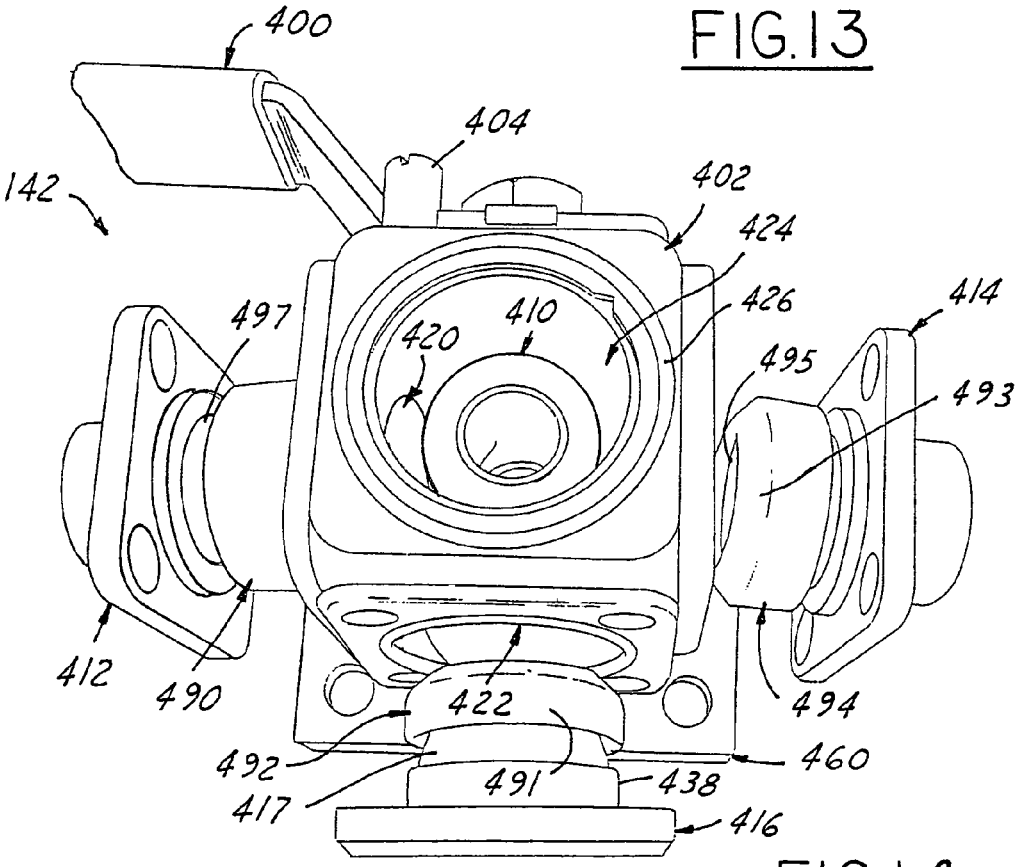
FIG. 14 is a fragmentary perspective exploded view of the components of the tertiary water supply valve disassembled from the structure of FIGS. 8-12.
Figure 15:
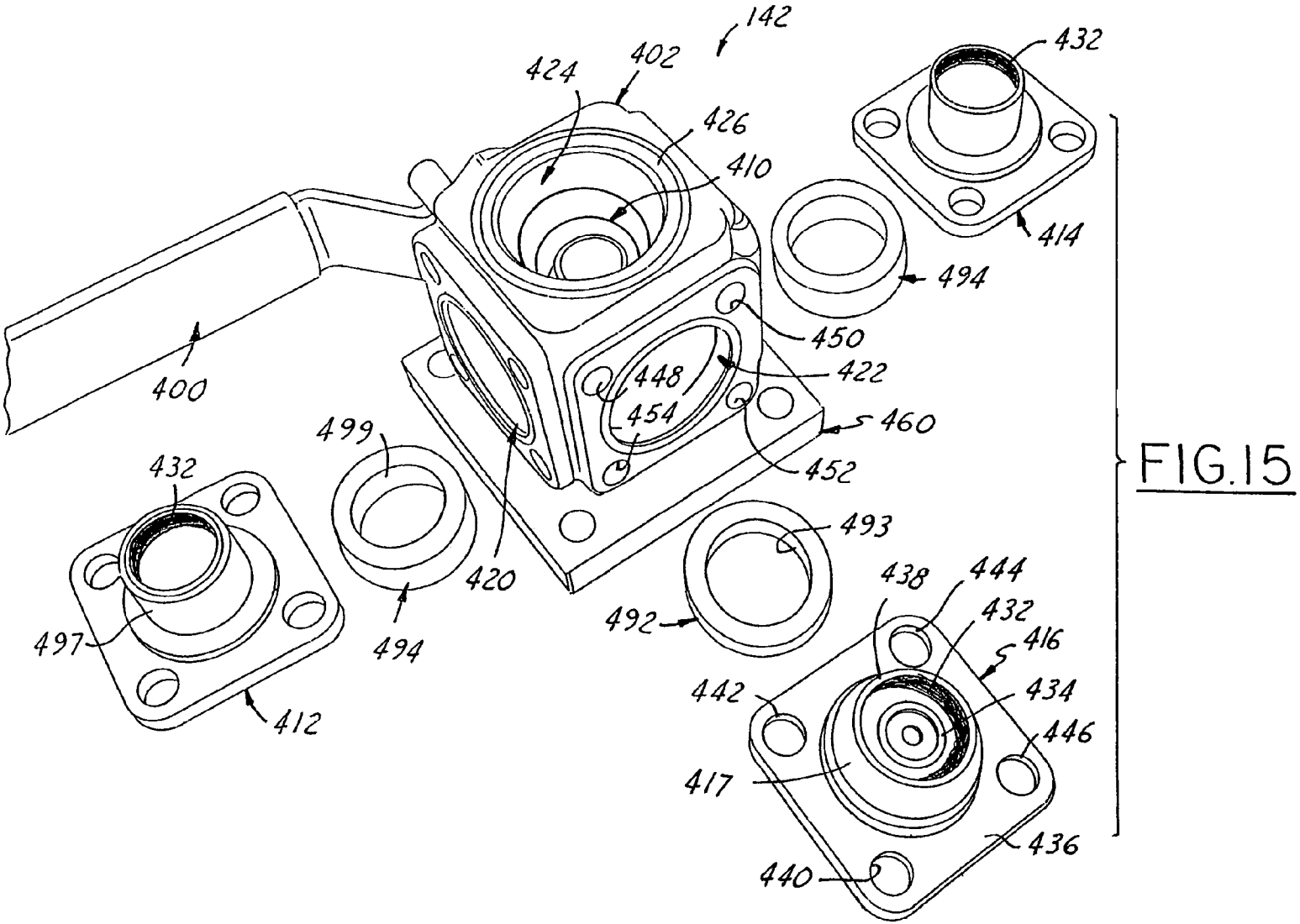
FIG. 15 is another view of the valve of FIG. 14 but further exploded to better illustrate the components thereof, the valve handle being shown in the water feed position corresponding to FIG. 18.
Figure 15A:
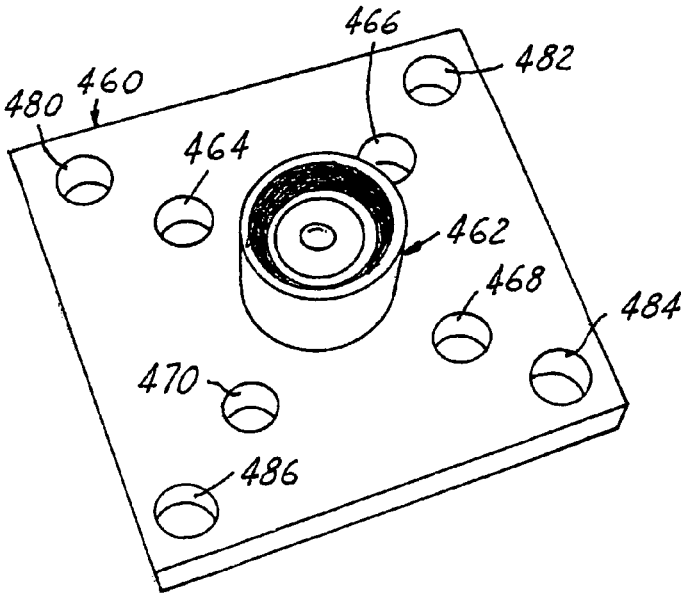
FIG. 15A is a perspective view of the mounting plate and blind end plug subassembly of the secondary water supply valve assembly.
Figure 16:
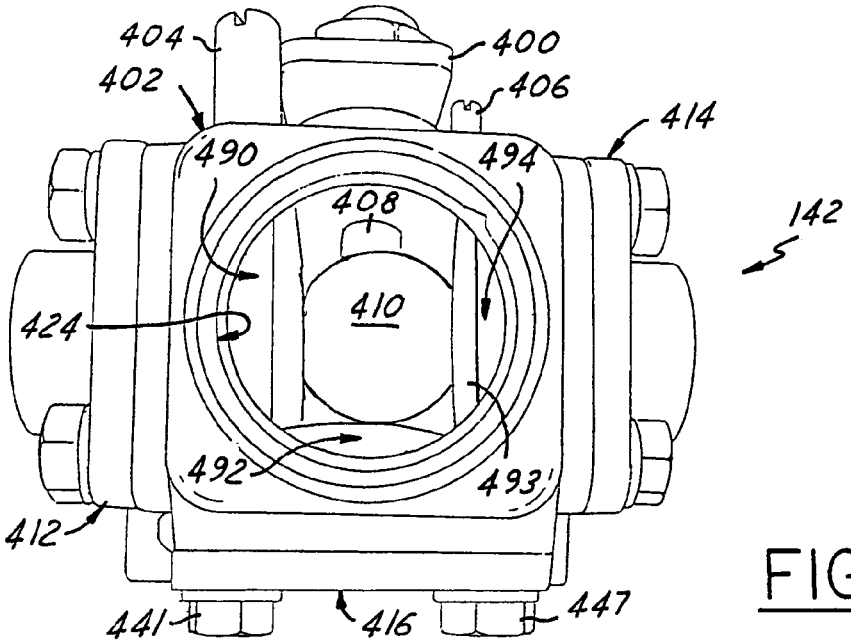
FIG. 16 is a side-elevational view of the valve of FIG. 15 reassembled and illustrating the same in the drain position corresponding to FIG. 17.

Secondary water valve assembly 140 is identical construction to tertiary water valve assembly 142, and hence discussion of these two valves will be limited to valve assembly 142 as illustrated in more detail in FIGS. 14, 15 and 16. However, it should be understood that valve assembly 142, when mounted to the side of feedblock 134, shown open in FIG. 13, is flipped around 180° from the showing of valve assembly 142 in FIG. 14. Hence, the crank handle 400 of valve assembly 142, shown in FIG. 14 in the tertiary water feed supply position (the "ON position"), in assembly with feedblock 134 points towards the spray head end of boom 128 (as shown in FIG. 12).

Valve assembly 142 in some respects resembles a conventional commercially available three-way flow port T-style ball valve in that it has a square cubical cast metal housing 402 with a hollow interior and with openings on each of the four sides of the cube and on the cube bottom. The top wall of valve body 402 is basically unchanged and carries the usual upright travel limit pins 404 and 406 (FIGS. 14 and 16, respectively), pin 404 limiting travel of handle 400 to the fully on position, and pin 406 limiting the 90° arc of travel of handle 400 in the opposite direction, i.e., to the drain position of FIG. 16. Handle 400 is fixed to operating stem 408 of the ball valve (FIG. 16) that protrudes into the body cavity and that is affixed at its inner end to the valve ball 410 that controls liquid flow through the valve assembly. Also, two of the five end caps provided with a conventional ball valve assembly are also utilized, namely the flanged water feed outlet end cap 412 and the flanged water drain outlet end cap 414. These two end caps 412, and 414 are bolted to valve body 402 in the usual manner as shown in FIG. 16, and respectively cover the water feed side opening 420 (FIG. 15), and the drain side opening (not seen) disposed axially opposite opening 420 in the axially opposite side wall of body 402.

Figure 17:
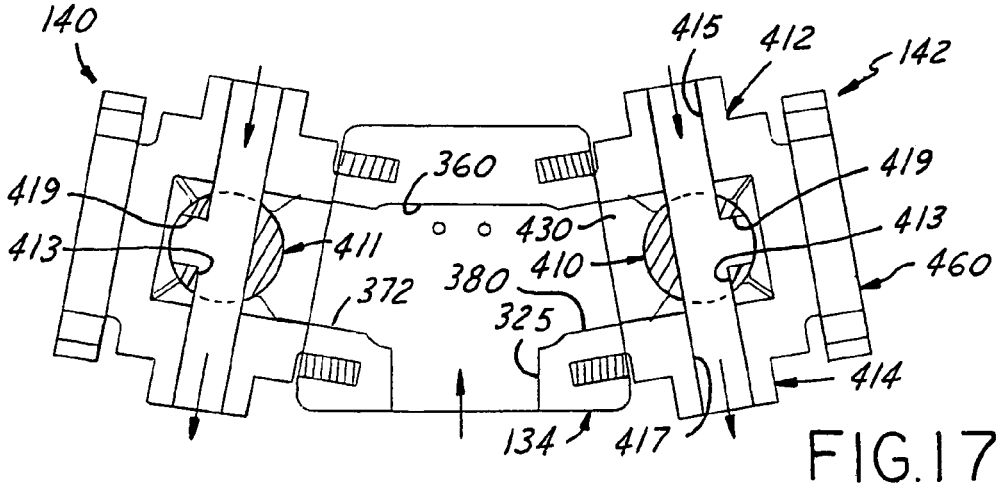
FIGS. 17 and 18 are simplified diagrammatic views taken in horizontal sections through the secondary and tertiary water supply valves and associated water feed block respectively illustrating the drain position and the feed position of the valve ball of these valves.
Figure 18:
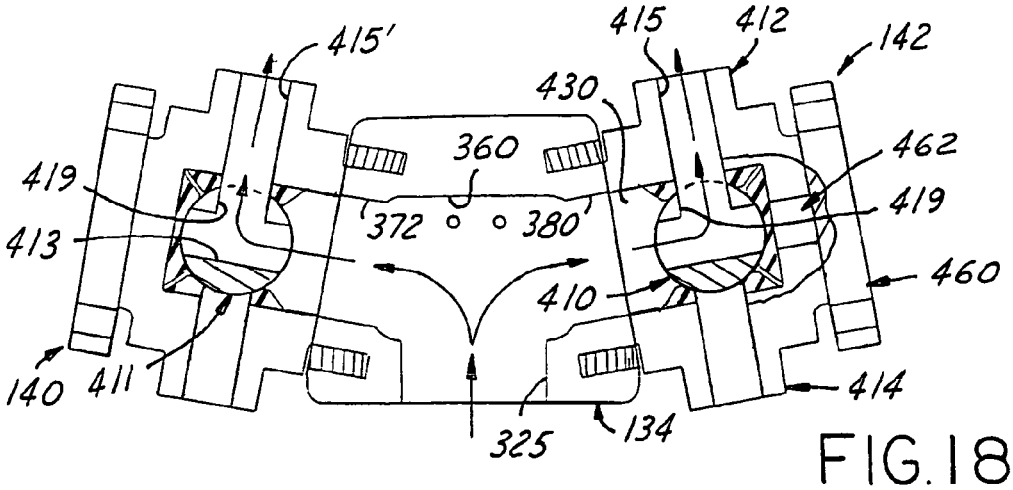

However, the improved valve assembly 140 or 142 of the invention is modified from conventional commercial three-way ball valves in several important and novel respects. First of all, the usual end cap that covers the inlet side opening is deleted and the inlet side opening 424 of body 402 is enlarged diametrically over the diametrical dimension of the openings 420 and 422, and a larger O-ring seal 426 provided to encircle the margin of the enlarged opening. Opening 424 is thus sized to match the diametrical dimension of outlet opening 380 of feed block 134 (FIG. 13) when fastened in assembly therewith. Thus, the valve ball 410 and adjacent inlet space within valve body 402 is "wide open" to the turbulent flow of primary water entering feed block 134 via inlet 324 (FIGS. 17 and 18 described hereinafter). Notice, as best seen in FIGS. 17 and 18, there is thus a large open space 430 constantly exposed to the turbulent primary water flow entering feed block 134 via inlet 324 and impinging back wall 360 then exiting upwardly from the feed block via parallel channels 362 and 364, as described previously in conjunction with FIGS. 9, 19 and 20. Valve ball 410 is thus constantly washed by this turbulent flow even in the feed-closed, drain-open condition of FIG. 17, thereby helping to prevent ice build up and freeze up locking of the valve 142 when set in the drain position of FIG. 17.

Next, the trunion pin provided in the commercial valve bottom plate that normally is aligned coaxially with pin 408 to provide a trunion mount of the ball valve was removed and replaced by a blind end cap 416 (see FIG. 6*a*) made up of a concave annular elastomeric seal ring 432 surrounding a solid center plug post 434 protrudes centrally from a square base plate 436. A cylindrical metal tube 438 protruding concentrically up from base plate 436 concentric with plug 434 and encapsulates seal 432. Four bolt holes 440, 442, 444, and 446, one in each corner of plate 436, line up with internally threaded bolt holes 448, 450, 452 and 454, respectively, in the bottom side of body 402 for receiving the mounting bolts that fasten bottom blind end plate 416 to body 402 (as shown in FIG. 16). Blind bottom plug 416 thus serves as an imperforate cover plate and also functions to support ball 410 for rotation on seal 432 as a modified trunion support without requiring the prior trunion pin journaling and the construction details associated therewith.

As another modification and improvement incorporated into valve assemblies 140 and 142, a combined valve assembly mounting plate and blind end cap subassembly 460 is provided in place of the usual smaller conventional blind end cap that is similar to vent cap. The mounting plate/end cap 460 is shown in FIGS. 11, 12, 14, 15, 15A, 15B and 15C.

Mounting plate 460 is a flat square plate carrying the blind end cap 462 at its center and protruding therefrom into the body opening opposite fill opening 424 and adapted to sealably engage and seal whichever passage of ball 410 is registering therewith, as partially shown in the broken away portion of FIG. 18. Mounting plate 460 is provided with four through holes 464, 466, 468 and 470 (FIG. 15A) that match up with the four threaded mounting sockets provided in body 402 on its outboard face against which plate 460 mounts, as shown in FIGS. 11 and 12. Bolt holes 464-470 individually receive the four mounting bolts 472, 474, 476 and 478 (shown in FIG. 11) that securely mount the in-board face of plate 460 against the O-ring seal carried by body 402.

Plate 460 has another series of bolt holes 480, 482, 484 and 486 (FIG. 15A) individually adjacent each corner of plate 460 that are adapted to be coaxially aligned with the threaded bolt sockets 480', 482', 484' and 486' provided in the side face of feed block 134 (FIG. 13). As best seen in FIGS. 11 and 12, valve assembly 142 is thus mounted to feed block 134 by inserting long, hex-headed mounting bolts 481, 483, 485 and 487 respectively through holes 480, 482, 484 and 486 and threadably into holes 480', 482', 484' and 486', and then tightening down the same to securely clamp valve assembly 142 to feedblock 134 as shown in FIGS. 11 and 12.

Figure 15B:
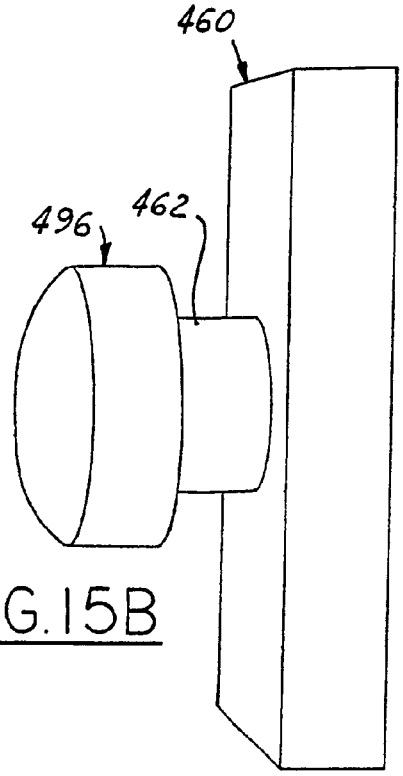
FIG. 15B is a simplified perspective view of the mounting plate/end cap subassembly of FIG. 15A with an associated filler ring mounted thereon.
Figure 15C:
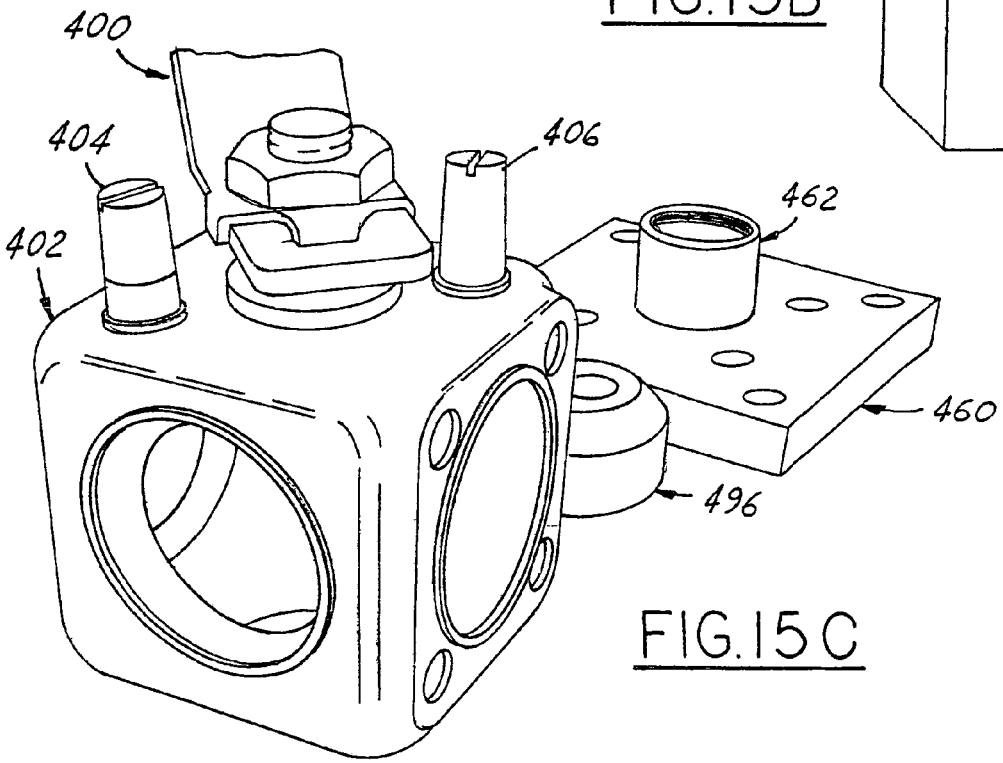
FIG. 15C is a perspective view of the valve body and valve handle of FIG. 15 showing the mounting plate and end plug subassembly of FIGS. 15A and 15B separated off to the rear and with the filler ring shown laying by itself between these two parts.

In accordance with another improvement feature of valve assemblies 140 and 142, a series of filler rings are provided to occupy most of the interior dead space normally found in conventional T-flow ball valve assemblies in order to further reduce the likelihood of lock up due to water freezing interiorly of the valve assembly. A total of four filler rings 490, 492, 494 (FIG. 15) and 496 (FIGS. 15B & 15C) are thus provided and are made from a suitable plastic material such as ultra-high molecular weight polyethylene (UHMWPE). Each filler ring 490-496 is identical and, as best seen in FIG. 14, has an outer periphery 491 that is cylindrical in contour and also has a beveled or tapered nose 493 that converges down from cylindrical surface 491 to an inner edge 495 that is flush with the edge of the sleeve 497 that carries the valve-ball-engaging seal 432. The inner periphery 499 of each filler ring 490-496 is dimensioned for a sliding press-fit on the associated cap sleeve 497 of end caps 412 and 414 and sleeve 462 of mounting plate 460 (FIG. 15B). However, filler ring 492 for bottom end cap 416 has a conical inner periphery 493 adapted to seat snugly on the conical surface of the short post 417 of bottom blind plate 416 (FIGS. 14 and 15).

As partially seen in FIG. 16, when the feed outlet end cap 412, the drain outlet end cap 414 and the bottom blind end cap 416 are bolt-mounted to body 402 in final assembly therewith, filler rings 490, 492, 494 (as seen in FIG. 16, as viewed looking through the large inlet opening 424 of body 402), occupy what otherwise would be dead space that otherwise would fill with water when valve ball 410 as shifted back and forth between the drain and feed positions shown diagrammatically in FIGS. 17 and 18. Filler ring 496 carried by the mounting plate 460 likewise occupies most of the dead space behind valve ball 410 (not seen in the drawings).

The operation of valve assemblies 140 and 142 is illustrated semi-schematically in FIGS. 17 and 18. The valve ball in valve assembly 140 is designated by the reference numeral 411, valve assemblies 140 and 140 being identical but reverse mounted to feed block 134. It will be seen in the drain condition of FIG. 17 that the water flow through main conduit 413 of each valve ball 410, 411 is aligned with the flow passages 415 and 417 of end caps 412 and 414, respectively. The branch passage 419 of each valve ball 410, 411 is closed by the engagement with the blind plug 462 of the associated mounting plate assembly 460.

In the feed condition of the valve assemblies 140 and 142 illustrated in FIG. 18, it will be seen that valve balls 410 and 411 have been rotated by turning the associated handles 400 and 400' to rotate valve ball 411 clockwise 90°, and to rotate valve ball 410 counterclockwise 90°. In this feed condition, one end of valve ball through-passage 413 is open to the primary water turbulence chamber of feed block 134 via side outlets 372 and 380 respectively. The other end of the valve ball through-passage 413 is sealed by the end plug of the associated mounting plate 460. The short branch passage 419 of each valve ball now registers with the passage 415 in end cap 412, and the like passage 415' in the like end cap of valve assembly 140 to thereby feed a portion of the primary water inflow to feed block 134 through the secondary and tertiary water feed lines 144 and 146.

It will be seen in FIGS. 17 and 18 that the incoming primary water entering feed block 134 continuously flows into the feed block cavity on its way to the primary water flow conduit 300 of the boom assembly 128. The incoming water being forced by blind wall 360 to make a right angle upward turn, due to the cooperative orientation of the outlet channels 362 and 364 having their flow axis perpendicular to the inflow axis of inlet bore 325, creates a turbulent condition in both the main chamber (bore 360) of feed block 134 as well as in the wide-open spaces provided by the block outlets 372 and 380 and the registering space provided by the enlarged opening 424 in the valve body 402. Hence, in the drain condition of FIG. 17, turbulent water is continually washing against a back side of each valve ball 410, 411 exposed to the main chamber of feed block 134.

In addition to this turbulent flow anti-freezing effect of the improved valve construction of valve assemblies 140, 142, filler rings 490-496 further reduce the possibility of valve lock up due to water freezing in any of the dead spaces existent in the valve body 402. What little dead space remains has been significantly reduced in volume and hence if water does freeze in the reduced dead space volumes, the ice formation is correspondingly smaller and hence may be readily broken by little torque being exerted on the valve handle, i.e., the valve is not locked up in the event of such dead water being frozen in the dead spaces of the valve assembly interior. Due to this feature, electrical heaters are not needed to prevent freeze up of the valve assemblies 140 and 142 because flowing water does not freeze, and dead water volume within valve body 402 is greatly reduced.

Spray Head Assembly

Figure 46:
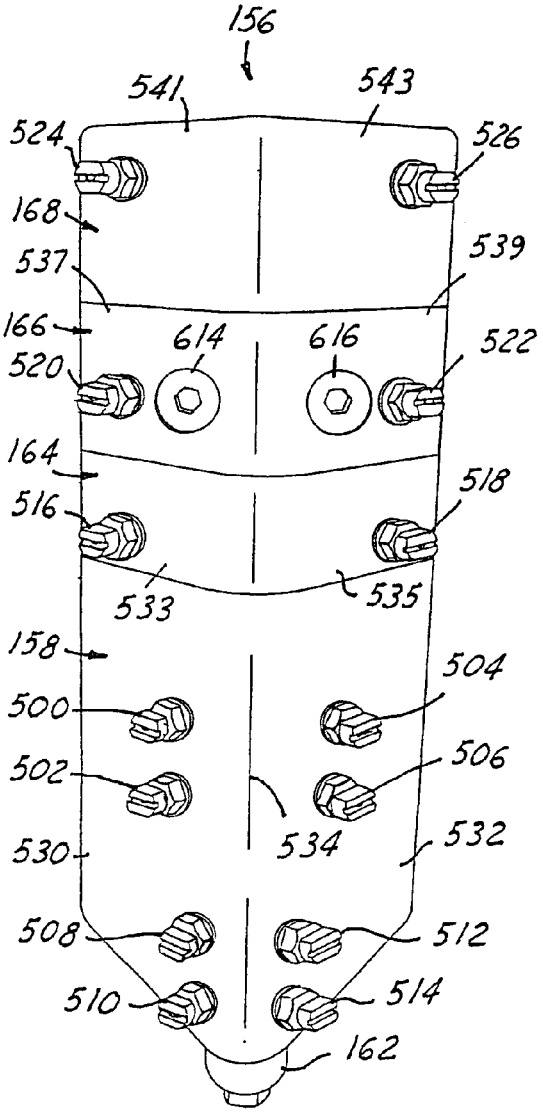
FIGS. 46 and 47 are respectively front and side elevational views on the spray head assembly of the snow making tower of the invention.

The spray head assembly 156 of tower 100 also represents a further improvement feature of this invention, as will become apparent from the detailed description hereinafter. In the presently preferred embodiment of spray head assembly 156 illustrated in FIGS. 46-65, the spray head is equipped with 12 water spray nozzles and 2 nucleator nozzles. Referring to FIG. 46, spray head assembly 156 is a four-piece modular stack up made up of the base manifold 158 that is welded to the upper end of the cylinder 300 of boom extrusion 148 (directly and without any foot piece therebetween). Base manifold 158 mounts eight of the water spray nozzles, namely, secondary water nozzles 500 and 502 on one side face 530 of the angled head front face and secondary water nozzles 504 and 506 on the other side face 532 of the front face. Tertiary water nozzles 508 and 510 are mounted on side face 530 below secondary nozzles 500 and 502 but closer to the apex 534 of the angled front face of the head. Likewise tertiary water nozzles 512 and 514 are mounted on side face 532 and closer to the apex 534 than secondary nozzles 504 and 506. The intermediate spray manifold 164 carries two primary water spray nozzles 516 and 518 one on each of its angled front faces 533 and 535 but spaced further from the head apex 534 than nozzles 500 and 504. The nucleator manifold 166 carries nucleator spray nozzles 520 and 522, one on each angled front face 537 and 539 and aligned vertically directly above primary nozzles 516 and 518, respectively. Finally, the cap spray manifold 168 carries two primary water spray nozzles 524 and 526 mounted respectively on angled front faces 541 and 543, and vertically aligned respectively with nozzles 520 and 516 and 522 and 518. The primary, secondary and tertiary water spray nozzles 516, 518, 524, 526; 500, 502, 504, 506; and 508, 510, 512, and 514 are conventional commercially-available nozzles and, for example, operate with a spray angle of 50°. Nucleator spray nozzles 520 and 522 likewise are conventional commercially-available nozzles with, for example, a spray angle of 65°.

Figure 47:
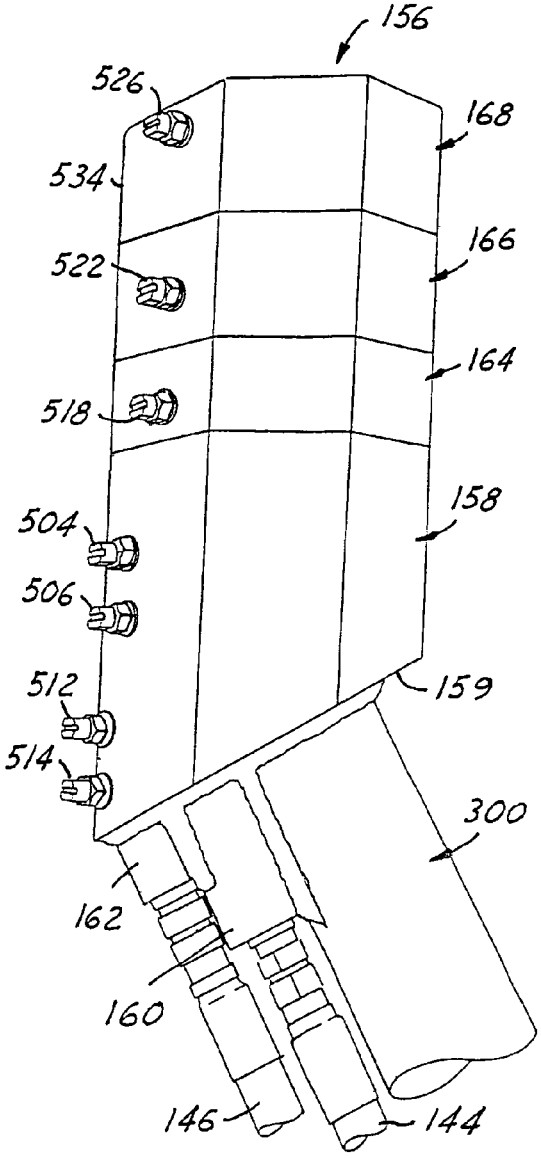
Figure 48:
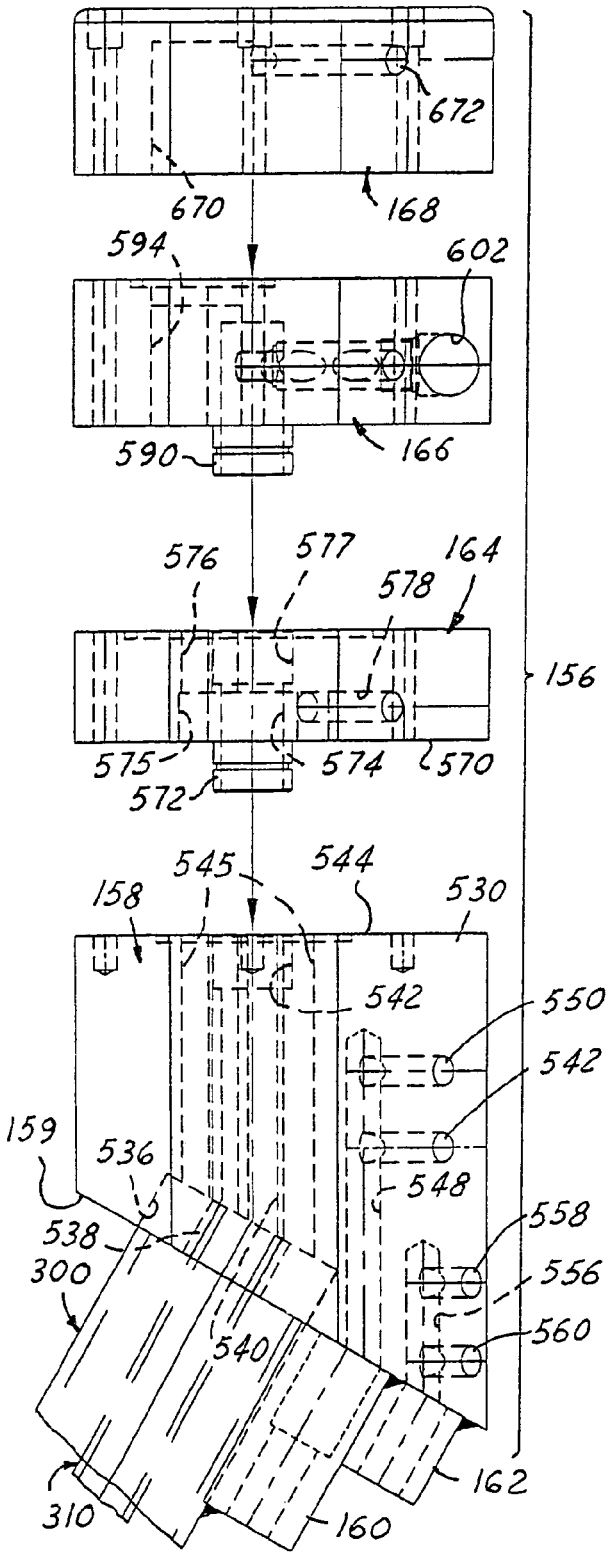
FIG. 48 is an exploded side-elevational view of the spray head assembly of FIGS. 46 and 47.
Figure 49:
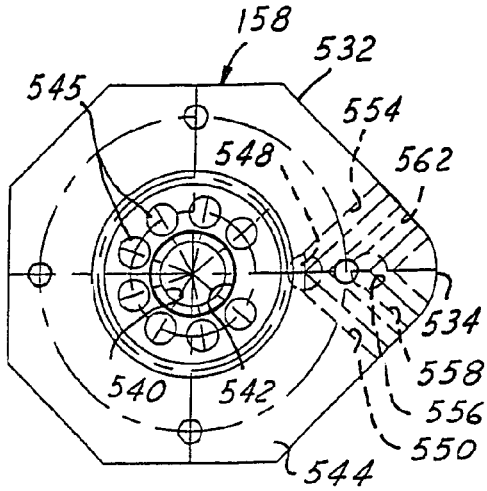
FIG. 49 is a top plan view of the manifold base component of the spray head assembly of FIGS. 46-48.
Figure 50:
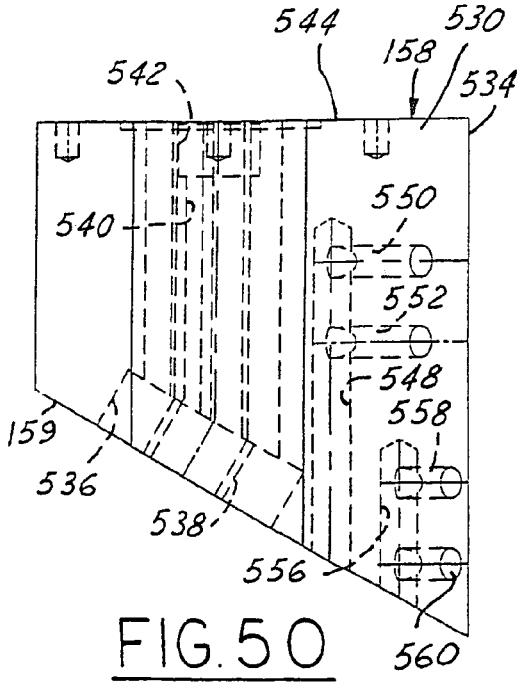
FIG. 50 is a side-elevational view of the manifold base component of the spray head assembly.
Figure 51:
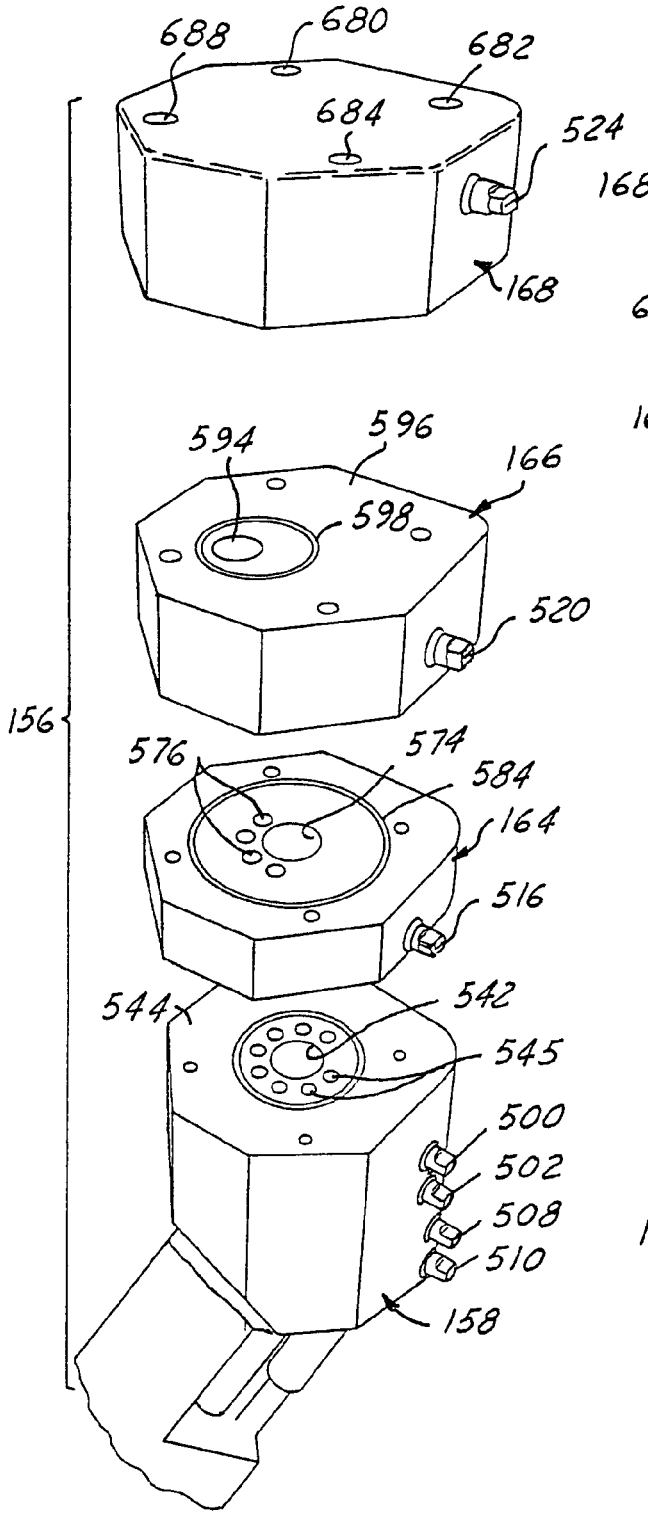
FIG. 51 is an exploded perspective view of the spray head assembly as viewed from above and off to the side.
Figure 52:
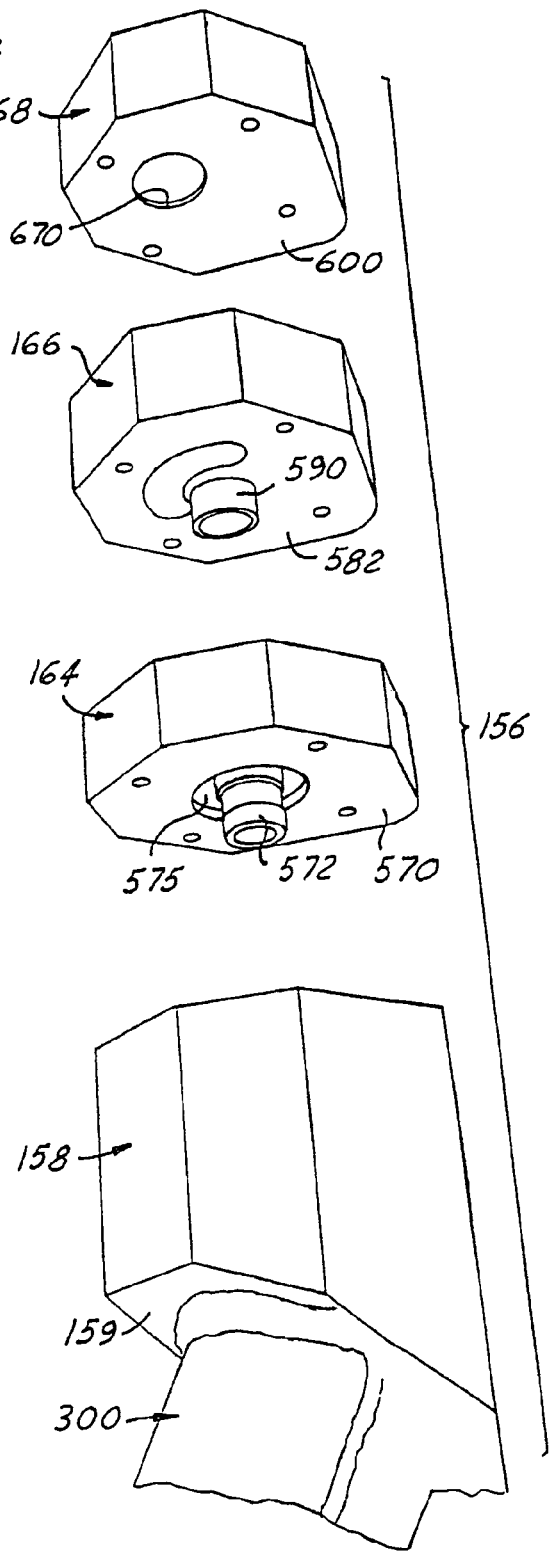
FIG. 52 is an exploded perspective view of the spray head assembly as viewed from below and off to the side, but with the spray nozzles omitted.

As shown in more detail in FIGS. 48, 49 and 50, the spray head manifold base 158 is a seven-sided polygon having the same configuration in radial cross-section as each of the other manifold parts 164, 166 and 168 to provide matching contours and modular assembly. The "starboard" face 530 of base 158 is angled at 45° to the fore and aft centerline of the head, as is the port face 532 of base 158, but in the opposite directions so they converge in a 90° angle at the apex vertical centerline 534 of the spray head. It will be seen from FIGS. 47 and 50 that the underside face 159 of base 158 is angled in a plane at 60° from the axial centerline of head 156 so that when boom 128 is elevated to maximum or near maximum operating height, with its longitudinal axis generally at 60 degrees to horizontal, head 158 mounted on the end of boom 128 will have its axial centerline oriented vertically thereby orienting all of the water and nucleator nozzles so to discharge generally in a horizontal direction.

The underface 159 of manifold base 158 is provided with a cylindrical socket 536 (FIGS. 48 and 50) the diameter of which corresponds to the outside diameter of cylindrical tube 300 of boom 128. A smaller diameter inner concentric collar 538 is machined in head 158 for telescopically receiving in assembly the upper end of air tube 310 therein (FIG. 48). A circumferentially continuous weld is formed around the entire circumference of air pipe 310 at the outer end of collar 538. The upper end of tube 300 of extrusion 148 is fitted to the outer edge of cavity 536 and it too is welded to head base 158 with a circumferentially continuous weld.

Collar 538 registers with an axially extending central passageway 540 in head base 158 that opens at its upper end into a counterbore 542 which in turn opens to the upper flat face 544 of base 158 (FIGS. 48 and 50). The annular space in socket 536 surrounding collar 538 registers with a circular row of eight drilled passages 545 (FIG. 49) that are arrayed concentrically around air tube passage 540 for feeding primary water from tube 300 through head base 158 to intermediate manifold 164. Compressed air is fed from air tube 310 via passage 540 to intermediate head 164.

Spray head base 158 also has an axially extending drilled water passage 548 (FIGS. 48, 49 and 50) forming a blind bore that opens at face 159 and runs axially upwardly in head base 158 to feed secondary water to angled branch passages 550 and 552 (FIG. 50) that open at starboard face 530 and in turn respectively feed secondary water to spray nozzles 500 and 502. Likewise, passage 548 communicates with a pair of vertically spaced branch passages 554 (FIG.

49, only one shown) that open to port face 532 and feed secondary water to nozzles 504 and 506. As shown in FIG. 48, the lower end of passage 548 communicates with the outlet end of secondary water transition block 160 which is welded to base face 159 as well as to the side of tube 300.

Another shorter vertical passage 556 is drilled to form a blind bore opening at face 159 and extending axially upwardly in head base 158, passageway 556 communicates at its lower end with the tertiary water transition block 162 (FIG. 48), and feeds tertiary water to branch passages 558 and 560 which in turn supply tertiary water to nozzles 508 and 510. Again, the port side tertiary water nozzles 512 and 514 are fed by like branch passages 562 (only one shown) also communicating with passage 556.

Figure 57:
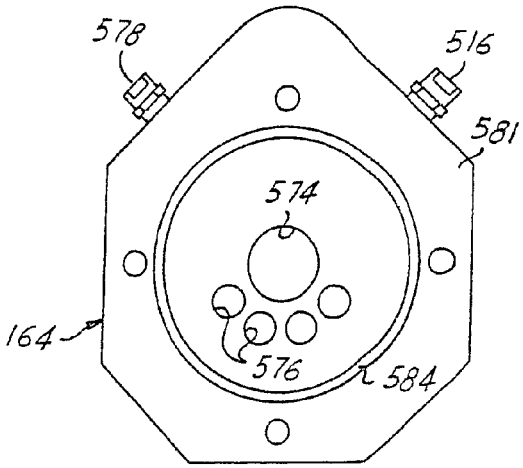
FIG. 57 is a top plan view of the intermediate manifold of the spray head.
Figure 55:
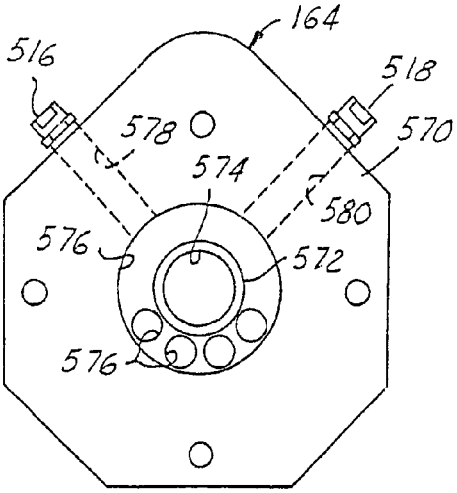
FIG. 55 is a bottom plan view of the intermediate manifold of the spray head.

Referring to FIGS. 48, 51, 52, 55 and 57 spray head intermediate manifold 164 has a flat bottom face 570 that rests flush against upper face 544 of base 158 in assembly therewith. A tubular nipple 572 protrudes from the underface 570 of head 164 and carries an O-ring. Nipple 572 is telescopically received within socket 542 of head base 158 to couple air passage 540 with a compressed-air-conducting passage 574 for feeding air through intermediate manifold 164 to nucleator head 166. An annular cavity 575 surrounds nipple 572 and registers with the upper outlet openings of primary water passages 545 of head base 158 to receive primary water therefrom and feed the same within intermediate manifold 164 via drilled passages 578 and 580 to nozzles 516 and 518, respectively. As best seen in FIGS. 55 and 57, arcuate row of four drilled passages 576 extend from the upper wall of annular cavity 575 upwardly to open at the top face 580 of intermediate head 164 for feeding primary water up to the nucleator manifold 166.

Figure 56:
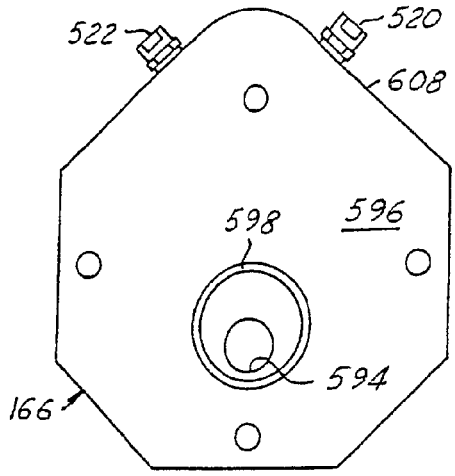
FIG. 56 is a top plan view of the nucleator manifold of the spray head.
Figure 54:
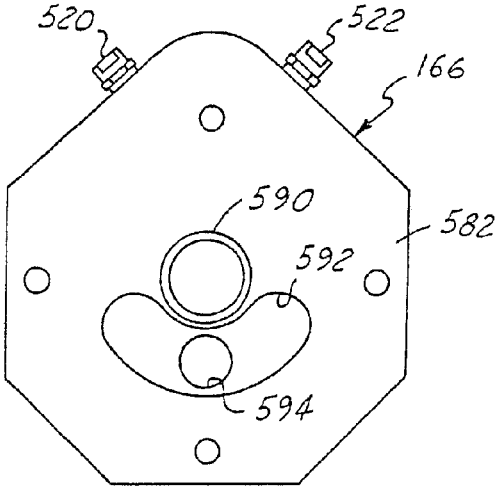
FIG. 54 is a bottom plan view of the nuclear manifold of the spray head.

Nucleator manifold 166 has a flat bottom face 582 which seats flush on top face 581 of head 164 in assembly therewith. An O-ring groove containing an O-ring 584 is provided in top face 581 in surrounding relation to passages 576 to prevent water leakage from between manifolds 164 and 166 in assembly. Nucleator manifold 166 has a nipple 590 protruding from its underface 582 that carries an O-ring and sealably seats the upper end socket 577 (FIG. 48) of air passage 574 in assembly with manifold 164 to thereby supply compressed air to the nucleator head 166. An arcuate cavity 592 (FIGS. 54, 60 and 61) is provided in the underside 582 of nucleator manifold 166 for receiving therein primary water communicated upwardly through manifold 164 via passages 576 that open into cavity 592. A cylindrical passage 594 opens into cavity 592 and extends upwardly through manifold 166 to open at its top face 596 (FIG. 56). An O-ring groove and an O-ring 598 therein encircles the upper opening of passage 594 for preventing water leakage between top face 596 and the bottom face 600 of cap manifold 168 when seated against top face 596 in assembly.

Figure 59:
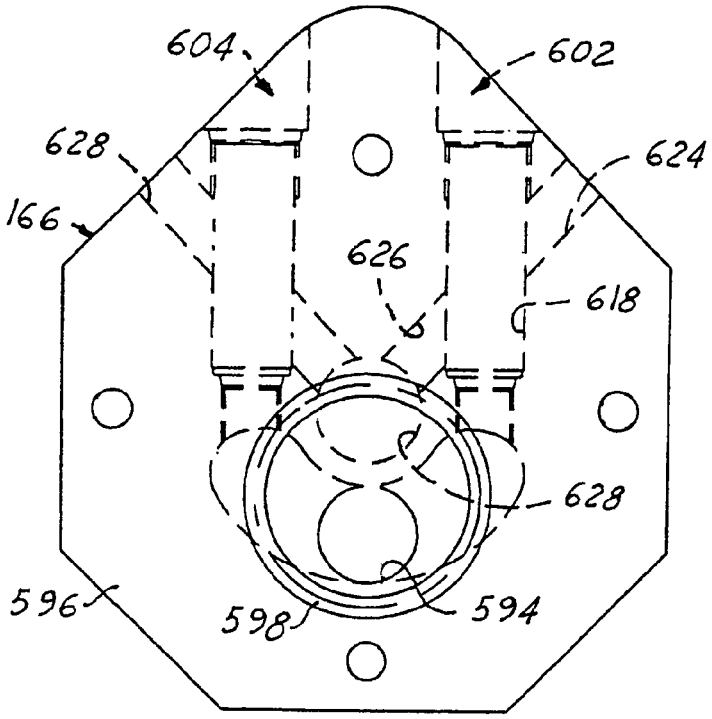
FIG. 59 is a top view of the nucleator manifold of the spray head, similar to FIG. 56, but showing internal details in phantom.
Figure 60:
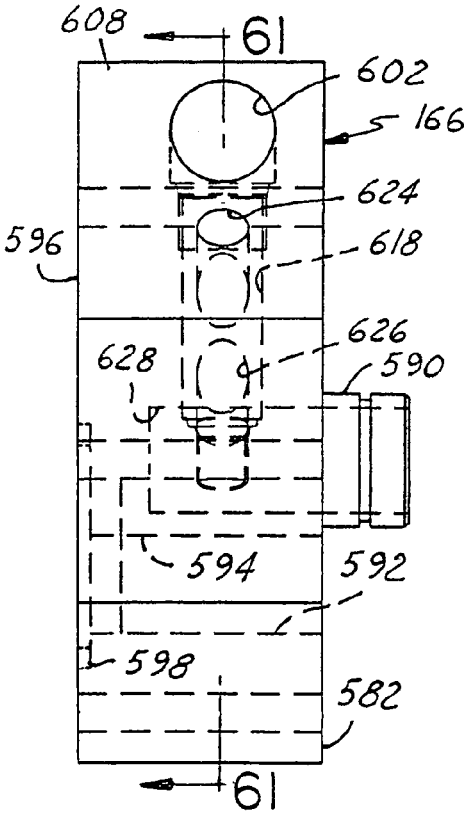
FIG. 60 is a side-elevational view of the nucleator manifold of the spray head.
Figure 61:
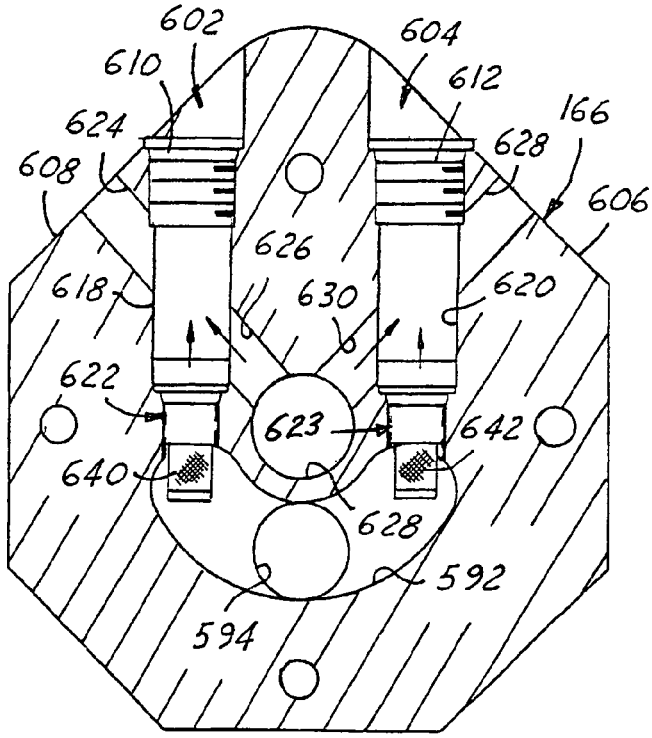
FIG. 61 is a cross-sectional view taken on the line 61-61 of FIG. 60, but with the interior nucleator water atomizing nozzles shown in elevation.
Figure 62:
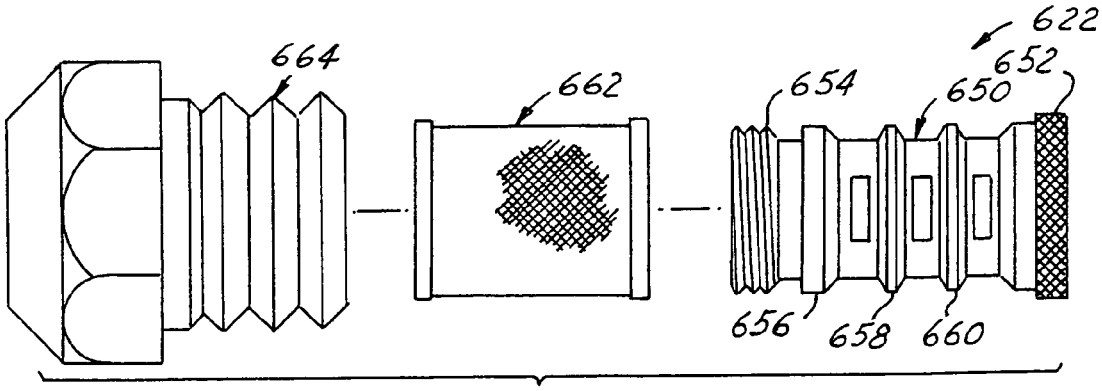
FIG. 62 is a side-elevational exploded view of the nucleator water atomizing nozzle subassembly.
Figure 63:
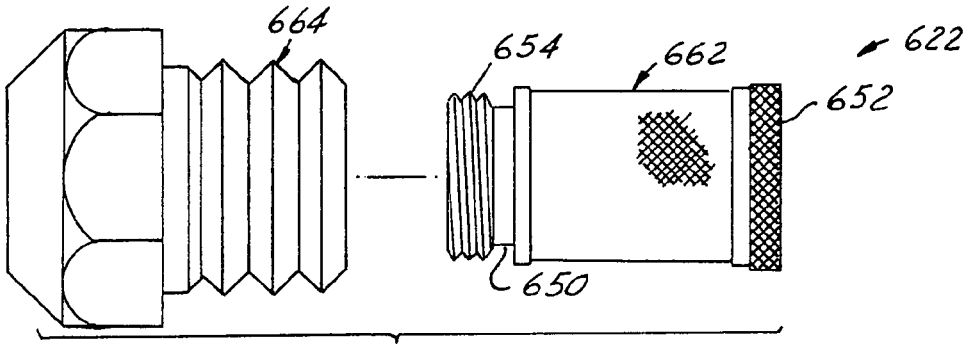
FIG. 63 is a side-elevational exploded view showing the cylindrical filter screen assembled on the filter carrier.

As seen in more detail in FIGS. 59, 60 and 61, nucleator manifold 166 is provided with a pair of parallel stepped diameter passageways 602 and 604 that open respectively at port and starboard faces 606 and 608 of nucleator manifold 166. The entrances to passages 602 and 604 have internal threads 610 and 612 for threadably receiving sealing plugs 614 and 616 respectively (FIG. 46). Each passage 602 and 604 has a slightly reduced diameter cylindrical portion 618 and 620 respectively which serve as mixing chambers for generating (by compressed air-water jet spray intermixture and release to ambient) seeding crystals in operation of spray head 156. The inner end of each passage 602 and 604 is slightly further reduced in diameter and is threaded to individually removably receive and secure therein interior water atomizing nozzles 622 and 623, respectively.

Nozzles 622 and 623 are shown in more detail in FIGS. 62-65, and are identical. Hence, only nozzle 622 and its components are shown in FIGS. 62-65.

As best seen in FIG. 61A, a drilled passageway 624 extends from front starboard face 608 at 2.5° from perpendicularly thereto and intersects the bore of mixing chamber 618 for communication therewith. The same drilling continues inwardly to form a coaxial passage 626 that also intersects bore 618 and enters a central compressed air passageway 628 that is fed by nipple 590. Likewise, a drilled passage 628 extends perpendicularly from face 606 to intersect mixing chamber bore 620. A continuation of this drilling forms passage 630 that intersects bore 620 and communicates at its interior end with compressed air passage 628. Nucleator nozzle 520 is threadably removably mounted in the outer end of passage 624, and nucleator nozzle 522 is threadably removably mounted in the outer end of passage 628. Interior atomizing nozzles 622 and 624 are disposed with their cylindrical filters 640 and 642 exposed within and communicating with the pressurized primary water chamber 592.

Figure 64:
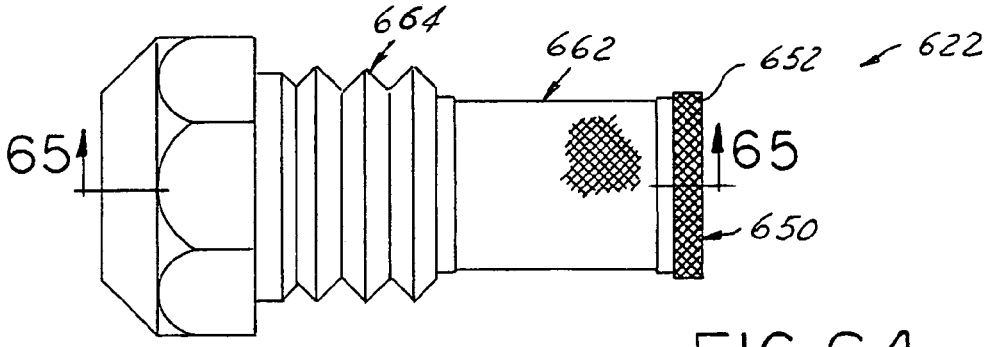
FIG. 64 is a side-elevational view with the components of FIGS. 62 and 63 fully assembled.
Figure 65:
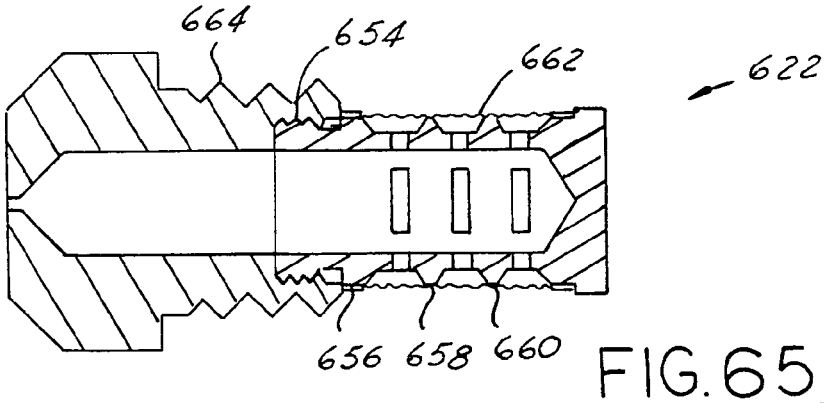
FIG. 65 is a cross-sectional view taken on the line 65-65 of FIG. 64.

Referring to FIGS. 62-65, water atomizing nozzle 622 is made up of a filter-support barrel 650 having a knurled knob 652 at one end, external threads 654 at the other end and filter support straight circular ribs 656 and straight rib 658 and 660 therebetween. A cylindrical stainless steel strainer 662 telescopically slips over holder 650 as shown by the progression from FIGS. 62 to 63. Slots between the ribs feed screen-filtered water into the central passageway of barrel 650. The subassembly of carrier 650 and filter 662 is threaded into the internally threaded bore of nozzle 622 as shown in FIGS. 64 and 65. Assembled nozzle 622 is designed for direct pressure operation to produce a very fine solid stream spray at very high pressure (e.g., 100-500 psi).

In the operation of nucleator manifold 166, and as shown in FIG. 61 compressed air from the central conduit 628 is fed by passages 626 and 630 to the respective mixing chambers 618 and 620 where it encounters the atomized water spray output of nozzles 622 and 624, respectively. The fine water sprays issuing from nozzles 622 and 623 coaxially into chambers 618 and 620 respectively is deflected and mixed up with compressed air entering at a 42.5° angle to these chambers. Then the resultant mixture issues from chambers 618 and 620 through passages 624 and 628, respectively, to the nucleator spray nozzles 520 and 522. The expanding compressed air as it mixes with the atomized water spray in chambers 618 and 620, and begins producing seeding crystals, and the resultant internal mixture of water spray droplets and compressed air as well as seed crystals then issues from the nucleator nozzles 520, 522 and further expands and hence produces large quantities of seeding particles in ambient air, as is well understood in the art.

When it is desired to clean the interior nucleating water atomizing nozzles 622 and 623, the associated plugs 614 and 616 are removed and then the nozzles unscrewed from their threaded seats at the interior end of their respective passageways 602 and 604 and removed for cleaning, and then replaced in the reverse sequence. Of course, nucleator spray nozzles 520 and 522 also may be individually and separately removed from their respective seating bores 624 and 628 without removing the interior nozzles 622 and 624, if desired.

Figure 53:
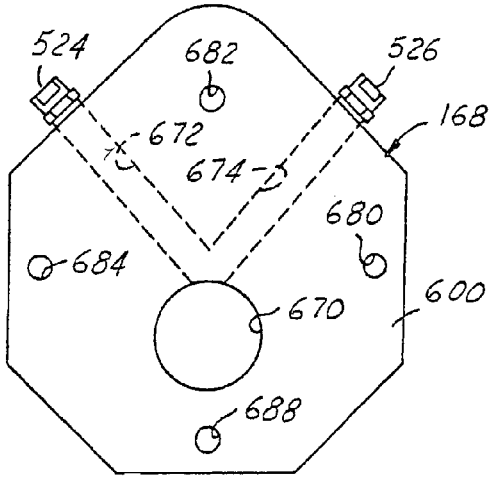
FIG. 53 is a bottom plan view of the cap manifold of the spray head.

Referring to FIGS. 48, 51, 52 and 53, manifold cap 168 of spray head 156 has a water passageway 670 opening in its bottom face 600. When manifold cap 168 is seated with its bottom face 600 against upper face 596 of nucleator manifold 166, passageway 670 communicates with passageway 594. As best seen in FIG. 53, drilled passages 672 and 674 intersect at their inner ends with, and communicate with, water passage 670. The outer ends of passages 672 and 674 threadably receive the water spray nozzles 524 and 526 respectively therein. Water passage 670 is formed as a blind bore (FIG. 48) in manifold cap 168 and hence provides the termination of the upward flow of primary water in the spray head 156.

Figure 58:
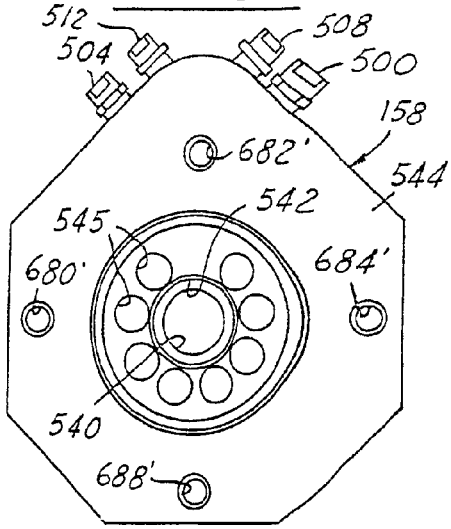
FIG. 58 is a top plan view of the manifold base of the spray head.

To assemble together the spray head individual manifolds to form the assembled spray head shown in FIGS. 46 and 47, each of the manifolds is provided with an axially aligned array of four mounting bolt holes 680, 682, 684 and 688 (see manifold cap showing in FIGS. 51 and 53) so that a long mounting bolt may be inserted through each one of these registered and axially aligned series of mounting bolt passages, with the threaded end of the bolt (not shown) being threaded into the coaxially aligned threaded sockets 680', 682', 684' and 688' provided in the upper face 544 of manifold base 158 (FIG. 58).

Method of Assembling Spray Boom Assembly 128

Referring to FIGS. 66 through 70, the adjustable snow making tower 100 of the invention is preferably constructed, as to the manufacturing of the boom assembly 128, in accordance with the sequence discussed hereinafter in connection with FIGS. 66 through 70. The novel structural arrangement of the components of boom assembly 128 as shown in FIG. 2, in addition to performing their cooperative functions described previously, lend themselves to a sequential assembly fabrication procedure wherein conduit junctions are welded in a novel sequence in conjunction with assembly of components to build up the boom assembly 128. This assembly method enables efficient, reliable and rugged construction of the boom assembly 128 in a manner that will provide leakproof operation. The method of fabrication involves the steps that are represented sequentially in FIGS. 66 through 70, respectively.

Note that in the fabrication step shown in FIG. 66, the air tube 310 is provided with three fins or spacers 311, 313 and 315 (shown in end view in FIG. 4), preferably in five equally-spaced locations along, and for supporting, air tube 310 concentrically with water tube 300.

Note also that in connection with the fabrication steps FIGS. 67 and 68 that a suitable compressed air supply test fitting is to be provided and threadably coupled into the threaded inlet 324 of feed block 134 and the threaded inlet 318 of an inlet coupling 138 for test purposes. Likewise the side branch outlets 372 and 380 of block 134 are to be sealed by providing suitable special valve test caps, adapted to cover and seal the same on both sides of the water feed block 134. In addition, as shown in FIG. 68 the spray head manifold base 158 is provided with a special test cap TC having suitable seals and which is bolted onto upper face 544 of head manifold base 158 using the threaded sockets 680'-688' shown and described in conjunction with FIG. 58 hereinabove.

Referring in more detail to FIGS. 66-70, a first step in the fabrication method for constructing boom assembly 128 is shown in FIG. 66. This figure illustrates the air tube 310 which has been provided with the aforementioned five sets of three fins or spacers 311, 313 and 315 at five equally-spaced locations axially therealong. The spray head manifold assembly 158 has also been completed prior to this step. In addition, the extrusion 148 with its cylindrical water pipe portion 300 and the integral hose housing rectangular channel 302 have also been fabricated with both of these sections initially being of equal length, but being shown in FIGS. 66-70 after cut-off of the hose housing 302 at each end to appropriate length as specified hereinafter. With the foregoing components in hand as subassemblies, a first step is to insert the outlet end of air tube 310 into its socket 538 in manifold base 158 as shown in FIG. 66. A circumferential weld is then welded around the entire circumference of this ¾ inch schedule 40 aluminum pipe to seal the adjoining air tube 310 to manifold base 158 to place the same in communication with the internal passageway 540 of manifold base 158 (see also FIG. 48).

After air tube 310 has so been welded to the head manifold 158 (and also after the air chamber spacers 311, 313 and 315 have been welded to the air tube 310 in the five locations mentioned), the cylindrical portion 300 of extrusion 148 is slid over the air tube and head subassembly 310-158 so that, as shown in FIG. 67, the upper end of the cylindrical extrusion 300 is seated in its socket 536 in manifold base 158 (see FIG. 48). However, at this point in the assembly procedure the outlet end of extrusion 300 is not welded to the manifold base 158.

Note that at the inlet end of extrusion 300 air tube 310 protrudes coaxially therefrom. The air fitting 138 is installed on air tube 310 by having the protruding inlet end of air tube 310 inserted into the air fitting socket 312. Air tube 310 is affixed to fitting 138 by performing a circumferentially continuous sealing weld around the entire circumference of this 3 inch schedule 40 pipe where it protrudes from socket 312. At this point, air tube 310 thus has been welded at its outlet end to its socket in the spray head assembly 158 and at its inlet end to the socket in air fitting 138, and thus this air tube assembly is now ready for air testing to check for leaks at both of these circumferential welds.

In order to so air test the subassembly of FIG. 67, a ¾ inch pipe plug is inserted into socket 542 of base manifold 158. At the other end of the subassembly, a ¼ inch pipe plug is inserted into the passage 319 provided in air feed coupling fitting 138 (see FIGS. 21-22) that will later receive the stem pipe of a conventional air pressure gauge in final assembly. Then, external fittings 322 and 328 of air hose coupling assembly 324 (FIG. 9) are inserted into the threaded bore 320 of fitting 138 for pressurizing with compressed air the welded subassembly of fitting 138, air tube 310 and manifold base 158. All welds and pipe plugs are tested for air leaks by using the usual soapy water test.

It is to be noted that, in preparing for this leak test, extrusion 300/302 is slid axially to the left (as viewed in FIG. 67) relative to air tube 310 in order to slide the outlet end of cylindrical portion 300 out of, and well away from, its socket in manifold base 158 to enable the welded junction of air tube 310 and manifold base 158 to be exposed to be easily soaped and viewed for this leak test.

After this first air test has been successfully passed, the next step in assembling the spray boom assembly 128 is illustrated in the progression from FIG. 67 to FIG. 68. The hose channel 302 is cut back nine inches at its upper end, which is the distance "B" as illustrated in FIG. 68. This cut-back is done prior to inserting extrusion 300 into manifold base 158. Likewise, the lower end of hose channel extrusion 302 is cut back thirteen inches as illustrated by the dimension "A" in FIG. 68. Then the upper end of cylindrical portion 300 of extrusion 148 is re-inserted back into its socket in base manifold 158 and a circumferentially continuous sealing weld is formed around the entire cylindrical portion 300 of extrusion 148.

Then the subassembly of pipe sleeve 136 and water feed block 134 is slidably telescoped over the air feed coupling fitting 138 and over the lower inlet end of the cylindrical portion 300 of extrusion 148 to the position shown in FIG.

68 (see also FIG. 9). Then the circumferential welds 348 and 350, partially illustrated in FIG. 9, are performed to secure and seal subassembly 136/134 in place on extrusion 300.

A custom test cap fixture "TC", shown in FIG. 68, is then bolted against the upper end face 544 of manifold base 158. Fixture TC is provided with suitable seals that plug all of the fluid-conducting openings in the top face 544 of manifold base 158. The ¾ inch pipe plug that was installed in conduit 542 for first leak testing is left in place for this subsequent second leak test procedure. Also, for the second leak testing, test caps (not shown) are installed on the port and starboard sides of water feed block 134 to seal valve openings 372 and 380 (FIGS. 13, 17 and 18).

Then fitting 332 is installed in water inlet opening 325 of block 134 and coupled to a source of compressed air capable of providing test pressures. Compressed air is then supplied to the FIG. 68 subassembly to thereby elevate the internal fluid pressure well beyond maximum operational pressures, and soapy water leak testing is done at the test caps and all welds around sleeve 136, including welds 346, 348 and 350 (FIGS. 9 and 10) and the weld around extrusion pipe 300 at manifold base 158. It is to be understood that the test cap "TC" installed as shown in FIG. 68 is removed after completion of the steps shown and described in conjunction with the steps of FIG. 68.

Figure 69:
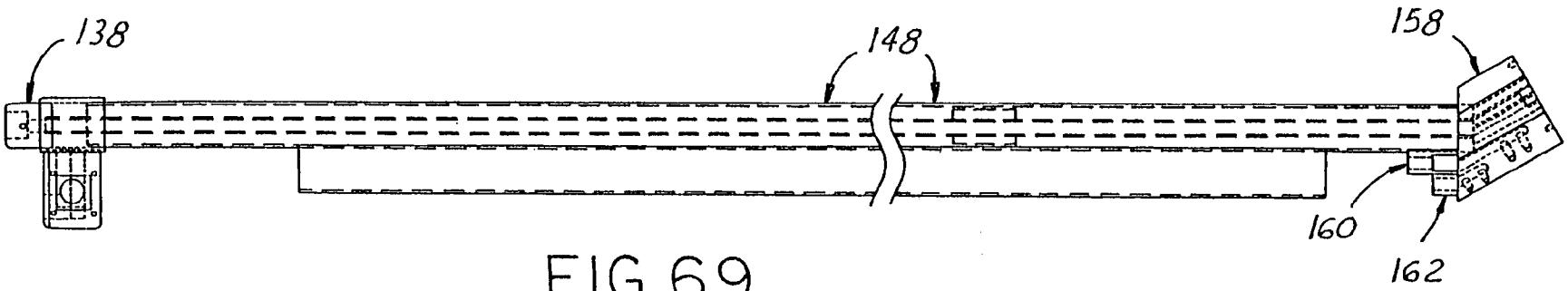

Upon successful completion of this second leak test the fabrication method proceeds to the further assembly and leak test step shown in FIG. 69. Long secondary water transition block 160 is assembled to manifold base 158 as shown in FIG. 48, and a seal weld is made around this block, i.e., around all its edges at its junction with face 159 of manifold block 158 and where it lays adjacent and laterally abuts extrusion tube 300. Then this welding is set for leak testing by installing ¼ inch pipe plugs in the secondary water passages for feeding the secondary water nozzles, these being starboard passages 550 and 542 and the port passages 554 and associated the passage therebelow (not seen) corresponding to passage 552. These passages are those that receive the secondary water spray nozzles 500, 502, 504 and 506 (FIG. 46). An air fitting is installed in the inlet of transition block 160 and compressed air at test pressure is applied. Soapy water is applied to the welds on block 160 and on the pipe plugs in the secondary nozzle-feeding passages to test for leaks around these welds. If this third leak test is passed, the boom fabrication procedure then progresses to the fabrication step shown in FIG. 70.

Figure 70:
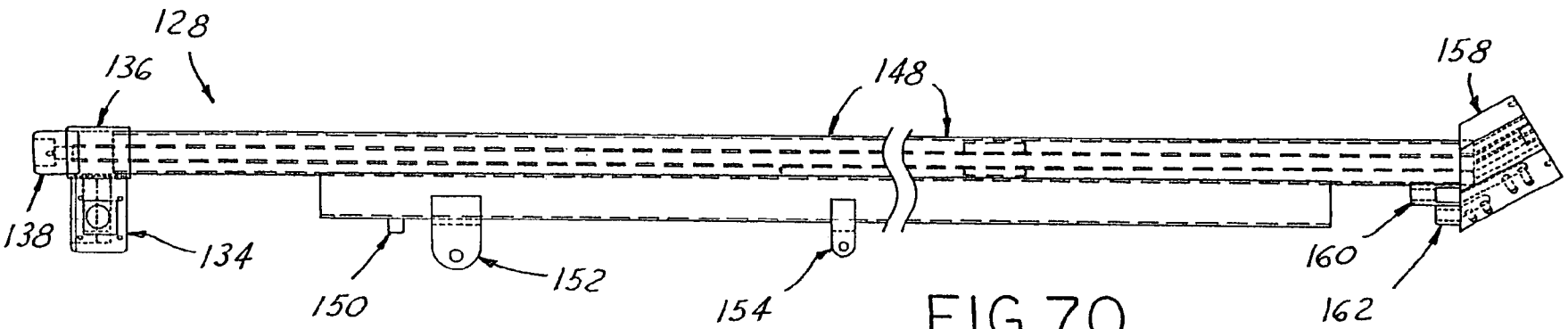

In the fabrication step of FIG. 70, the short transition block 162 is installed and seal seam-welded around all of its edges adjoining manifold base 158 and transition block 160. In addition, pivot stop 150, boom pivot bracket 152, and boom jack bracket 154 are installed and weld affixed on the hose channel section 302 of the extrusion 148. After the short transition fitting 162 is so welded, ¼ inch pipe plugs are individually installed in the nozzle passages 558, 560, 562 and in the nozzle passage corresponding to passage 560 on the port side, these passages being those leading to the tertiary water nozzles 508, 510, 512 and 514 (FIG. 46). Then compressed air pressure leak testing is performed, soapy water testing again being employed for testing for leaks around the welds and pipe plugs. Upon completion of this fourth pressure testing step, all pressure leak testing has been completed.

The foregoing assembly procedure completes the fabrication and incremental leak testing steps of the improved method of assembling the pipe tower components shown in FIG. 70 and described hereinbefore.

Advantages of Snow Making Tower 100 of the Invention

From the foregoing description, it will now be apparent that the snow making tower 100 of the invention provides many features and advantages over the prior art snow making towers, included but not limited to the following:

1. The manner in which primary water is fed into the water feed block 134 and up into chamber 365 in pipe sleeve 136 and then sent out through tube 300 to feed spray head 156, and cooperative the wide-open lateral porting to the secondary and tertiary water supply valves 140 and 142, ensures that turbulent water continuously flows into the entrance cavity in the valve block. Hence heaters are not needed and yet the valves 140 and 142 do not freeze up.

2. The hydraulic jack 116 and safety latch 120 provide compact hoisting apparatus with much mechanical advantage in the hydraulic jack, and the safety latch system enables the boom to be easily and safely positioned at any angular position in the range of pivotal travel established by jack operation. Safety latch 120 ensures that the entire boom may safely retropivot back downwardly a very short distance established by the latch notches and latch pin hook up. The latch can be quickly converted over to a nonlatching mode to allow the boom to be dropped as rapidly as desired under the operator control of the hydraulic release valve on the ram.

3. The modular design of spray head 156 enables manufacturing economies to be achieved and facilitates repair and replacement in the field.

4. The internal nucleation provided in the nucleator manifold 166 provides efficient mixture of compressed air and seed spray in an internal chamber and expansion through a spray nozzle 520, 522 to thereby provide copious quantities of seed crystals for seeding the primary water nozzles from spray head assembly 156. In addition, the filter screens of the internal spray nozzle 622 and 624 are accessible for removal and cleaning or replacement by simply removing the plugs 614 and/or 616 with an Allen wrench (see FIGS. 46 and 61-65).

5. As shown and described in conjunction with FIGS. 66 through 70, the boom assembly 128 of tower 100 enables the air and water chambers of the tower to be isolated and economically leak tested sequentially during assembly to ensure reliable leakproof operation of the final assembly.

6. The welded-on pipe cap 174 installed at the upper end of support pole 104 provides a rugged hemispherical bearing surface for the pipe cap 172 of the support pipe 170 on pole 104 to thereby substantially lower the torque or effort required to turn the tower boom assembly 128, and provides a substantially fail-safe, heavy-duty and long lasting bearing arrangement for this purpose.

7. The provision of upper and lower service locks 114 and 112 greatly enhances the safety anti-rotation lockup of the tower boom assembly to thereby prevent the tower boom assembly 128 from turning even under high wind loads and/or water pressure loads.

8. The deep section channel 302 provides substantial reinforcement against gravity-induced bending loads exerted on the boom assembly 128 while also protecting the secondary and tertiary water feed hoses that are fed through this channel. The use of water hoses instead of extruded conduits for secondary and tertiary water adds manufacturing flexibility in the event that different models are to be offered that in some instance do not use tertiary water, or in other instances do not use secondary and/or tertiary water. Use of waterfeed hoses instead of internal extruded water conduits in the boom also facilitates cleaning these conduit passages due to the ability to easily remove the hoses and replace them with clean hoses, and then return the removed hoses to maintenance for cleaning and repair. Also, in some conditions, the fact that the secondary and tertiary water feed hoses are not in heat transfer relationship with primary water being fed in tube 300 nor with the compressed air being fed in tube 310, can actually result in lower temperature water being fed to the secondary and tertiary spray nozzles, e.g., in those installations where primary water is drawn from surface ponds at a temperature close to freezing and delivered to the snow making tower at such lower temperatures, which in turn further increases snow making efficiencies.

From the foregoing description and the accompanying drawings, it will now be apparent to those skilled in the art, that the snow making pipe tower 100 of the invention provides many advantages and features over the prior art. It will also be appreciated that the preferred embodiments of the snow making tower constructions disclosed herein can be readily altered in construction to adopt features from the invention as disclosed without thereby departing from the spirit and scope of the invention to be protected in pursuit of this provisional application.

What is claimed is:

1. A snow making tower comprising an elongated tower pipe mounted on a support and having upper and lower ends with primary, secondary and tertiary snow making nozzles adjacent the upper end and primary, secondary and tertiary water connections and air connections at the lower end for respective connection to sources of water and air under pressure, an air conduit substantially coextending within said tower pipe with a bottom end thereof connected to said air connection, and wherein the space between said air conduit and the interior wall of said tower pipe defines a primary water conduit, and wherein said air connection exits the lower end of said tower pipe in line therewith and said water connection exits the lower end of said tower pipe at an angle, the improvement in combination therewith of secondary and tertiary water conduits extending along said tower pipe and respectively operably connected at their upper ends to the secondary and tertiary snowmaking nozzles and at their lower ends to the secondary and tertiary water connections, the lower end of said tower pipe being received in and secured to a transverse first wall of a pipe sleeve member having a hollow interior defining a primary water feed chamber communicating with the open lower end of said tower pipe, said air conduit bottom end extending through said primary water feed chamber in said interior space of said pipe sleeve member to an air connection coupling mounted in a transverse second wall of said pipe sleeve member and having fittings externally adapted for coupling to an air supply line, a water feed block member having a first side mounted to a third wall of said pipe sleeve member that extends between and transversely to said pipe sleeve member first and second walls, said water feed block member having a second side extending transversely to said first side and having a primary water source connection entering therein into an initial primary water receiving chamber in said block member oriented in a first flow direction generally parallel to said pipe sleeve member third wall and also to the axis of said tower pipe, said water feed block member having at least one exit passageway communicating between said primary water receiving chambers and oriented to define a second water flow direction generally perpendicular to said first flow direction, and secondary and tertiary water flow control valve assemblies respectively individually mounted to mutually opposed third and fourth sides of said water feed block member that extend transversely to said first and second sides of said block member, said valve assemblies each having an inlet communicating with said initial primary water receiving chamber of said feed block in flow directions transverse to said first and second flow directions, said secondary and tertiary water conduits being respectively operably individually coupled to an outlet of each said secondary and tertiary water flow control valves, whereby, in the feed condition of each said valve assembly a valve member feed passage is open to the turbulent primary water flowing in said inlet chamber of said feed block, whereas in the drain condition of each said valve assembly the turbulent primary water flowing in said inlet chamber of said feed block continually washes against a flow closure side of each said valve member exposed to said inlet chamber of said feed block to thereby create a turbulent flow anti-freezing effect at each said valve assembly.

2. The snowmaking tower of claim 1 wherein each of said valve assemblies resembles a conventional commercially available three-way flow port T-style ball valve assembly having a square cast metal housing with a hollow interior and with openings on each of the four sides of the cube and on the cube bottom, said top wall of the valve body being basically unchanged from such commercial valve assembly and carrying the usual upright travel limit pins limiting travel of a valve operating handle to a fully on position and oppositely to a drain position, said valve handle being fixed to an operating stem that protrudes into the valve body cavity and that in turn is fixed at its inner end to the three-way valve ball that controls liquid flow through the valve assembly, said valve assembly having the usual flanged water feed outlet cap and the flanged water drain outlet end cap bolted to the valve body and respectively covering the water feed side opening and the drain side opening disposed axially opposite said water feed opening and the axially opposite side wall of the valve body, the improvement in combination therewith comprising an inlet side opening that is rendered open without the usual end cap and is enlarged diametrically over that of the conventional ball valve assembly whereby the valve ball and adjacent inlet space within said valve body are wide open to the turbulent flow of primary water entering said feed block via said initial primary water receiving chamber and then impinging an associated transverse back wall of said receiving chamber and then exiting in the second water flow direction such that said valve ball is constantly washed by this turbulent flow even in the feed-closed, drain-open condition thereof to thereby help prevent ice buildup and freeze-up blocking of said valve assembly when set in the drain position.

3. The snowmaking tower of claim 2 wherein said valve assembly is further modified from the commercial form by removing the trunion pin opposite the valve stem that provided the trunion mount of the valve ball and replacing such trunion pin with a blind end cap made up of a concave annular elastomeric seal ring surrounding a solid center plug post, said blind end cap being mounted to the bottom side of the valve body by a blind bottom plug that serves as an imperforate cover plate and also functions to support said valve ball for rotation on said blind end cap seal to thereby serve as a modified trunion support without requiring the prior trunion pin journaling and the construction details associated therewith.

4. The tower of claim 3 wherein a mounting plate/end cap is provided in place of one of the side caps of the conventional valve assembly, said mounting plate/end cap having a mounting plate in the form of a flat square plate carrying a blind end cap at its center and protruding therefrom into the body opening opposite the inlet opening of said valve body housing, the lateral dimensions of said mounting plate exceeding those of the valve body housing to provide a protruding bolt-hole margin area for access to mounting bolt holes in said mounting plate margin area for bolt clamping of said valve assembly to said feed block.

5. The tower of claim 2 wherein said modified valve assembly includes a series of filler rings individually provided one on each of the valve housing end caps to occupy most of the interior dead space normally found in conventional T-flow ball valve assemblies in order to further reduce the likelihood of lock-up due to water freezing interiorly of the valve assembly, each said filler ring being made from a suitable plastic material such as ultra-high molecular weight polyethylene (UHMWPE) and having a cylindrical outer periphery in contour and a beveled tapered nose that converges down from the cylindrical surface to an inner edge that is flush with the edge of a sleeve that carries said valve ball engaging seal, such that when the feed outlet end cap, drain outlet end cap and bottom blind end cap of the said valve assembly are bolt-mounted to the said valve body in final assembly therewith, said filler rings occupy what otherwise would be dead space that otherwise would fill with water when said valve ball is shifted back and forth between the drain and feed positions thereof, and wherein the filler ring carried by said mounting plate likewise is made to occupy most of the dead space behind said valve ball, said filler rings thereby further reducing the possibility of valve lock-up due to water freezing in any of the dead spaces remaining existent in the valve body, what little dead space remains being significantly reduced in volume by said filler rings and hence if water does freeze in the reduced dead space volumes, the ice formation is correspondingly smaller than without said filler rings and hence may be readily broken up by low torque being exerted on said valve handle, that is, said valve is not locked up in the event of such dead water being frozen in the remaining dead spaces of said valve assembly interior, thereby eliminating the need for electrical heaters to prevent freeze ups of said valve assemblies because flowing water does not freeze.

6. The snowmaking tower of claim 1 wherein said elongated tower pipe is in the form of an extrusion comprising a hollow cylindrical portion of constant diameter throughout its length and defining the interior wall of said tower pipe forming the primary water conduit, said extrusion also including a hollow rectangular hose housing channel extruded integrally with and exteriorly of said cylindrical portion, said hose housing comprising two spaced parallel sidewalls integrally joined along their upper edges to the underside of said cylindrical portion of said extrusion and thus being dependent therefrom, and a web wall joined to the lower edges of and extending perpendicularly to said hose channel walls and running lengthwise parallel to the longitudinal axis of said extrusion, said hose housing channel portion of said extrusion functioning as a very strong stiffening member for the cylindrical pipe portion as well as providing ample room for entraining a secondary water feed hose and a tertiary water feed hose so as to extend therethrough side-by-side and thereby provide said secondary and tertiary water conduits.

7. A spray head assembly for mounting on the upper end of an elongated pipe snowmaking tower having primary, secondary and tertiary water conduits and a compressed air conduit, the conduit being adapted to be operably coupled at the lower end of the tower pipe to respective sources of pressurized water and compressed air, the conduits extending the length of the tower pipe to individual outlets at the upper end of the pipe, said spray head assembly comprising a four-piece modular stack up made up of a first manifold carrying tertiary and secondary water spray nozzles respectively communicating with said tower tertiary and secondary water conduits, a second manifold carrying at least one primary water spray nozzle communicating with said tower primary water conduit, a third manifold carrying at least one nucleator spray nozzle communicating with said tower primary water conduit and said tower compressed air conduit, and a fourth manifold carrying at least one primary water spray nozzle communicating with said tower primary water conduit, all of said nozzles being oriented to discharge into ambient atmosphere in a spray zone generally oriented forwardly away from the pipe tower.

8. The spray head assembly of claim 7 wherein said manifolds are generally in the form of solid metal planar disks having matching peripheral contours and being fastened together in a stacked array.

9. The spray head assembly of claim 8 wherein said manifold disks together form starboard and port forward front faces angled at approximately 45° relative to the centerline of said tower pipe and convergent at an apex disposed in a forward direction away from said pipe, and wherein each of said front faces carries a set of said tertiary, secondary and primary water spray nozzles and a nucleator spray nozzle so that the centerline of the spray directions from the nozzles of one of said faces is oriented at generally 90° relative to that from the other of said faces.

10. The spray head assembly of claim 9 wherein said stack up of manifold disks has its assembly centerline oriented at about a 150° included angle with the axis of said tower pipe so that said manifold stack up is generally vertical when the tower pipe is elevated to about 60° from horizontal.

11. The spray head assembly of claim 7 wherein said manifolds are arrayed in a sequential stack up with said first manifold comprises a lowermost base manifold affixed to the upper end of said tower pipe and then as further arrayed in ascending order said second, third and fourth manifolds respectively comprise an intermediate manifold, a nucleator manifold and a cap manifold.

12. The spray head assembly of claim 9 wherein said base manifold carries on each of its port and starboard faces a pair of tertiary water spray nozzles located one above the other and close to the centerline apex of said faces and a pair of secondary water nozzles on each of said faces spaced one above each other and offset laterally from said tertiary nozzles almost to the center of each respective face, said intermediate manifold carrying one primary water spray nozzle on each of its front faces located on the far side of the center of the face relative to the face apex, said nucleator manifold carrying a nucleator nozzle on each of its front faces generally vertically aligned with said water spray nozzles on said intermediate manifold faces, and said cap manifold carrying a primary water spray nozzle on each of its front faces and generally vertically aligned with said associated nucleator nozzles on said nucleator manifold.

13. The spray head assembly of claim 12 wherein each of said nozzles is oriented to direct its spray in a direction generally perpendicular to the associated front face of the associated manifold on which it is mounted so that the sprays from all of the nozzles issuing from the same port or starboard front faces of the nozzle arrays are directed generally parallel to one another.

14. The spray head assembly of claim 13 wherein all of the water spray nozzles are designed to operate with a spray angle of about 50°, whereas the nucleator spray nozzles are designed to operate with a spray angle of about 65'.

15. The spray head assembly of claim 14 wherein each of said manifolds is made as a planar disk with its periphery constituting a seven-sided polygon having the same configuration in radial cross-section as each of the other of said manifolds to provide matching peripheral contours in modular assembly, the front two sides converging at and defining said apex and forming in the stacked array of said port and starboard 45° angle faces.

16. The spray head assembly of claim 11 wherein said nucleator manifold comprises a centrally located compressed air passageway extending generally centrally of the manifold disk generally parallel to the a front face of said nucleator manifold and terminating within said manifold disk as a blind bore, said nucleator spray nozzle being mounted at the outer end of a spray passageway extending generally perpendicularly inwardly from said first front face and intersecting said compressed air passageway, said nucleator manifold also having a second spray passageway that terminates at its outer end at said front face of the manifold, said second spray passageway having internal threads for threadably receiving a sealing plug at the outer end of said second spray passageway, said second spray passageway having a portion intersecting and crossing said first passageway at an acute angle and forming at such intersection a mixing chamber for generating seeding crystals by compressed air-water jet spray and mixture and release to ambient in operation of the nucleator spray head, the inner end of said second spray passageway to individually removably receive and secure therein an associated interior water atomizing spray nozzle oriented to spray into said mixing chamber at an intersecting angle with compressed air entering from said first passageway, said nucleator manifold also having a primary water passageway in which the inlet of said interior atomizing nozzle is disposed.

17. The spray manifold of claim 16 wherein said water atomizing nozzle in said nucleator manifold is made up of a filter-support barrel having a knob at one end, external threads at the other end and filter-support axially spaced circular ribs, a cylindrical strainer telescopically received over said barrel filter holder to form a screen filter for straining pressure water leading to an interior water passage of said barrel via radial ports in said barrel, said interior water passage communicating with a nozzle orifice operable to thereby produce a very fine solid water stream spray at very high pressure, for example 100-500 psi, that is ejected into said mixing chamber of said nucleator manifold where it mixes with expanding compressed air and begins producing seeding crystals to form an internal mixture of water spray droplets, compressed air and seed crystals that feed the associated nucleator spray nozzle and, when exiting therefrom, produce large quantities of seeding particles in ambient air.

18. A snow making tower including in combination an elongated primary-water-conducting conduit pipe having a spray nozzle head at its upper end and being pivotally supported on a ground-mounted support pipe for vertical inclination, said tower including a hydraulic ram jack operably connected between said pipes for providing infinite non-preselected incremental inclinations of said conduit pipe relative to said support pipe, a ram safety latch operably coupled between said pipes for automatically latch/catching said tower conduit pipe if said jack leaks, said tower conduit pipe also carrying secondary and tertiary external flexible water hoses operably selectable to feed pressurized water to respectively associated spray nozzle head secondary and tertiary snowmaking spray nozzles, said conduit pipe also having an internal compressed air conduit operably coupled for feeding compressed air to associated spray head seeding spray nozzles, said tower also including a water feed block operably coupled to the lower end of said conduit pipe and having secondary and tertiary water-feed-and-drain ball valve assemblies mounted on said water feed block and being outlet coupled respectively to said secondary and tertiary water hoses, said ball valve assemblies being constructed and arranged such that in their drain condition incoming turbulent primary water continually washes against a valve ball flow closure side for an anti-freezing effect, said spray nozzle head comprising a four-piece modular planar stack up of disks with operably intercoupled air and water passageways and together carrying said spray nozzles oriented to all discharge forwardly away from the tower conduit pipe in generally parallel spray patterns.

19. The snow making tower of claim 18 further including a ground support pole with a bottom end adapted to be anchored in a ground surface to support said pole upright with an upper end spaced above the ground surface, said tower support pipe being coaxially received over an upper end of said pole for free axial rotation thereon, said tower further having a hemispherically-shaped upper crown provided at the upper end of said support pole to thereby provide a convex bearing surface, said support pipe having a flat cap plate closing its upper end and loosely resting on said crown convex bearing surface to thereby provide a very simple and strong rotational bearing structure to accommodate the axial rotation of said support pipe on said support pole.

20. The snow making tower of claim 18 wherein said hydraulic ram jack has a hydraulic cylinder pivotally connected at its lower end to said tower support pipe and an associated piston reciprocable in said cylinder and having a piston rod protruding from the upper end of said cylinder and pivotally coupled to said tower such that hydraulically-actuated extension of said piston rod from said cylinder pivots the tower upwardly through a range of elevation from generally horizontal to an inclined upright position approaching vertical for elevating said snowmaking nozzles, operation of said jack thus enabling pivotal elevational positioning of said tower in infinite incremental positions as operationally selected during such elevation, any such said elevated position being held by a hydraulic lock-up of the hydraulic fluid that was pumped into said cylinder to drive the piston on the extension stroke, said ram safety latch being operable to automatically latch/catch said tower in the 13 event that the said hydraulic jack experiences internal leakage that allows said piston 14 rod to be forced back into the cylinder by the weight load of said tower bearing thereon.

21. The snowmaking tower of claim 20 wherein said safety latch comprises an inverted C-channel having a planar web with a pair of spaced-apart parallel side flanges dependent therefrom, each of said side flanges being provided with a series of spaced-apart safety latch notches, said safety latch channel being pivotally attached at its upper end to said tower conduit pipe so as to be pivotable in a vertical plane and with its notched side flanges overlying said ram cylinder, said safety latch also including a safety stop pin carried on the upper end of said cylinder and protruding laterally of the pivotal path of travel of said ram so as to bear against said channel flanges, whereby extension of the piston rod of said ram also carries said safety latch channel upwardly, causing the free edges of the channel flanges to be dragged upwardly relative to and slidably along said latch pin, whereby, if leakage occurs causing leakage-induced retraction of said piston rod, when and if said rod is bearing on said flanges out-of-registry with said notches, said latch channel will also ride downwardly relative to and slidably on said latch pin, thereby allowing said pin to relatively ride up and into a locking condition in a registering one of said notches to thereby rigidly couple the upper end of said ram cylinder to said tower and prevent said tower from falling any further despite such leakage condition.

22. The snow making tower of claim 18 wherein said tower conduit pipe has primary, secondary and tertiary incoming water supply connections and an incoming air supply connection at the lower end thereof for respective connection to sources of water and air under pressure, said internal compressed air conduit substantially coextending within said tower pipe with a bottom end thereof connected to said air supply connection, and wherein the space between said internal air conduit and the interior wall of said tower pipe defines a primary water conduit within said tower conduit pipe conduit, and wherein said air connection exits the lower end of said tower pipe in line therewith and said water connection exits via an opening in the lower end of said tower pipe, the lower end of said tower conduit pipe being received in and secured to a transverse first wall of a pipe sleeve member having a hollow interior defining a primary water feed chamber communicating with said opening in the lower end of said tower pipe, said air internal conduit bottom end extending through said primary water feed chamber in said interior space of said pipe sleeve member to a coupling of said incoming air connection mounted in a transverse second wall of said pipe sleeve member and having fittings externally adapted for coupling to an air supply line operably coupled to the pressure air source, a water feed block member having a first side mounted to a third wall of said pipe sleeve member that extends between and transversely to said pipe sleeve member first and second walls, said water feed block member having a second side extending transversely to said first side and having said primary water source connection entering therein into an initial primary water receiving chamber in said block member oriented in a first flow direction generally parallel to said pipe sleeve member third wall and also to the axis of said tower pipe, said water feed block member having at least one exit passageway communicating between said primary water receiving chambers and oriented to define a second water flow direction generally perpendicular to said first flow direction, said secondary and tertiary water feed ball valve assemblies being respectively individually mounted to mutually opposed third and fourth sides of said water feed block member that extend transversely to said first and second sides of said block member, said valve assemblies each having an inlet communicating with said initial primary water receiving chamber of said feed block in flow directions transverse to said first and second flow directions, said secondary and tertiary water hoses being respectively operably individually coupled to an outlet of each said secondary and tertiary water flow control valves, whereby, in the feed condition of each said valve assembly a valve member feed passage is open to the turbulent primary water flowing in said inlet chamber of said feed block, whereas in the drain condition of each said valve assembly the turbulent primary water flowing in said inlet chamber of said feed block continually washes against a flow closure side of each said valve member exposed to said inlet chamber of said feed block to thereby create a turbulent flow anti-freezing effect at each said valve assembly.

23. The snowmaking tower of claim 18 wherein said tower conduit pipe comprises a hollow cylindrical portion defining the interior wall of said tower pipe forming the primary water conduit, said tower conduit pipe also including a hollow rectangular hose housing channel joined longitudinally parallel with and exteriorly of said tower pipe cylindrical portion, said hose housing comprising two spaced parallel sidewalls joined along their upper edges to the underside of said cylindrical portion of said tower pipe and thus being dependent therefrom, and a web wall joined to and extending perpendicularly to said hose channel walls and running lengthwise parallel to the longitudinal axis of said tower pipe, said hose housing channel portion of said tower pipe functioning as a very strong stiffening member for the cylindrical pipe portion as well as providing ample room within said channel walls for entraining said secondary and tertiary water feed hoses arranged so as to extend therethrough and thereby provide said secondary and tertiary water conduits.

24. The snow making tower of claim 18 wherein said spray nozzle head comprises a four-piece modular stack up assembly made up of a first manifold carrying tertiary and secondary water spray nozzles respectively communicating with said tower tertiary and secondary water hoses, a second manifold carrying at least one primary water spray nozzle communicating with said tower primary water conduit, a third manifold carrying at least one nucleator spray nozzle communicating with said tower primary water conduit and said tower compressed air conduit, and a fourth manifold carrying at least one primary water spray nozzle communicating with said tower primary water conduit, all of said nozzles being oriented to discharge into ambient atmosphere in a spray zone generally oriented forwardly away from the pipe tower.

25. The tower of claim 24 wherein said manifolds are generally in the form of solid metal planar disks having matching peripheral contours and being fastened together in a stacked array.

26. The tower of claim 25 wherein said manifolds are arrayed in a sequential stack up with said first manifold comprising a lowermost base manifold affixed to the upper end of said tower pipe and then, as further arrayed in ascending order, said second, third and fourth manifolds respectively comprise an intermediate manifold, a nucleator manifold and a cap manifold, and wherein each said manifold has port and starboard forward-facing front faces angled at about 90° relative to one another and defining at their mutual vertex in assembly a center line apex of said front faces of said spray nozzle head.

27. The tower of claim 26 wherein said base manifold carries on each of its port and starboard front faces a pair of tertiary water spray nozzles located one above the other and close to the centerline apex of said front faces and a pair of secondary water nozzles on each of said front faces spaced one above each other and offset laterally from said tertiary nozzles almost to the center of each respective front face, said intermediate manifold carrying one primary water spray nozzle on each of its front faces located on the far side of the center of the associated front face relative to the face apex, said nucleator manifold carrying a nucleator nozzle on each of its front faces generally vertically aligned with said water spray nozzles on said intermediate manifold front faces, and said cap manifold carrying a primary water spray nozzle on each of its front faces and generally vertically aligned with said associated nucleator nozzles on said nucleator manifold.

28. The tower of claim 27 wherein each of said nozzles is oriented to direct its spray in a direction generally perpendicular to the associated front face of the associated manifold on which it is mounted so that the sprays from all of the nozzles issuing from the same port or starboard front faces of the nozzle arrays are directed generally parallel to one another.

29. The tower of claim 28 wherein each of said manifolds is made as a planar disk with its periphery constituting a seven-sided polygon having the same configuration in radial cross-section as each of the other of said manifolds to provide matching peripheral contours in modular assembly, the front two sides converging at and defining said apex and forming in the stacked array of said port and starboard 45° angle front faces.

30. The tower of claim 26 wherein said nucleator manifold comprises a centrally located compressed air passageway extending generally centrally of the manifold disk generally parallel to the a first front face of said nucleator manifold, said nucleator spray nozzle being mounted at the outer end of a spray passageway extending generally perpendicularly inwardly from said first front face and intersecting said compressed air passageway, said nucleator manifold also having a second spray passageway that terminates at its outer end at said first front face of the manifold, said second spray passageway receiving a sealing plug at the outer end of said second spray passageway, said second spray passageway having a portion intersecting and crossing said first passageway at an acute angle and forming at such intersection a mixing chamber for generating seeding crystals by compressed air-water jet spray violent intermixture and release to ambient in operation of the nucleator spray head, the inner end of said second spray passageway individually removably receiving therein an associated interior water atomizing spray nozzle oriented to spray into said mixing chamber at an intersecting angle with compressed air entering from said first passageway, said nucleator manifold also having a primary water passageway in which the inlet of said interior atomizing nozzle is disposed.

31. The tower of claim 30 wherein said water atomizing nozzle in said nucleator manifold is made up of a filter-support barrel and a cylindrical strainer telescopically received over said barrel filter support to form a screen filter for straining pressure water leading to an interior water passage of said barrel via radial ports in said barrel, said interior water passage communicating with a nozzle orifice operable to thereby produce a very fine solid water stream spray at very high pressure, for example 100-500 psi, that is ejected into said mixing chamber of said nucleator manifold where it mixes with expanding compressed air and begins producing seeding crystals to form an internal mixture of water spray droplets, compressed air and seed crystals that feed the associated nucleator spray nozzle and, when exiting therefrom, produce large quantities of seeding particles and frozen water snow particles in ambient air.

* * * * *